US006257700B1

(12) United States Patent
Aihara et al.

(10) Patent No.: US 6,257,700 B1
(45) Date of Patent: Jul. 10, 2001

(54) PRINTING APPARATUS AND METHOD FOR CONTROLLING THE SPREAD OF FLUID AROUND A NOZZLE ORIFICE

(75) Inventors: Takashi Aihara, Chiba; Tohru Naganuma, Kanagawa; Makoto Ando; Kenji Okamoto, both of Tokyo; Koichiro Kishima, Kanagawa, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 08/787,269

(22) Filed: Jan. 24, 1997

(30) Foreign Application Priority Data

Jan. 31, 1996 (JP) ..... 8-015968
Nov. 28, 1996 (JP) ..... 8-318185

(51) Int. Cl.[7] ..... B41J 2/135
(52) U.S. Cl. ..... 347/44; 347/45; 347/95
(58) Field of Search ..... 347/44, 47, 48, 347/95, 45

(56) References Cited

U.S. PATENT DOCUMENTS 4,746,935 * 5/1988 Allen ..... 347/101
5,212,050 * 5/1993 Mier et al. ..... 430/320
5,777,636 * 7/1998 Naganuma et al. ..... 347/10
5,811,019 * 9/1998 Nakayama et al. ..... 347/47
5,825,379 * 10/1998 Kagami ..... 347/20
6,086,196 * 7/2000 Ando et al. ..... 347/95

FOREIGN PATENT DOCUMENTS

655337 A2 5/1995 (EP) .
655337 * 5/1995 (JP) .
WO 9408793 4/1994 (WO) .

* cited by examiner

*Primary Examiner*—John Barlow
*Assistant Examiner*—Michael S Brooke
(74) *Attorney, Agent, or Firm*—Ronald P. Kananen; Rader, Fishman & Grauer

(57) ABSTRACT

A printing apparatus having a printing head that prevents ink, diluent, and a mixed solution thereof from adhering to and spreading about a portion of the printing head around a nozzle. The printing apparatus has an enhanced ability to reproduce a gradation of concentration, thereby making it possible to form a recorded image of high resolution. The printing head has a first nozzle, which discharges a discharge medium, and a second nozzle, which discharges a metering medium. The orifices of the first and second nozzles are adjacent to each other in a nozzle outlet face of the printing head. A groove, a hydrophilic portion, or an insular projection is formed between the first and second nozzles to control the spread of ink, diluent, and a mixed solution thereof around the nozzles. The hydrophilic portion may be made by a non-processed portion of the outlet face of the printing head, and a portion other than the nonprocessed portion may be made a hydrophobic portion. Several variations of the groove, hydrophilic portion, and insular projection are disclosed.

27 Claims, 48 Drawing Sheets

PRINTING APPARATUS AND METHOD FOR CONTROLLING THE SPREAD OF FLUID AROUND A NOZZLE ORIFICE

BACKGROUND OF THE INVENTION

1. Field of the Invention

The present invention relates generally to a printing apparatus for mixing and ejecting a metering medium and a discharge medium and, more particularly, to a printing apparatus which has a means for controlling the spread of ink, diluent, and a mixed solution around a nozzle to form a recorded image of high resolution.

2. Description of the Related Art

In recent years, particularly in offices, documents have increasingly been composed and printed with computers, which is called desk top publishing. It has been recently requested to print not only a character and a figure, but also a colored natural image of a high quality, such as a photograph, along with the character and the figure. Thus, it has been important to reproduce a halftone color.

In addition, an on-demand-type printing apparatus, which discharges a drop of ink solution from a nozzle to a sheet of paper, film, or the like according to a printing signal only when it is necessary for printing, has been used widely in recent years because it is easy to miniaturize the printing apparatus and to lower its cost.

Although various kinds of methods have been proposed for discharging a drop of the ink solution, it is common to use a piezo-electric element or a heating element. The former is a method of discharging a drop of the ink solution by pressurizing the ink with a deformation of a piezo-electric element. The latter is a method of discharging a drop of the ink solution with a pressure of bubbles generated by heating and boiling the ink with a heating element.

In addition, various kinds of methods have been proposed for reproducing the above-described halftone color with the on-demand-type printing apparatus which discharges a drop of the ink solution as described above. The first method is to control the size of a drop of the ink solution by changing a voltage or a pulse length of a voltage pulse provided to the piezo-electric element or the heating element and thus to change the diameter of a printing dot and to produce gradation therewith.

However, in this method too small of a voltage or pulse length provided to the piezo-electric element or the heating element will not discharge the ink. Therefore, this method has a limit to the minimum diameter of a drop of the ink solution, a relatively small number of expressible gradation levels, and a particular difficulty in expressing lower concentrations. Accordingly, this method is not sufficient to print out a natural image of high quality.

The second method is to compose a picture element with a matrix including 4×4 dots, for example, without changing the diameter of the dot, and to express the gradation by this matrix, or a dither method. This method can express 17 levels of gradation. However, in this method, for example, if a printing is performed in the same dot density as in the first method, the resolution of the picture in this method is a quarter of that in the first method and coarseness is noticeable. Accordingly, this method is not sufficient to print out a natural image of high quality.

On the other hand, the inventors have proposed a printing apparatus which mixes diluent and ink to discharge a drop of the mixed liquid, changes the concentration of a drop of the discharged ink, and thereby can control the concentration of the printed dot to express the gradation without deteriorating the resolution and to print out a natural image.

According to the above-described concept, there is a print head having a first nozzle into which discharge medium is introduced, and a second nozzle into which metering medium is introduced. The first nozzle is adjacent to the second nozzle. The second nozzle oozes a metered amount of the metering medium toward the first nozzle to mix with the discharge medium in the vicinity of an orifice of the first nozzle. A discharge medium is pushed out from the first nozzle with the discharge medium mixed with the metering medium. The discharge medium and metering medium are thereby discharged in a mixed state in a direction between the faces of the first nozzle and the second nozzle. In this case, one of the above-described metering medium and discharge medium is the ink and the other is a diluent.

In the above-described print head, however, as shown in FIGS. 1 and 2, liquid 104, such as ink, diluent, or a mixed solution or the like, spreads around the orifices of the first nozzle 102 and the second nozzle 103 of the nozzle outlet face 101*a* where the first nozzle 102 and the second nozzle 103 of the print head 101 are opened. This spreading of the liquid 104 causes a number of problems.

For example, when the liquid 104 adheres to the part around the orifices of the first nozzle 102 and the second nozzle 103, a condition occurs wherein the liquid 104 adheres to an unnecessary part of the print head during printing, thereby causing a worse printing.

In addition, when the liquid 104 adheres to the part around the orifices of the first nozzle 102 and the second nozzle 103, the ink, the diluent, or the mixed solution discharged from each nozzle is displaced in its discharging direction during printing later, which produces a worse printing.

Moreover, when the liquid 104 adheres to the part around the orifices of the first nozzle 102 and the second nozzle 103, there is a strong possibility that it has an effect on a mixing ratio of the ink and the diluent during printing later and, thus, the response to a change of concentration is lost. The gradation of the concentration in the dot, therefore, cannot be correctly reproduced and, therefore, the resolution of the recorded image is lost.

Furthermore, for the print head to reproduce precise shades of dots, the print head must stably mix a specified amount of metering medium with the discharge medium, and detach the mixture from the print head. Accordingly, for the print head with the above constitution to ensure detachment of the mixture comprising the metering medium and the discharge medium from the print head, the print head is provided with a liquid-repellent membrane.

Referring now to FIGS. 3 and 4, for a specified amount of the metering medium to stably mix with the discharge medium in the print head, which is provided with a first nozzle 201 having a round opening to eject the discharge medium and a second nozzle 202 having an elliptic opening to eject the metering medium, the metering medium should not be pushed out equally in all directions from the second nozzle 202, but in a specific direction with respect to the position of the first nozzle 201.

As illustrated in FIG. 4, with the liquid repellent membrane coated on the whole surface around the openings of the nozzles, however, the metering medium 203 ejected from the second nozzle 202 spreads equally in all directions around the opening of the second nozzle 202, as indicated by the arrows A. If the metering medium were allowed to spread equally in all directions, as indicated in FIG. 4, it might happen that the metering medium 203 could not reach the first nozzle 201 from which the discharge medium is ejected. This would obliterate the required mixing of the metering medium and the discharge medium, which would destroy the precise quantification of the volume of the metering medium 203.

To meet such situations, the print head with the above constitution has the first nozzle to eject the discharge medium and the second nozzle to push out the metering medium placed as close together as possible. This arrangement allows a minute to large amount of metering medium 203 to be put to mixing, which then allows reproduction of a wide range of graded tones.

To produce a print head in which the first nozzle 201 and the second nozzle 202 are placed as near as possible, however, it is necessary to improve the positioning precision of the machines responsible for the manufacture of the print head. Thus, stable production of such print heads would be difficult or require a high cost.

In view of above, there is a need for a printing apparatus which suppresses the adherence of ink, diluent and their mixture to the parts around the nozzles, minimizes failures in printing, allows precise reproduction of graded tones, and thereby enables reproduction of high-resolution graphic images, and a method for manufacturing such a printing apparatus.

SUMMARY OF THE INVENTION

Accordingly, an object of the present invention is to provide a printing apparatus which can form a recorded image of high resolution by preventing the ink, the diluent, or the mixed solution thereof from adhering to the part around the nozzles, and thereby preventing the occurrence of a worse printing, and by correctly reproducing the gradation of the concentration.

In order to solve the above-described problems, a printing apparatus according to the present invention has a print head comprising: a first chamber into which a discharge medium is introduced; a second chamber into which a metering medium is introduced; a first nozzle having a first orifice, communicating with the first chamber; and a second nozzle having a second orifice, communicating with the second chamber. The print head is characterized by the first and second nozzles being formed in a nozzle member having a surface on which the first and second orifices are formed to ooze the metering medium from the second orifice to the first orifice through the surface, and a means for controlling a spread of metering medium being formed on the surface between the first and second orifices. The means for controlling a spread of metering medium can be in the form of a groove, a hydrophilic portion, or an insular projection.

Thus, according to a first aspect of the present invention, a printings apparatus is provided which includes a print head comprising: a first chamber into which a discharge medium is introduced; a second chamber into which a metering medium is introduced; a first nozzle having a first orifice, communicating with the first chamber; and a second nozzle having a second orifice, communicating with the second chamber. The print head is characterized by first and second nozzles which are formed in a nozzle member having a surface on which the first and second orifices are formed to ooze the metering medium from the second orifice to the first orifice through the surface, and a groove which is formed on the surface between the first and second orifices.

It is desirable that the width of the groove of the above-described printing apparatus according to the present invention is smaller than a diameter of an orifice of the second nozzle.

In addition, the groove of the above-described printing apparatus according to the present invention may be formed from an orifice of the second nozzle to an orifice of the first nozzle or from an orifice of the second nozzle to a middle part between an orifice of the second nozzle and an orifice of the first nozzle.

Moreover, if the groove of the printing apparatus according to the present invention is formed in the latter shape, it is desirable that the depth of the groove becomes gradually smaller from the second nozzle toward the first nozzle.

Further, if the groove of the printing apparatus according to the present invention is formed in the latter shape, a groove may be formed from the orifice of the first nozzle to a middle part between the orifice of the first nozzle and the orifice of the second nozzle. In this case, it is desirable that the depth of the groove becomes gradually smaller from the first nozzle toward the second nozzle.

If the groove is formed from the orifice of the second nozzle to the orifice of the first nozzle, the depth of the groove may be large by the side of the orifice of each nozzle and become smaller toward a middle part between the orifices of the nozzles.

Further, it is desirable that the printing apparatus according to the present invention has a recess formed at least around the orifice of the second nozzle in a nozzle outlet face of the print head so as to surround the orifice of the second nozzle therewith. It is also desirable that the printing apparatus has a recess around the orifice of the first nozzle so as to surround the orifice of the first nozzle therewith. These recesses may be connected to the grooves.

According to a second aspect of the present invention, a printing apparatus is provided having a print head comprising: a first chamber into which a discharge medium is introduced; a second chamber into which a metering medium is introduced; a first nozzle having a first orifice, communicating with the first chamber; and a second nozzle having a second orifice, communicating with the second chamber. The print head is characterized by first and second nozzles which are formed in a nozzle member having a surface on which the first and second orifices are formed to ooze the metering medium from the second orifice to the first orifice through the surface, and a hydrophilic portion which is formed on the surface between the first and second orifices.

The printing apparatus according to the second aspect of the present invention may have a portion processed so as to be hydrophobic (hereinafter referred to as a hydrophobic portion) in the portion other than the hydrophilic portion.

Further, the hydrophilic portion of the above-described printing apparatus according to the present invention may be formed from the orifice of the second nozzle to the orifice of the first nozzle or from the orifice of the second nozzle to a middle part between the orifice of the second nozzle and the orifice of the first nozzle.

Furthermore, if the hydrophilic portion of the printing apparatus according to the present invention is formed in the latter shape, the hydrophilic portion may also be formed from the orifice of the first nozzle to a middle part between the orifice of the first nozzle and the orifice of the second nozzle.

Further, it is desirable that the printing apparatus according to the present invention has a hydrophilic portion formed at least around the orifice of the second nozzle in a nozzle outlet face of the printing head so as to surround the orifice of the second nozzle therewith. It is also desirable that the nozzle outlet face has also a hydrophilic portion formed around the orifice of the first nozzle so as to surround the orifice of the first nozzle therewith. These hydrophilic portions around the orifice of the nozzle may be connected to the above-described hydrophilic portions formed at the middle part between the orifice of the first nozzle and the orifice of the second nozzle.

Further, the present invention is characterized in that the hydrophilic portion of the printing apparatus having the above-described hydrophilic portion is made a non-processed portion, and the remaining portion thereof is made a hydrophobic portion.

According to a third aspect of the present invention, a printing apparatus is provided having a print head comprising: a first chamber into which a discharge medium is introduced; a second chamber into which a metering medium is introduced; a first nozzle having a first orifice, communicating with the first chamber; and a second nozzle having a second orifice, communicating with the second chamber. The print head is characterized by the first and second nozzles which are formed in a nozzle member having a surface on which the first and second orifices are formed to ooze the metering medium from the second orifice to the first orifice through the surface, and an insular projection which is formed on the surface between the first and second orifices.

Furthermore, the printing apparatus according to the present invention has a first pressure chamber to incorporate the discharge medium and a second pressure chamber to incorporate the metering medium, and has the first nozzle communicating with the first pressure chamber and the second nozzle communicating with the second pressure chamber. The first and second nozzles are placed such that their openings are adjacent each other, whereby, after the metering medium has oozed, the discharge medium is allowed to eject through the first nozzle to mix with the metering medium. The surface of the print head flush with the nozzle openings is coated with a liquid-repellent membrane, and a groove is formed between the openings of the first and second nozzles after the selective removal of a portion of the liquid-repellent membrane corresponding to the groove.

Incidentally, for the printing apparatus of the present invention, the width of the groove is preferably smaller than the diameter of the opening of the second nozzle.

In addition, for the printing apparatus of the present invention, the groove preferably communicates at least with the opening of the second nozzle, and extends from the opening of the second nozzle up to the opening of the first nozzle.

Still further, for the printing apparatus of the present invention, a plurality of grooves may be prepared. Also in this case, the plurality of grooves preferably communicate at least with the opening of the second nozzle, and extend from the opening of the second nozzle up to the opening of the first nozzle.

Also in this case, the width occupied by the plurality of grooves is preferably smaller than the diameter of the opening of the second nozzle. Still further, for the printing apparatus of the present invention, another plurality of grooves may be prepared with a right angle to the plurality of grooves communicating with the opening of the second nozzle. Incidentally, for the printing apparatus of the present invention, the liquid-repellent membrane is preferably formed after a liquid-repellent material has been coated. Further, for the printing apparatus of the present invention, a liquid-repellent membrane is preferably prepared on the bottom surface of the groove.

The liquid-repellent membrane generally, including the liquid-repellent membrane applied on the bottom surface of the groove, is preferably made of a polyimide material, and the polyimide material is preferably photosensitive.

Further, the method for the manufacture of the printing apparatus of the present invention includes the steps of: forming a hydrophobic film on a surface of a nozzle member; forming a first nozzle, into which a discharge medium is introduced, and a second nozzle, into which a metering medium is introduced, in the nozzle member, the first nozzle having a first orifice on the surface, and the second nozzle having a second orifice on the surface, the first and second orifices being placed to ooze the metering medium from the second orifice to the first orifice through the surface; and removing the hydrophobic film from a portion of the surface between the first and second orifices to define a groove. Incidentally, in the method, preparation of the groove may come before the formation of the first and second nozzles.

The liquid-repellent membrane is preferably made of a polyimide material having photosensitivity. Further, in the method, the liquid-repellent membrane may be prepared as a two-layered structure by having one layer overlying another. Then, a portion of the superficial layer is selectively removed to form a groove whose bottom is formed by the underlying liquid-repellent layer. In this case, the superficial layer is preferably made of a polyimide material having photosensitivity.

Incidentally, in this case, the underlying layer is preferably made of a polyimide material. Further, if the underlying material is made of a material requiring polymerization, application of the superficial layer onto the underlying layer preferably takes place before polymerization of the underlying layer.

Further, in the method of the present invention, the selective removal of the liquid-repellent membrane is preferably performed by photolithography.

Since the printing apparatus according to the present invention has a groove formed between the orifice of the first nozzle and the orifice of the second nozzle, which is adjacent to the orifice of the first nozzle in the nozzle outlet face, for example, from the orifice of the second nozzle to the orifice to the first nozzle, and the metering medium oozing from the second nozzle travels along the above-described groove owing to a capillary action toward the first nozzle, the metering medium hardly leaks to the portion other than the groove, which thereby prevents the metering medium from adhering to the portion around the orifice of the nozzle.

Further, if the groove is formed from the orifice of the second nozzle to the middle part between the orifice of the second nozzle and the orifice of the first nozzle, the metering medium is well introduced into the second nozzle when the metering medium is introduced into the second nozzle so as to quantify the metering medium by making the metering medium ooze from the second nozzle toward the first nozzle and then making a metered amount of the metering medium remain around the orifice of the first nozzle, which thereby prevents the metering medium from adhering to the portion around the orifice of the nozzle.

Further, if the groove is formed from the orifice of the first nozzle to the middle part between the orifice of the first nozzle and the orifice of the second nozzle, when the metering medium is metered as described above, the metered amount of the metering medium is better separated from the introduced-metering medium, which thereby prevents the metering medium from adhering to the portion around the orifice of the nozzle. If the width of the groove is smaller than the orifice of the second nozzle, the capillary action tends to occur.

Further, when the groove is formed from the orifice of the second nozzle to the middle part between the orifice of the second nozzle and the orifice of the first nozzle, if the depth of the groove is made gradually smaller from the second nozzle toward the first nozzle, the metering medium is better metered.

Further, when the groove is also formed from the orifice of the first nozzle to the middle part between the orifice of the first nozzle and the orifice of the second nozzle, if the depth of the groove is made gradually smaller from the first nozzle toward the second nozzle, the metering medium is still better metered.

Further, if the printing apparatus according to the present invention has a recess formed at least around the orifice of the second nozzle in a nozzle outlet face of the printing head so as to surround the orifice of the second nozzle therewith and, in addition, it also has a recess formed around the orifice of the first nozzle so as to surround the orifice of the first nozzle there with, it can prevent the ink, the diluent and the mixed solution from spreading around the orifice of the nozzle.

Further, since the printing apparatus according to the present invention has a hydrophilic portion formed between the orifice of first nozzle and the orifice of the second nozzle, which is adjacent to the orifice of the first nozzle in the nozzle outlet face of the print head, for example, from the orifice of the second nozzle to the orifice of the first nozzle, and wettability of the above-described hydrophilic portion for the metering medium is considerably good, the metering medium oozing from the second nozzle travels along the above-described hydrophilic portion to be supplied toward the first nozzle and hardly leaks to the portion other than the above-described hydrophilic portion. This controlled flow of the metering medium prevents the metering medium from adhering to the portion around the orifice of the nozzle.

Further, if the above-described hydrophilic portion is formed from the orifice of the second nozzle to the middle part between the orifice of the second nozzle and the orifice of the first nozzle, the metering medium is well introduced into the first nozzle when the metering medium is introduced into the first nozzle so as to quantify the metering medium by making the metering medium ooze from the second nozzle to the first nozzle and then making a metered amount of the metering medium remain around the orifice of the first nozzle, which thereby prevents the metering medium from adhering to the portion around the orifice of the nozzle.

Further, if the above-described hydrophilic portion is also formed from the orifice of the first nozzle to the middle section between the orifice of the first nozzle and the orifice of the second nozzle, when the metering medium is metered as described above, the metered amount of the metering medium is still better separated from the introduced metering medium, which thereby prevents the metering medium from adhering to the portion around the orifice of the nozzle.

Further, if the portion other than the hydrophilic portion in the nozzle outlet face of the print head of the printing apparatus is made a hydrophobic portion, the metering medium travels still selectively along the hydrophilic portion.

Further, if the printing apparatus according to the present invention has a hydrophilic portion formed at least around the orifice of the second nozzle in a nozzle outlet face of the print head so as to surround the orifice of the second nozzle therewith and, in addition, the printing apparatus also has a hydrophilic portion formed around the orifice of the first nozzle so as to surround the orifice of the first nozzle therewith, it can prevent the ink, the diluent, and the mixed solution from spreading around the orifice of the nozzle.

Further, in the printing apparatus according to the present invention, if the above-described hydrophilic portion is made a non-processed portion, and the portion other than the hydrophilic portion is made a hydrophobic portion, the same effect as in the case of forming the hydrophilic portion is produced.

Further, since the printing apparatus according to the present invention has an insular projection formed between the orifice of the first nozzle and the orifice of the second nozzle, which is adjacent to the orifice of the first nozzle in the nozzle outlet face, and the metering medium oozing from the second nozzle travels along the contour of the above-described projection owing to a capillary action to be supplied toward the first nozzle, the metering medium hardly leaks to the portion other than the projection, which thereby prevents the metering medium from adhering to the portion around the orifice of the nozzle.

In addition, in the printing apparatus of the present invention, a liquid-repellent membrane is formed on the surface flush with the openings of the nozzles of the print head, the portion of the liquid-repellent membrane between the openings of the first and second nozzles adjacent to each other is selectively removed, and a groove is formed therein.

"Wettability" at an interface between a solid and a liquid depends on the roughness of the surface of the solid. Namely, when the contact angle between a solid having a substantial surface area and a liquid having a substantial surface area is larger than 90 degrees, wettability is impaired as the surface roughness increases. On the contrary, when the contact angle between a solid having a substantial surface area and a liquid having a substantial surface area is smaller than 90 degrees, wettability is improved as the surface roughness increases.

The metering medium used in the printing apparatus of the present invention has a contact angle equal to or less than 90 degrees with respect to the liquid-repellent material and, thus, as discussed earlier, wettability is improved as the surface roughness increases.

Accordingly, in the printing apparatus of the present invention, the groove formed after selective removal of a portion of the liquid-repellent membrane is made to have a rougher surface than other nearby portions, thereby raising its wettability so that the metering medium under pressure will selectively flow through the groove and its vicinity. With such constitution, even a minute amount of metering medium can stably flow under pressure towards the first nozzle. This arrangement makes it unnecessary to place the first and second nozzles as close as possible, which contributes to widening the range of producible graded tones.

Further, in the printing apparatus of the present invention, the width of the groove is made smaller than the diameter of the opening of the second nozzle. Being smaller than the diameter of the second nozzle, the width of the groove is also smaller than the diameter of a drop of the metering medium pushed out from the second nozzle under pressure and, thus, the drop of the metering medium readily chooses to flow through the groove because the surface of the groove is rougher than nearby portions. This constitution allows the metering medium to flow stably toward the first nozzle.

The characteristics of the printing apparatus described above also hold true for a printing head having a groove consisting of a number of hollow lines. The metering medium flows under pressure through these lines and their inter-line surfaces. When the width of the groove consisting of a plurality of lines is made smaller than the diameter of the opening of the second nozzle, the metering medium readily chooses to flow through the groove because the surface of the groove is rougher than nearby portions. This constitution allows the metering medium to flow stably towards the first nozzle.

Further, when the printing apparatus of the present invention is allowed to have a liquid-repellent membrane formed on the bottom of the groove, during standby intervals, no spontaneous mixing of the metering medium and the discharge medium occurs through the groove.

Furthermore, during the manufacture of the printing apparatus of the present invention, the liquid-repellent membrane may be prepared as a two-layered structure by having one layer overlay another, and then a portion of the superficial layer can be selectively removed. This allows ready production of a groove whose bottom is formed with a liquid-repellent layer.

Still further, when the liquid-repellent membrane is made of a polyimide material, the groove can be readily made by photolithography. When the liquid-repellent membrane is prepared by having one layer overlay another, and at least the superficial layer is made of a photosensitive polyimide material, the groove can be readily made by photolithography.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENTS

The preferred embodiments are hereinafter described in detail with reference to FIGS. 5 to 65 of the accompanying drawings.

Figure 1:
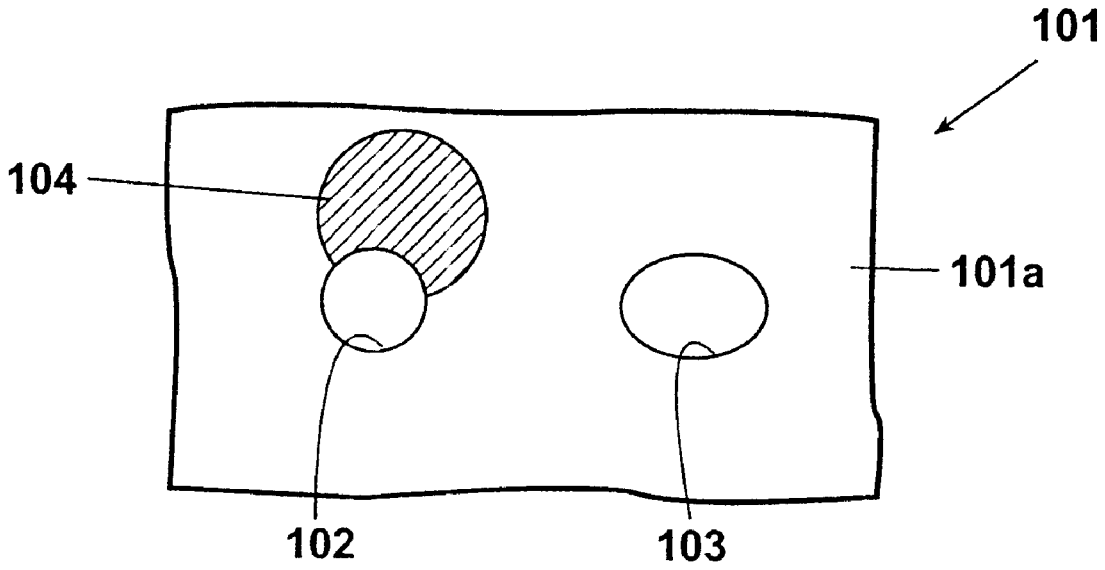
Fig. 1 (PRIOR ART)
FIG. 1 is an enlarged plan view illustrating an example of a situation that liquid adheres to the portion around the orifice of the nozzle of a print head of a related printing apparatus.
Figure 2:
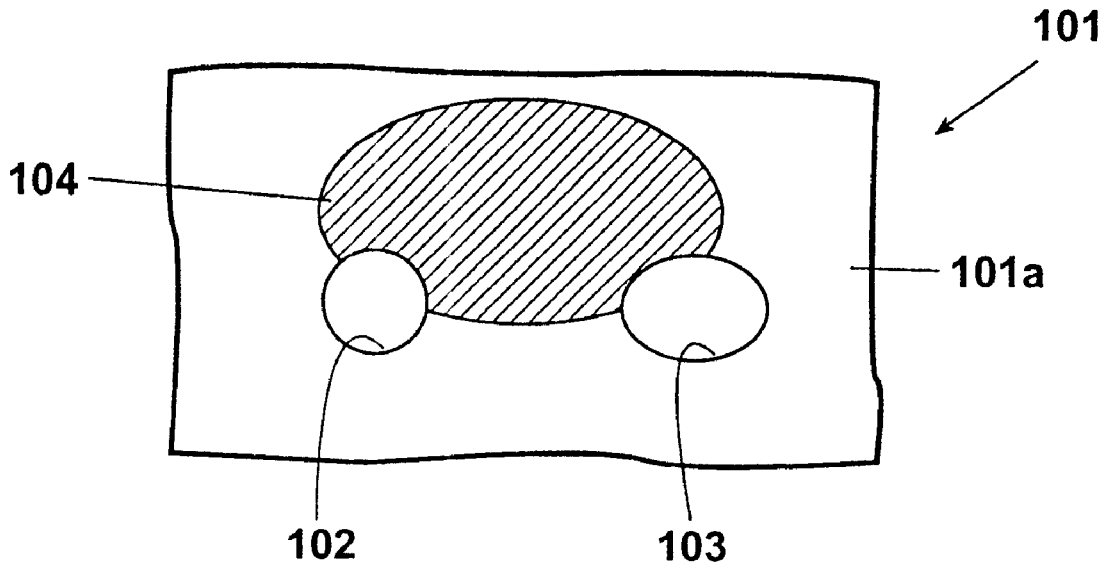
Fig. 2 (PRIOR ART)
FIG. 2 is an enlarged plan view illustrating another example of a situation that liquid adheres to the portion around the orifice of the nozzle of a print head of a related printing apparatus.
Figure 3:
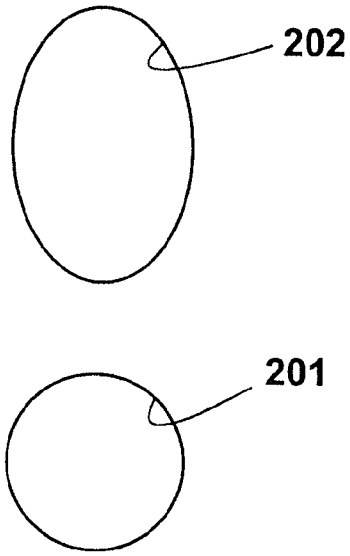
Fig. 3 (PRIOR ART)
FIG. 3 is an enlarged plan view illustrating another example of a print head of a related printing apparatus having an elliptic opening for a metering medium positioned adjacent a round opening for a discharge medium.
Figure 4:
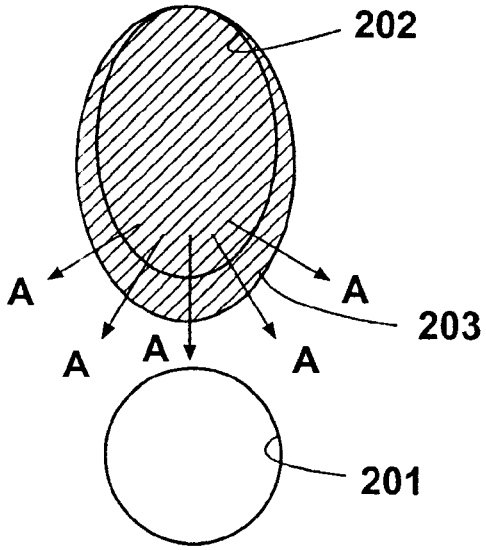
Fig. 4 (PRIOR ART)
FIG. 4 is an enlarged plan view illustrating the print head of the related printing apparatus wherein the metering medium spreads equally in all directions from the opening of the elliptic nozzle.
Figure 5:
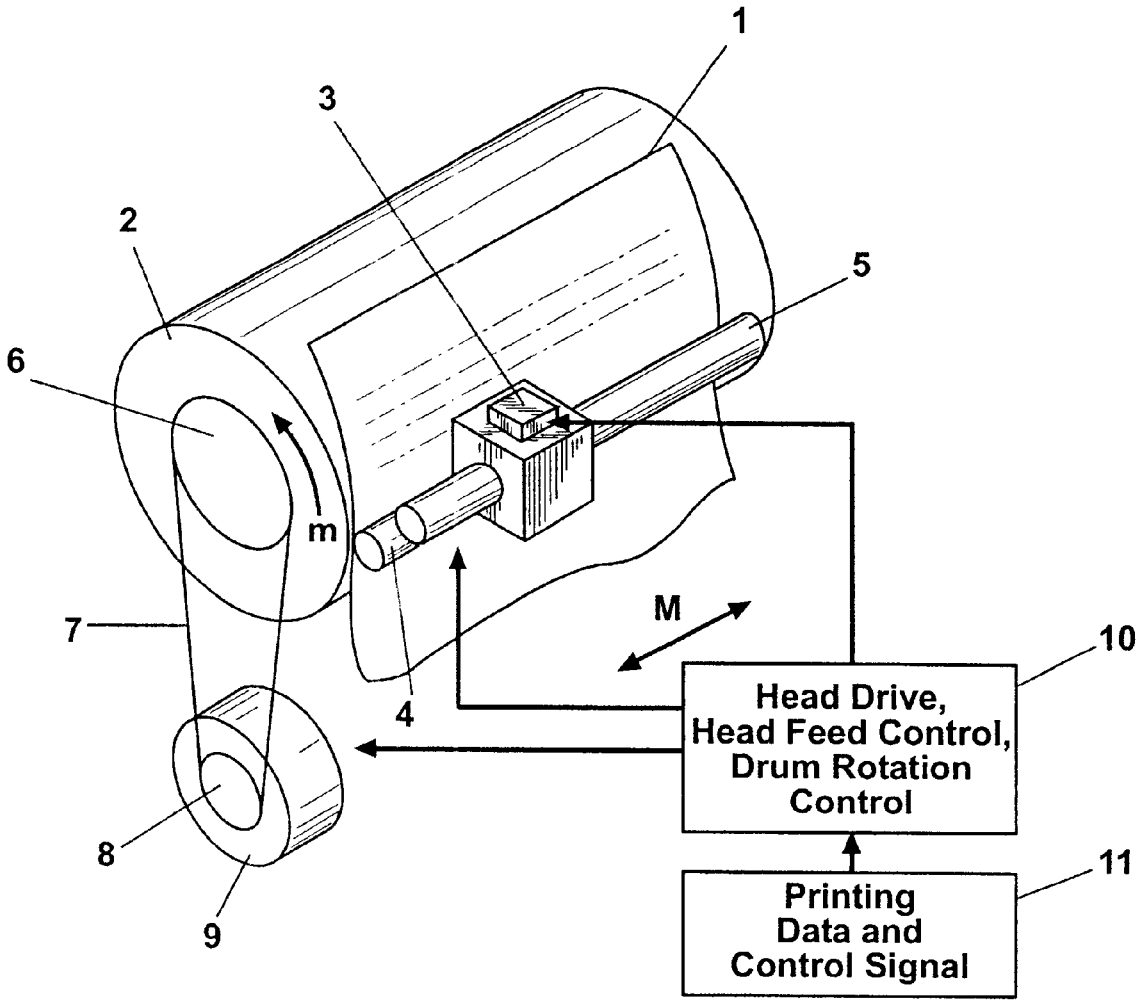
FIG. 5 is a schematic perspective view illustrating the main assembly of a first liquid-ejection-type recording device having a printing apparatus according to the present invention.

Referring to FIG. 5, there is shown a serial-type recording device as an example of a liquid-ejection-type recording device having a printing apparatus according to the present invention. The recording device includes a drum 2 carrying a sheet of printing paper 1 to be printed thereon, and a printing head 3 comprising the printing apparatus to which the present invention is applied for printing on the printing paper 1.

The printing paper 1 is attached to and carried on the drum 2 by a paper attaching roller 4 provided in parallel to an axial direction of the drum 2. The drum 2 is also provided with a feed screw 5 in parallel to an axial direction of the drum 2 near the outer periphery of the drum 2. The feed screw 5 carries the print head 3 for movement in an axial direction of the drum 2, as shown by the arrow M, upon rotation of the feed screw 5.

On the other hand, the drum 2 is rotated, as shown by the arrow m in FIG. 5, by a motor 9 via a pulley 6, a belt 7, and a pulley 8. In addition, the rotation of the feed screw 5, the motor 9, and the print head 3 is controlled by a head drive, head feed control, drum rotation control 10 on the basis of printing data and control signal 11.

In the above-described construction, when the print head 3 prints a line while moving, the drum 2 is rotated by a line to print the next line. When the print head 3 is moved to print, there are two cases of one direction and to-and-fro direction.

Figure 6:
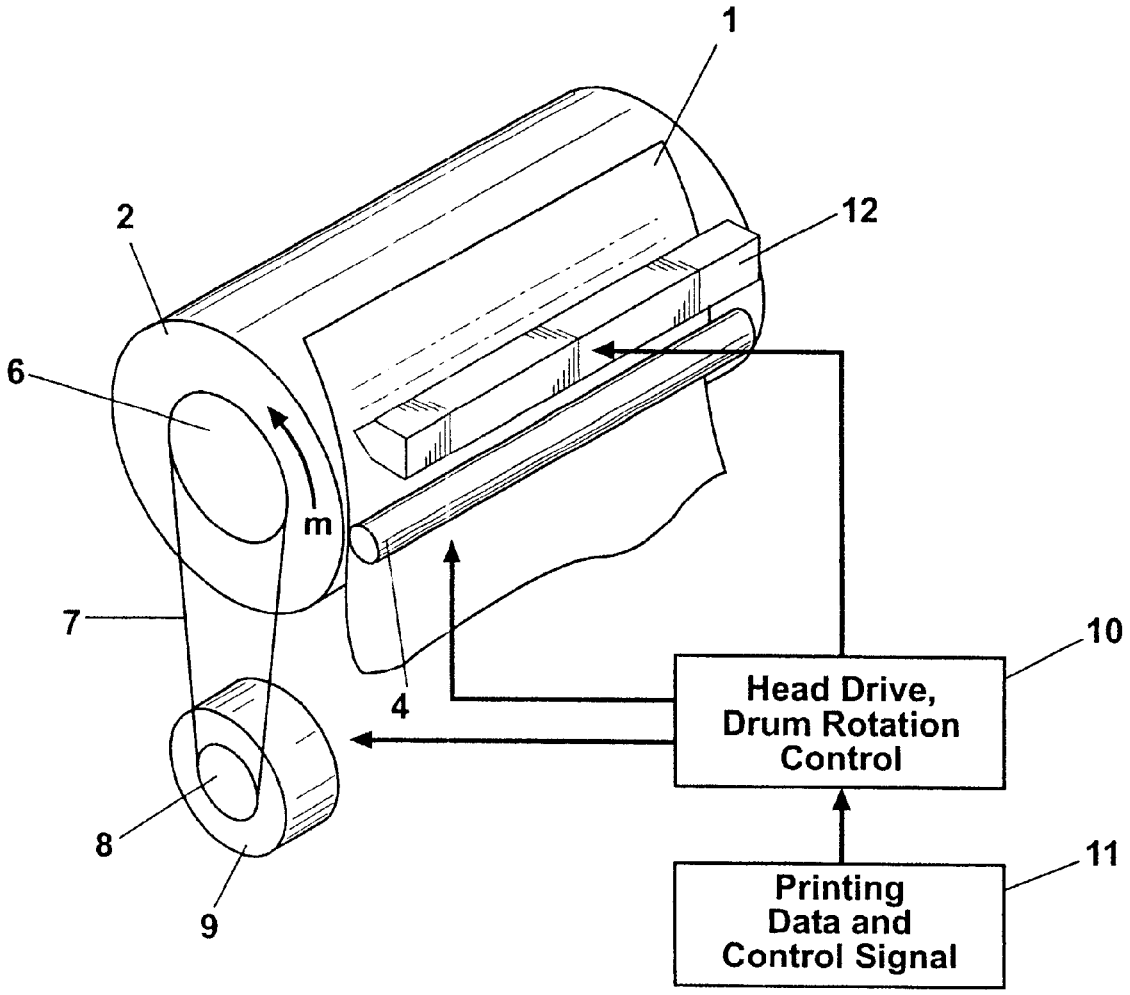
FIG. 6 is a schematic perspective view illustrating the main assembly of a second liquid-ejection-type recording device having a printing apparatus according to the present invention.

Referring to FIG. 6, there is shown a line-type recording device as another example of a liquid-ejection-type recording device having a printing apparatus according to the present invention. The liquid-ejection-type recording device shown in FIG. 6 has a construction similar to the liquid-ejection-type recording device shown in FIG. 5.

The recording device shown in FIG. 6 has a print head 12 in which a plurality of print heads are fixedly disposed in an axial direction of the drum 2, instead of a print head 3 which is carried by the feed screw 5 and can be moved by the rotation of the feed screw 5 in an axial direction of the drum 2. That is, the print head 12 prints an entire line at the same time and, after a line is printed, the drum 2 is rotated by a line to print the next line. In this case, in addition to printing an entire line at the same time, it is possible to print a line by dividing the line into several blocks or to print every other line alternately.

Figure 7:
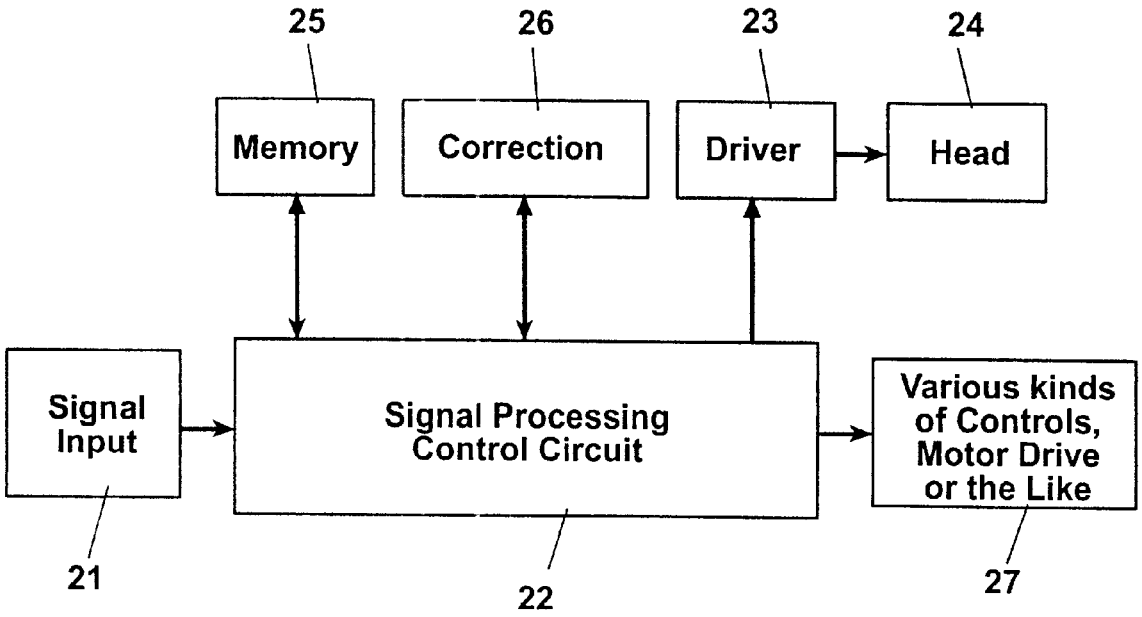
FIG. 7 is a block diagram of the printing and control system of a liquid-ejection-type recording device having a printing apparatus according to the present invention.

A block diagram of printing and control for the liquid-ejection-type recording devices of FIGS. 5 and 6 is shown in FIG. 7. A signal input 21, such as printing data or the like, is input to a signal processing control circuit 22 in which the signal input is arranged in the order of printing and is sent to a print head 24 via a driver 23. The order of printing may be different according to the head 24, the construction of the printing unit, and the order of input of the data to be printed. Thus, if necessary, the printing data can be stored in a memory 25, such as a line buffer memory, one picture memory, or the like, and then fetched. A gradation signal or a discharging signal is input to the head 24.

If the head 24 is a multi-head having a very large number of nozzles, the head 24 can have an IC mounted thereon to reduce the number of wiring. In addition, a correction 26 is connected to the signal processing control circuit 22 and performs a γ correction, a color correction in the case of color printing, a variance correction of each head, or the like. It is common practice to store in the correction 26 the predetermined correction data in the form of a ROM map and to fetch the data according to the outside conditions, for example, nozzle number, temperature, input signal, or the like.

It is common that the signal processing control circuit 22 includes a CPU or a DSP, processes with software, and sends the processed data to the various kinds of controls, motor drive or the like 27. The various kinds of controls, motor drive or the like 27 controls driving and synchronizing of the motor rotating the drum and the feed screw, cleaning of the head, and feeding and discharging the printing paper. For this reason, the signal can also include an operating section control signal or a peripheral control signal other than the data to be printed.

Next, the construction of the print head 3 comprising a printing apparatus according to the present invention will be described. Specifically, an example of a carrier-jet-type print head for the printing apparatus which mixes ink with the diluent to discharge them in a mixed condition will be described.

The print head 3 mixes the ink with the diluent to discharge them in a mixed condition. The print head 3 includes a pressure chamber unit 31 having two kinds of pressure chambers. A first piezo unit 32 and a second piezo unit 33 correspond to the two kinds of pressure chambers.

Figure 8:
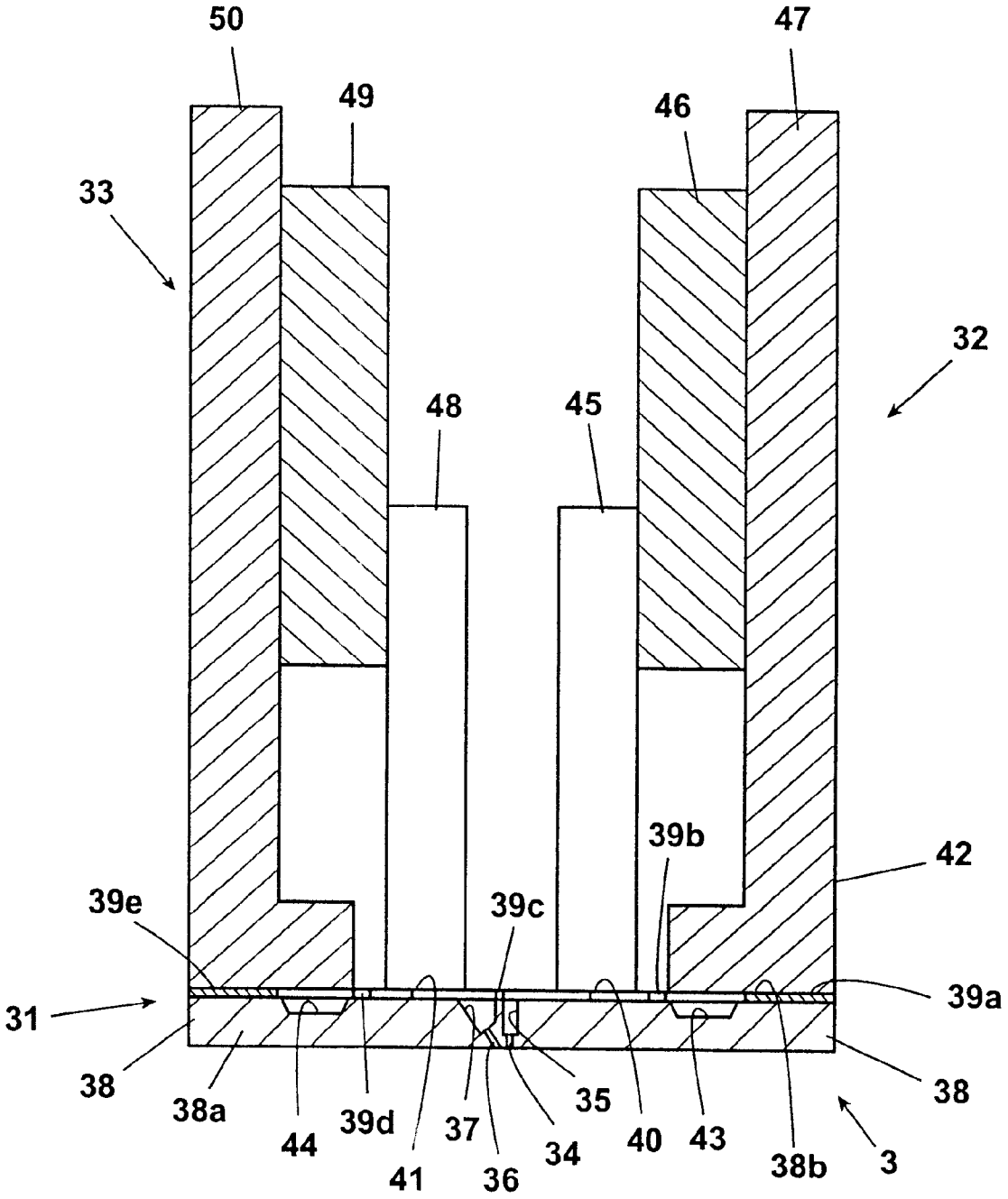
FIG. 8 is a schematic cross-sectional view illustrating a main assembly of a print head of a printing apparatus according to the present invention.
Figure 9:
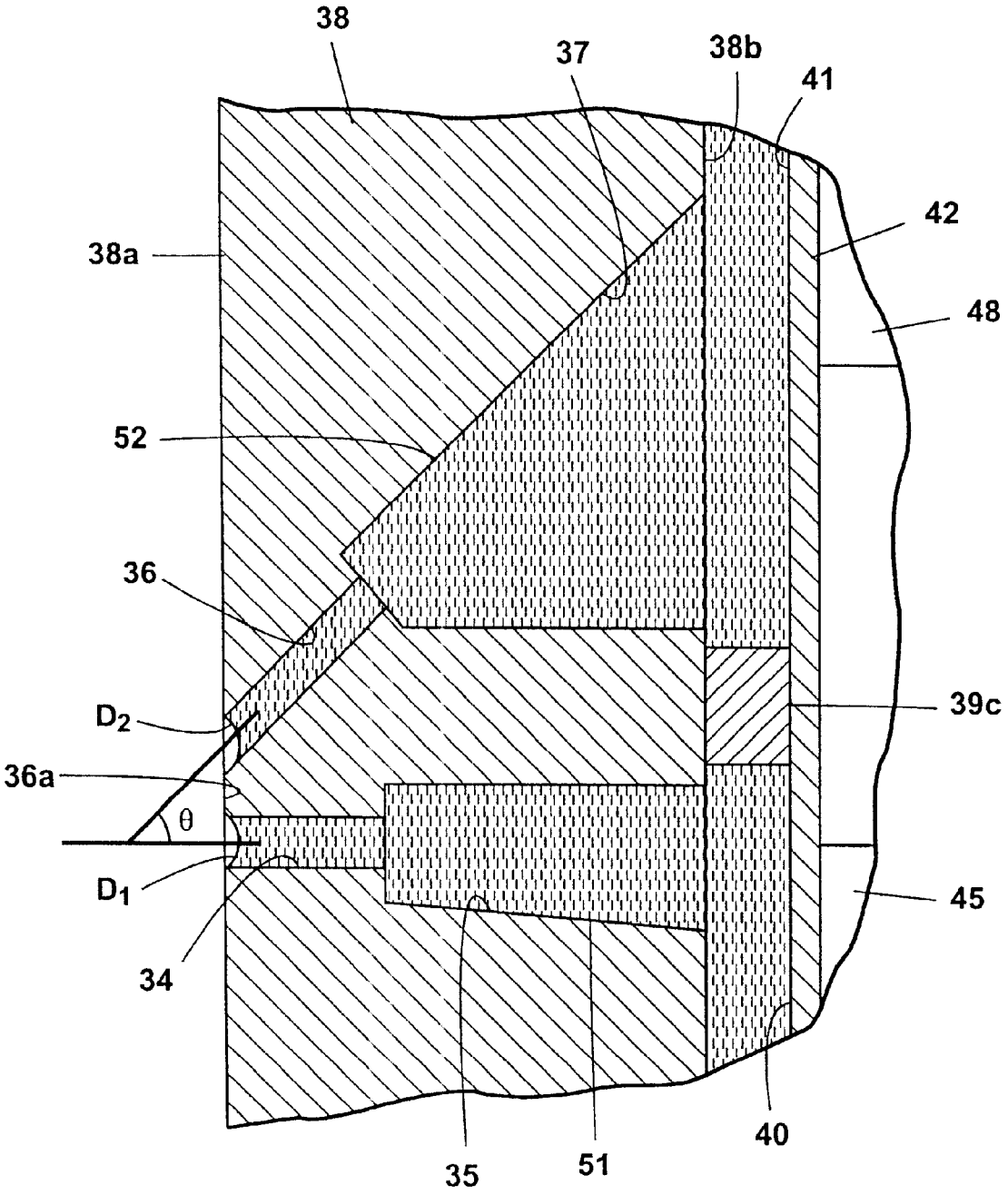
FIG. 9 is a schematic cross-sectional view illustrating the vicinity of an orifice plate of a print head of a printing apparatus according to the present invention on an enlarged scale.

The above-described pressure chamber unit 31 mixes the ink with the diluent to discharge them in a mixed condition, as described above. The pressure chamber unit 31 includes a plate-like orifice plate 38 having in its center thereof, as shown in FIG. 9 on an enlarged scale, a first nozzle 34 which is a discharging port of the diluent, a first introduction port 35 communicating with the discharging port of the diluent, a second nozzle 36 which is a discharging port of the ink, and a second introduction port 37 communicating with the discharging port of the ink. As shown in FIG. 8, a first pressure chamber 40, which is a passageway of the diluent, a second pressure chamber 41, which is a passageway of the ink, and a vibration plate 42 are formed by the side wall of the pressure chamber 39*a*, 39*b*, 39*c*, 39*d* and 39*e* which forms bulk heads.

In the orifice plate 38, as shown in FIG. 9 on an enlarged scale, one end of the first and second nozzles 34 and 36 are made so as to face one main printing face 38*a*. An end of each of the first and second introduction ports 35 and 37 communicating with the first and the second nozzles 34 and 36, respectively, is made so as to face a back face 38*b* of the orifice plate 38, which is at the opposite side or the back side of the main printing face 38*a*. Accordingly, the first introduction port 35 and the first nozzle 34 pierce through the orifice plate 38 as a whole. The second introduction port 37 and the second nozzle 36 also pierce through the orifice plate 38 as a whole.

In addition, the first and second nozzles 34 and 36 are formed so as to make an angle indicated by θ in FIG. 9 between the directions of these nozzles, for example, 45 degrees.

In addition, in the orifice plate 38, as shown in FIG. 8, first and second supply chambers 43 and 44 with C-shaped cross-sections are provided. The first supply chamber 43 is a recess for collecting the diluent, and the second supply chamber 44 is a recess for collecting the ink. The first and second supply chambers 43, 44 are formed such that they have the first and second nozzles 34 and 36 and the first and the second introduction ports 35 and 37 between them. The orifices of the first and second supply chambers 43, 44 face the back face 38*b* of the orifice plate 38, which is at the opposite side or the back of the main printing face 38*a*.

The pressure chamber-side wall 39*a*, 39*b*, 39*c*, 39*d* and 39*e* is laminated over as the bulkheads on the back side 38*b* of the above-described orifice plate 38. The part where the side wall of the pressure chamber 39*a*, 39*b*, 39*c*, 39*d* and 39*e* is not formed connects the outlet of the first supply chamber 43 to the outlet of the first introduction port 35 to form the first pressure chamber 40 which makes a flow passageway, and connects the outlet of the second supply chamber 44 to the outlet of the second introduction port 37 to form the second pressure chamber 41 which makes a flow passageway. The vibration plate 42 is laminated on the side wall of the pressure chamber 39*a*, 39*b*, 39*c*, 39*d* and 39*e* to hermetically close the first and second pressure chambers 40 and 41.

Further, the above-described first piezo unit 32 includes a plate-like first laminated piezo-electric element 45 laminated alternately by piezo-electric material and conductive material, a first supporting material 46 fixing one end of the first laminated piezo-electric element 45, and a first holder 47 fixing the first supporting material 46 on the pressure chamber unit 31. The second piezo unit 33 is similar to that of the first piezo unit 32. That is, one end of the second laminated piezo-electric element 48 is fixed on the second supporting material 49, and the second supporting material 49 is fixed on the pressure chamber unit 31 by the second holder 50.

A piezo-electric element made by laminating piezo-electric material and conductive material in a direction normal to or parallel to the direction of the length of the first and second pressure chambers 40 and 41 may be used as the above-described first and second laminated piezo-electric elements 45 and 48. The piezo-electric element has a characteristic of extending in a laminating direction when a voltage is applied across it.

For this reason, when a voltage is applied across the former laminated piezo-electric element, the former laminated piezo-electric element extends in the direction of the length of the first and the second pressure chambers 40 and 41 and contracts in the direction normal to the length of the first and the second pressure chambers 40 and 41. Accordingly, this laminated piezo-electric element does not give pressure to the pressure chambers. This type of laminated piezo-electric element is called a laminated piezo-electric element of a mode $d_{31}$.

On the other hand, when a voltage is applied across the latter laminated piezo-electric element, the latter laminated piezo-electric element extends in the direction normal to the length of the first and second pressure chambers 40 and 41 and, thus, gives pressure to the pressure chambers. This type of laminated piezo-electric element is called a laminated piezo-electric element of a mode $d_{33}$.

The above-described first laminated piezo-electric element 45 is disposed oppositely to the first pressure chamber 40 via the vibration plate 42. The second laminated piezo-electric element 48 is also disposed oppositely to the second pressure chamber 41 via the vibration plate 42.

Accordingly, in the print head 3 with the above-described construction, the diluent is supplied to the first supply chamber 43 through the supply pipe or the supply groove (not shown) from a tank for the diluent (not shown) and is packed in the first nozzle 34 communicating with the first introduction port 35 through the first pressure chamber 40, as shown in FIG. 9. Thus, the diluent 51 makes the first meniscus $D_1$ at the top end of the first nozzle 34.

On the other hand, the situation for the ink is the same as the situation for the above-described diluent. That is, the ink is supplied to the second supply chamber 44 through the supply pipe or the supply groove (not shown) from an ink tank (not shown) and is packed in the second nozzle 36 communicating with the second introduction port 37 through the second pressure chamber 41. Thus, the ink 52 makes the second meniscus $D_2$ at the top end of the second nozzle 36.

Figure 10A:
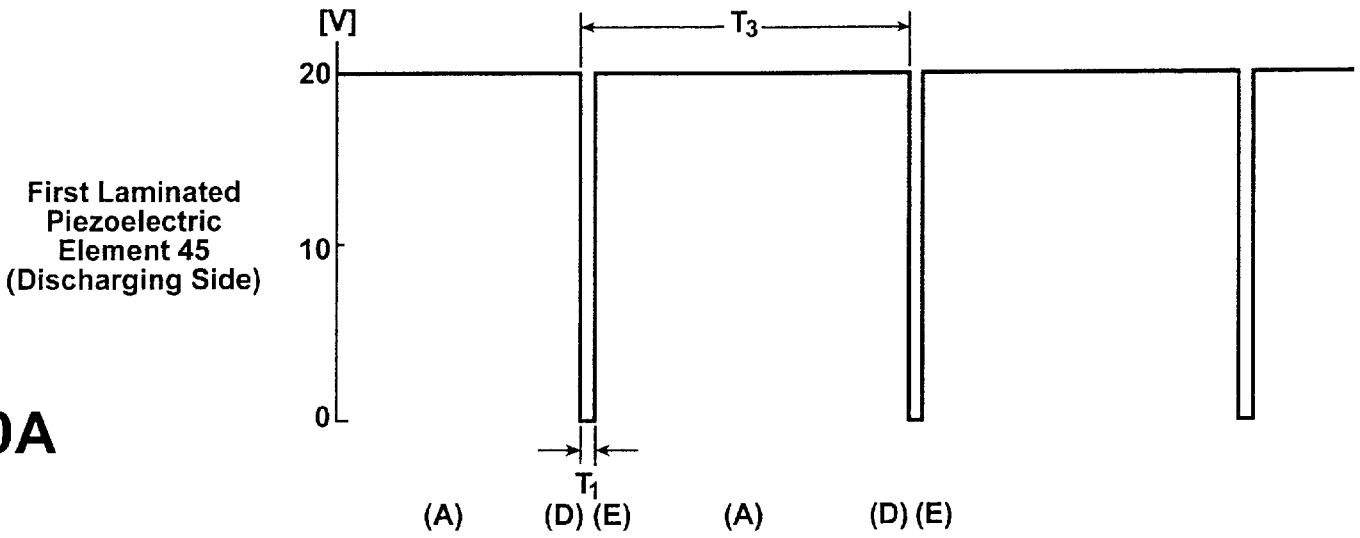
FIG. 10A and FIG. 10B are timing charts illustrating the timing when a driving voltage of a print head of a printing apparatus according to the present invention is applied.
Figure 10B:
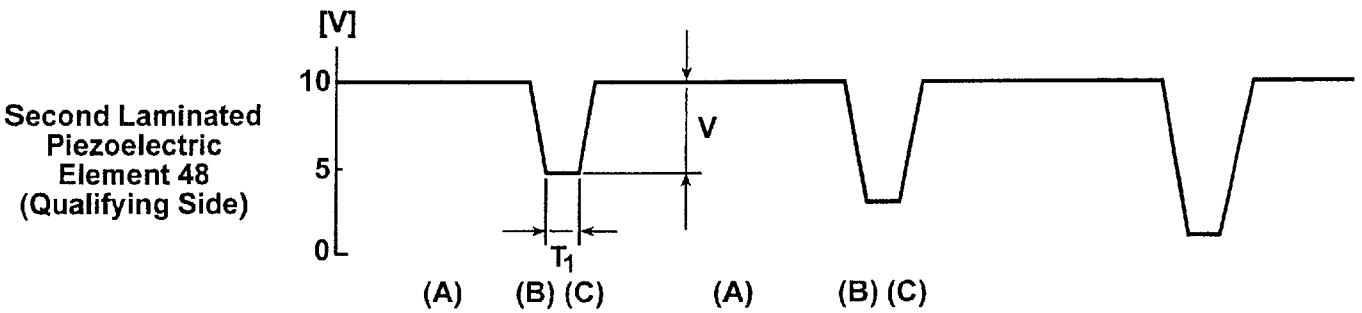

Timing charts illustrating when a driving voltage is applied are shown in FIGS. 10A and 10B for the case where a printing is performed by the liquid-ejection-type recording device according to the present invention. The laminated piezo-electric elements of a $d_{31}$ mode, for example, are used as the first and second laminated piezo-electric elements 45 and 48.

As indicated in FIG. 10A, during a wait before printing, that is, during the time indicated by (A) in the drawing, a voltage of 20V, for example, is applied across the first piezo-electric element 45 in advance. As indicated in FIG. 10B, during a wait before printing, that is, during the time indicated by (A) in the drawing, a voltage of 10V, for example, is applied across the second piezo-electric element 48 in advance.

Then when printing, a voltage applied across the second laminated piezo-electric element 48 is gradually reduced to 5V, for example, at a time indicated by (B) in FIG. 10B, so as to push and to make the ink 52 ooze from the second nozzle 36 on the basis of a signal from the above-described head drive, head feed control and drum rotation control 10. The second piezo-electric element 48 is held at this condition for 150 μsec, for example. Then the second laminated piezo-electric element 48 gradually extends in the direction of the length thereof to make the ink 52 ooze from the outside of the second nozzle 36 toward the vicinity of the orifice of the first nozzle 34 and to mix it with the diluent 51 of the first nozzle 34.

After that the voltage of the second laminated piezo-electric element 48 is gradually returned to 10V, for example, at a time indicated by (C) in the drawing, so as to introduce the ink 52 into the second nozzle 36 and to make only the metered ink 52 remain in the vicinity of the orifice of the first nozzle 34. The second piezo-electric element 48 then gradually contracts in the direction-of the length thereof, and the inner pressure of the second nozzle 36 is released and, thus, the ink 52 will return into the second nozzle 36. Accordingly, the metered ink 52 remains in the vicinity of the orifice of the first nozzle 34.

Next, the voltage of the first piezo-electric element 45 is made 0V, for example, at a time indicated by (D) in FIG. 10A, so as to discharge the diluent 51 from the first nozzle 34. The first piezo-electric element 45 then extends in the direction of the length thereof and pressurizes the first pressure chamber 40 via the vibration plate 42 and thereby increases the inner pressure of the first nozzle 34. As a result, the diluent 51 is pushed out by the inner pressure of the first nozzle 34 and mixed with the ink remaining in the vicinity of the orifice of the first nozzle 34 to make the mixed solution.

Next, the voltage of the first piezo-electric element 45 is made 0V for 50 μsec, for example, from the time indicated by (D) in FIG. 10A and returned to 20V, for example. The first piezo-electric element 45 then contracts in the direction of the length thereof, the inner pressure of the first nozzle 34 is released, and the diluent 51 tends to return into the first nozzle 34. This makes a narrow part between the diluent 51 in the first nozzle 34 and the mixed solution. The mixed solution is then discharged from the first nozzle 34 and adheres to the above-described printing paper 1 to perform the printing.

The inner pressure of the first and second pressure chambers 40 and 41 returns to the former state in the course of time. The diluent 51 and the ink 52 are packed again in the first and the second nozzles 34 and 36 to return to the former state.

The ink-metering pulse length between (B) and (C) indicated by $T_1$ in FIG. 10B, the diluent discharging pulse length between (D) and (E) indicated by $T_2$ in FIG. 10A, and the ink-metering voltage indicated by V in FIG. 10B are all variable.

As shown in FIGS. 10A and 10B, the printing is performed by repeating the-above-described operations. The printing cycle indicated by $T_3$ in FIG. 10A may be made 1 μsec, for example.

In the print head 3, resin such as polysulfone or the like, dry film photoresist, and metal plate, such as nickel or the like, may be used for the orifice plate 38, the walls of the pressure chamber side 39*a*, 39*b*, 39*c*, 39*d* and 39*e*, and the vibration plate 42.

Figure 11:
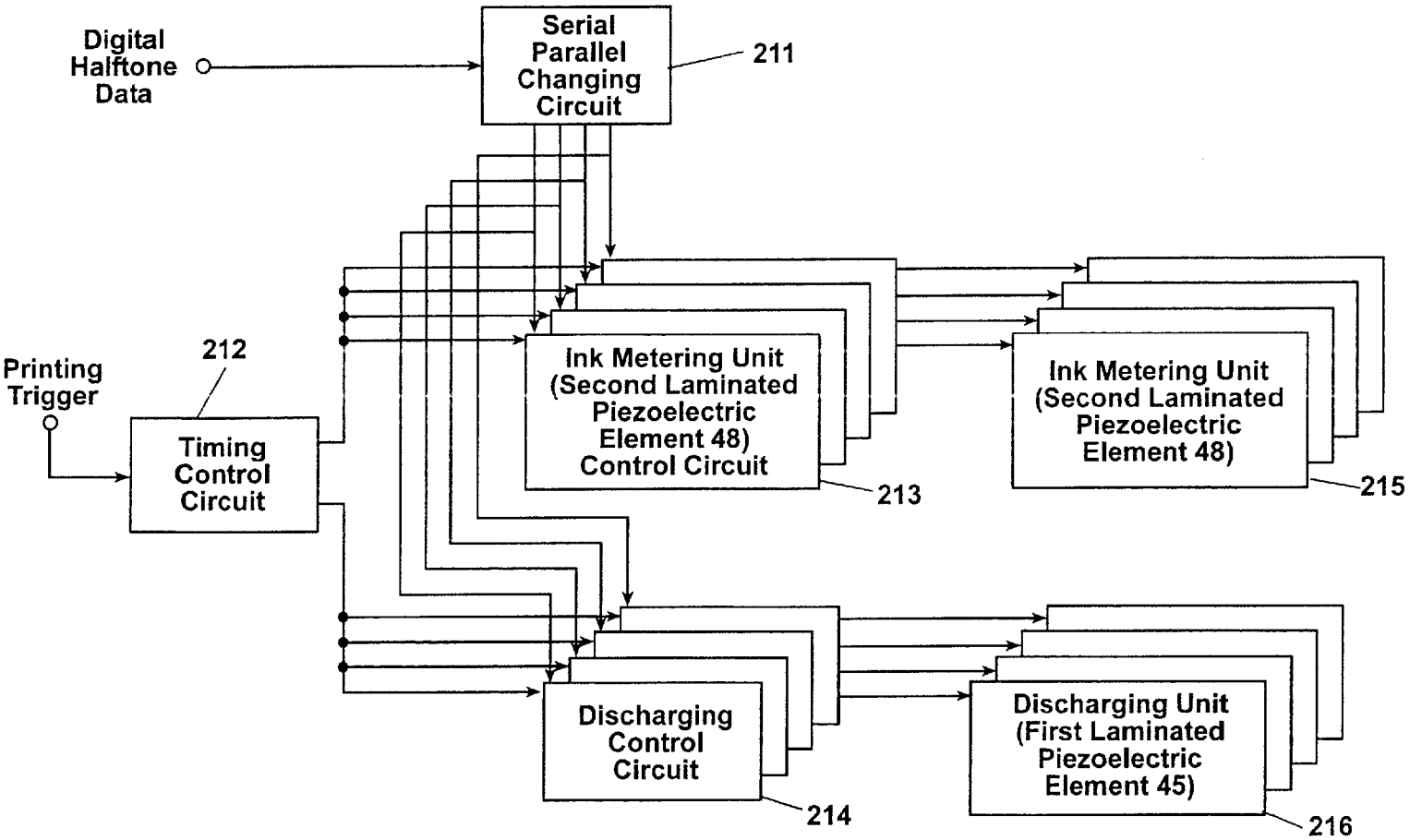
FIG. 11 is a circuit block diagram illustrating a driving circuit of a print head of a printing apparatus according to the present invention.

Next, the driving circuit of the print head 3 described above will be described by reference to FIG. 11. Digital halftone data are supplied from the other block and sent to each ink-metering unit (second laminated piezo-electric element 48) control circuit 213 and each discharging control circuit 214 via a serial parallel changing circuit 211. If the digital halftone data are less than a specified threshold value, the ink is not metered and discharged. When the printing time comes, a printing trigger is output from the other block and detected by a timing control circuit 212 which then outputs at a predetermined timing an ink-metering unit control signal and a discharging control signal to each ink metering unit (second laminated piezo-electric element 48) control circuit 213 and each discharging control circuit 214. Each signal is output at the timing indicated in FIG. 10.

A specified voltage is applied to the ink-metering unit (second laminated piezo-electric element 48) 215 and a discharging unit (first piezo-electric element 45) 216.

It is desirable that the ink 52 is made by dissolving or suspending water-based dyestuff or pigment of various kinds of colors in water, organic solvent or a mixture thereof. If necessary, the ink 52 may contain a viscosity adjusting agent, a surface tension adjusting agent, a preservative agent, a pH adjusting agent, or the like.

On the other hand, it is desirable that the diluent 51 is a clear and colorless liquid. Thus, the diluent 51 may be water, organic solvent, or a mixture thereof. The diluent 51 may further contain a viscosity adjusting agent, a surface tension adjusting agent, a preservative agent, a pH adjusting agent, or the like in the solution.

Figure 12:
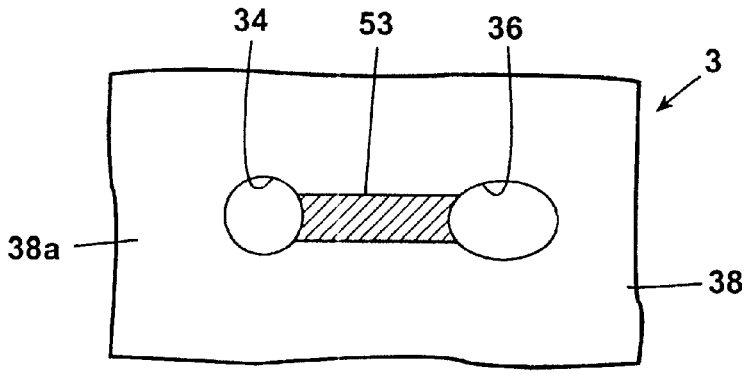
FIG. 12 is an enlarged plan view illustrating a main part of a print head of a printing apparatus according to a first embodiment of the present invention.

In addition, in the printing apparatus of the present embodiment, as schematically shown in plan view in FIG. 12, a hydrophilic portion 53 indicated by an shaded area is formed between the first nozzle 34 and the second nozzle 36 in the main printing face 38*a* (i.e., the nozzle outlet face) of the orifice plate 38 of the print head 3. The hydrophilic portion 53 is formed from the orifice of the second nozzle 36 to the orifice of the first nozzle 34. The hydrophilic portion 53 may be formed by performing a corona treatment or applying ultraviolet rays or the like at a specified position on the main printing face 38*a* of the orifice plate 38.

Accordingly, if the ink 52 is made to ooze from the second nozzle 36 to print as described above, the ink 52 selectively travels along the hydrophilic portion 53, which has good wettability, for the ink to be fed toward the first nozzle 34. Thus, the ink 52 hardly leaks in the portion other than the hydrophilic portion 53. This prevents the ink 52 from adhering to the portion around the orifices of the first and second nozzles 34, 36, and thereby prevents the occurrence of the worse printing. In this manner, the print head can correctly reproduce the gradation of concentration and, thus, make a recorded image of high resolution.

Although the hydrophilic portion 53 is formed from the orifice of the second nozzle 36 to the orifice of the first nozzle 34 in the above embodiment, the hydrophilic portion 53 may be formed from the orifice of the second nozzle 36 to only a middle part between the first nozzle 34 and the second nozzle 36.

As above-described, the ink 52 is well introduced into the second nozzle 36 when a metered amount of the ink 52 is made to remain in the vicinity of the orifice of the first nozzle 34. The ink 52 is introduced into the second nozzle 36 to quantify. Thus, the ink 52 is prevented from adhering to a portion around the orifices of the first and second nozzles 34 and 36, and thereby prevents the occurrence of worse printing. In this manner, the print head can correctly reproduce the gradation of concentration and, thus, make a recorded image of high resolution.

Figure 13:
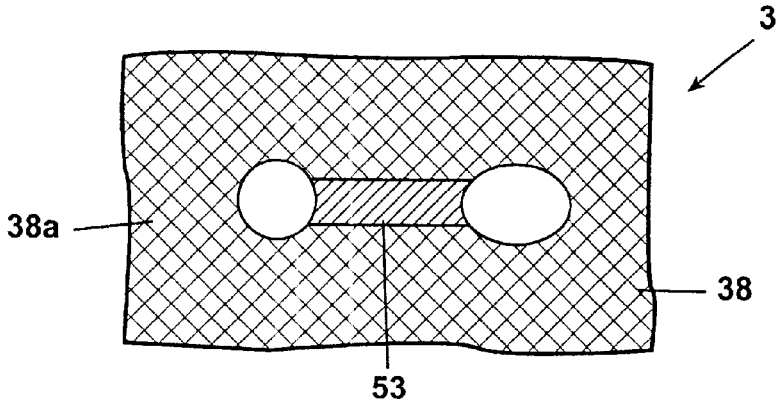
FIG. 13 is an enlarged plan view illustrating a main part of a print head of a printing apparatus according to a second embodiment of the present invention.

Moreover, a hydrophobic portion may be formed in addition to the above-described hydrophilic portion 53. In other words, as schematically shown in FIG. 13, the portion of the main printing face 38*a* of the orifice plate 38 other than the hydrophilic portion 53 may be processed so as to form a hydrophobic portion 54, as indicated by a cross-hatched area in FIG. 13.

In this case, the ink 52 more selectively travels the hydrophilic portion 53 owing to the difference in wettability for the ink between the hydrophilic portion 53 and the hydrophobic portion 54. This further prevents the ink 52 from adhering to the portion around the orifices of the first and second nozzles 34 and 36, and thereby prevents the occurrence of worse printing. In this manner, the print head can correctly reproduce the gradation of concentration and, thus, can make a recorded image of high resolution.

Figure 14:
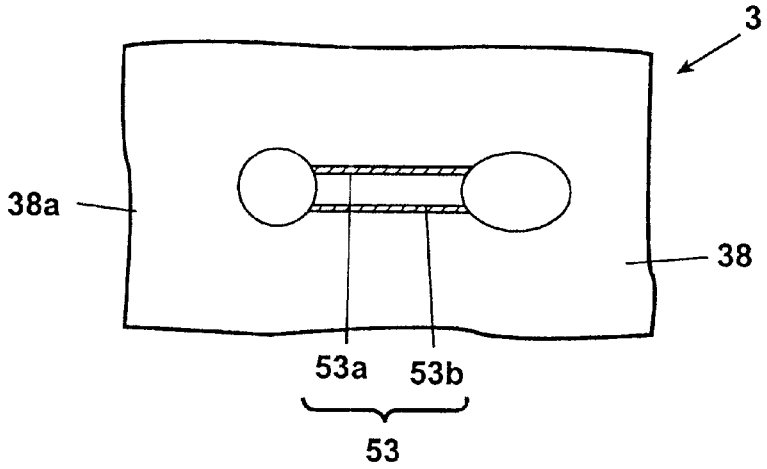
FIG. 14 is an enlarged plan view illustrating a main part of a print head of a printing apparatus according to a third embodiment of the present invention.

The above-described hydrophilic portion 53 may have a shape divided into two lines 53*a* and 53*b*, as schematically indicated in FIG. 14, instead of the shape of the above-described single line.

Further, in the print head of the printing apparatus according to the present invention, the hydrophilic portion 53 of the print head of the printing apparatus may be a non-processed portion, and the remaining portion of the print head may be hydrophobicly processed to be a hydrophobic portion 54. This print head has the same effects as the print head with a processed hydrophilic portion.

Figure 15:
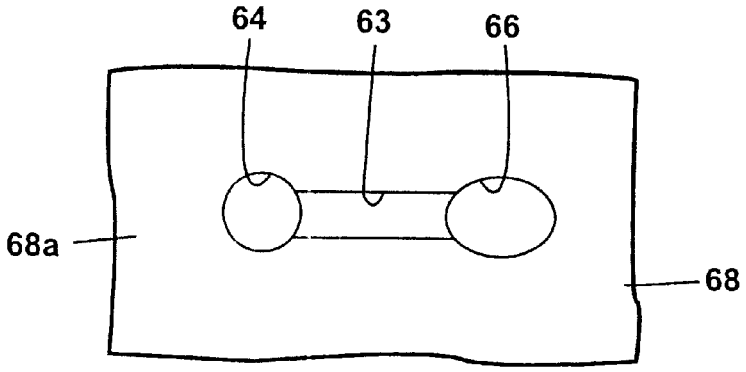
FIG. 15 is an enlarged plan view illustrating a main part of a print head of a printing apparatus according to a fourth embodiment of the present invention.
Figure 16:
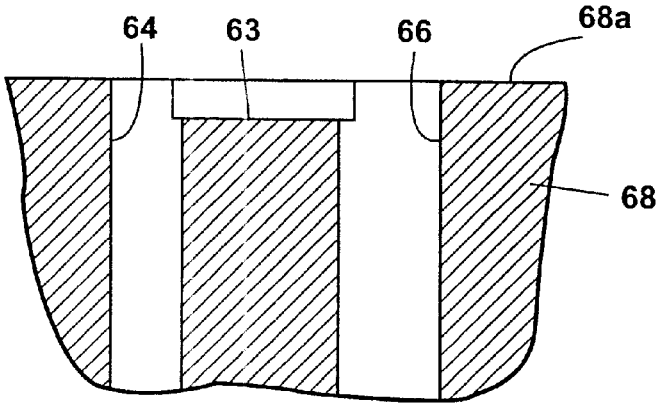
FIG. 16 is an enlarged cross-sectional view illustrating a main part of a print head of a printing apparatus according to a first variation of the fourth embodiment of the present invention.

The print head of the printing apparatus according to the present invention may have a groove formed between the orifice of the first nozzle and the orifice of the second nozzle in the main printing face (i.e., the nozzle outlet face) of the orifice plate in addition to the above-described hydrophilic portion. In other words, for example, the print head can have almost the same constitution as the above-described print head and, as schematically shown in FIGS. 15 and 16, the print head can be provided with a groove 63 with a constant depth connecting the orifice of the second nozzle 66 to the orifice of the first nozzle 64 in the main printing face 68*a* (i.e., the nozzle outlet face) of the orifice plate 68.

The groove 63 may be formed by means of ultraviolet laser processing or the like and may also be formed by means of machining, etching or the like. Moreover, if the orifice plate 68 is formed by injection-molding, electroforming or the like, it is recommended that it is formed in the shape having the above-described groove 63. It is recommended that the means of forming is selected according to the material to be formed.

Accordingly, when a printing is performed as in the case of the above-described print head, the ink oozing out from the second nozzle 66 travels the groove 63 owing to a capillary action and is fed to the first nozzle 64. Accordingly, the ink hardly leaks in the portion other than the groove 63. This prevents the ink from adhering to the portion around the orifices of the nozzles and prevents the occurrence of the worse printing. Thus, this print head can correctly reproduce the gradation of concentration and, thus, can make a recorded image of high resolution.

Figure 17:
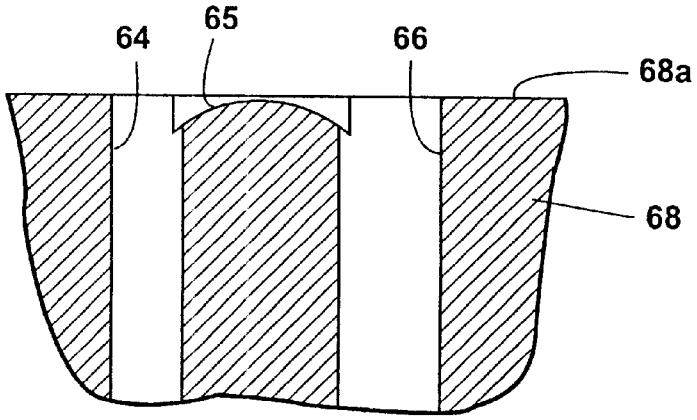
FIG. 17 is an enlarged cross-sectional view illustrating a main part of a print head of a printing apparatus according to a second variation of the fourth embodiment of the present invention.

Alternatively, the print head may have-almost the same constitution as described above, but with a groove 65 shaped as schematically shown in FIG. 17. The groove 65 is formed in such a way that the depth of the groove is large in the vicinity of the orifices of the first nozzle 64 and the second nozzle 65 and becomes gradually smaller toward the middle point between the orifices.

Figure 18:
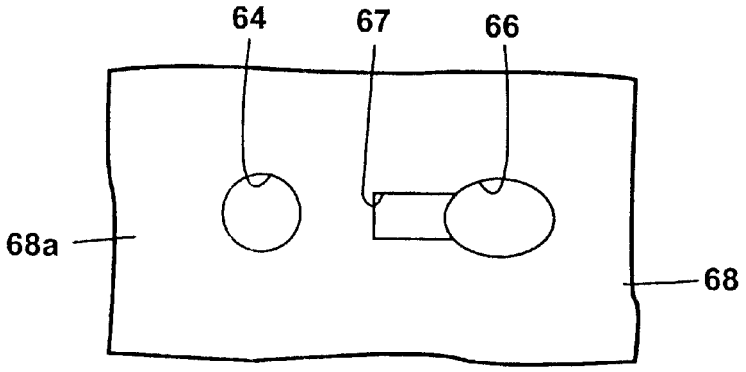
FIG. 18 is an enlarged plan view illustrating a main part of a print head of a printing apparatus according to a fifth embodiment of the present invention.
Figure 19:
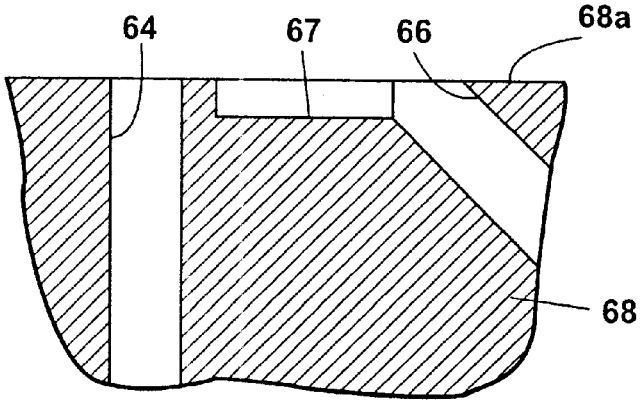
FIG. 19 is an enlarged cross-sectional view illustrating a main part of a print head of a printing apparatus according to a first variation of the fifth embodiment of the present invention.

Alternatively, the print head may have almost the same constitution as described above, but with a groove 67 shaped as schematically shown in FIGS. 18 and 19. The groove 67 has a constant depth from the orifice of the second nozzle 66 to the middle part between the orifice of the first nozzle 64 and the orifice of the second nozzle 66 in the main printing face 68*a* (i.e., the nozzle outlet face) of the orifice plate 68.

When the printing is performed with this print head, the ink 52 is well introduced into the second nozzle 66 because the ink 52 is made to ooze from the second nozzle 66 toward the first nozzle 64. A metered amount of the ink 52 is made to remain in the vicinity of the orifice of the first nozzle 64, and then the ink is introduced into the second nozzle 66 to quantify it.

This prevents the ink 52 from adhering to the portion around the orifices of the first and the second nozzles 64 and 66 and prevents the occurrence of the worse printing. Thus, the print head can correctly reproduce the gradation of concentration and, thus, can make a recorded image of high resolution.

Figure 20:
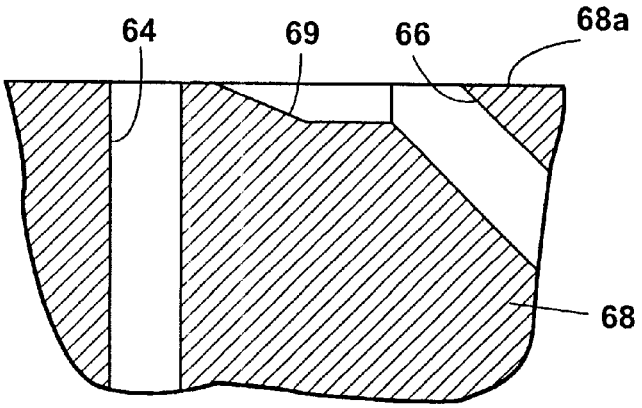
FIG. 20 is an enlarged cross-sectional view illustrating a main part of a print head of a printing apparatus according to a second variation of the fifth embodiment of the present invention.

Alternatively, when the groove 67 is formed from the orifice of the second nozzle 66 to the middle part between the orifice of the first nozzle 64 and the orifice of the second nozzle 66, the depth of the groove 69 is preferably made gradually smaller from the second nozzle 66 toward the first nozzle 64, as schematically shown in FIG. 20. The tapered groove 69 provides better metering of the ink as compared to the constant depth groove 67 shown in FIG. 18.

Figure 21:
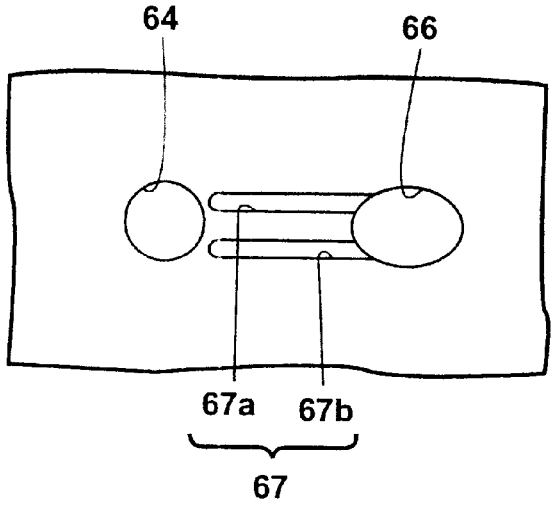
FIG. 21 is an enlarged plan view illustrating a main part of a print head of a printing apparatus according to a sixth embodiment of the present invention.

Alternatively, the above-described groove 67 may have a shape divided into two lines 67*a* and 67*b*, as schematically illustrated in FIG. 21, instead of the above-described shape of a single line.

Figure 22A:
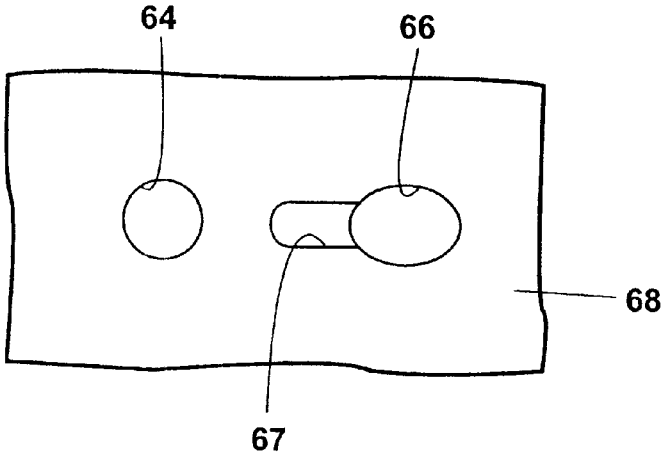
FIGS. 22A and 22B are enlarged plan views illustrating a main part of a print head of a printing apparatus according to seventh and eighth embodiments of the present invention.
Figure 22B:
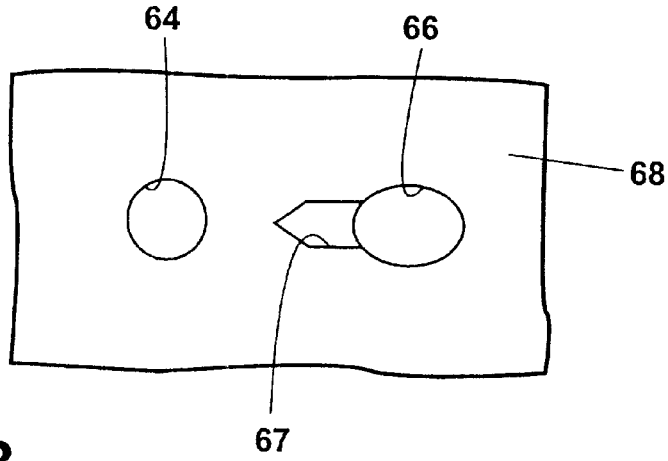

Further, the groove 67 may have an arc end or a pointed end at the side of the first nozzle 64 of the groove 67, as shown in FIGS. 22A and 22B, respectively.

Figure 23A:
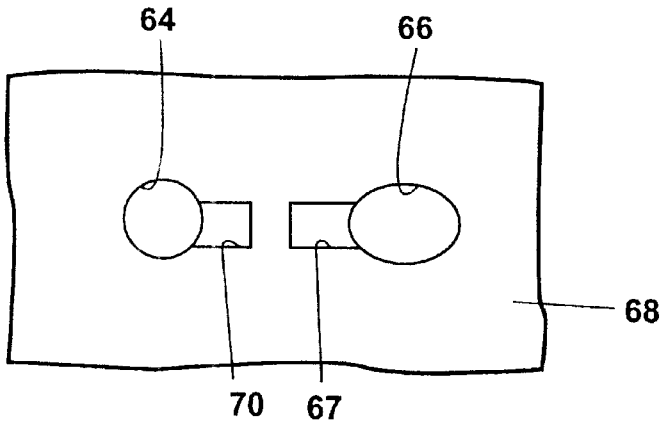
FIGS. 23A, 23B, and 23C are enlarged plan views illustrating a main part of a print head of a printing apparatus according to ninth, tenth, and eleventh embodiments of the present invention.
Figure 23B:
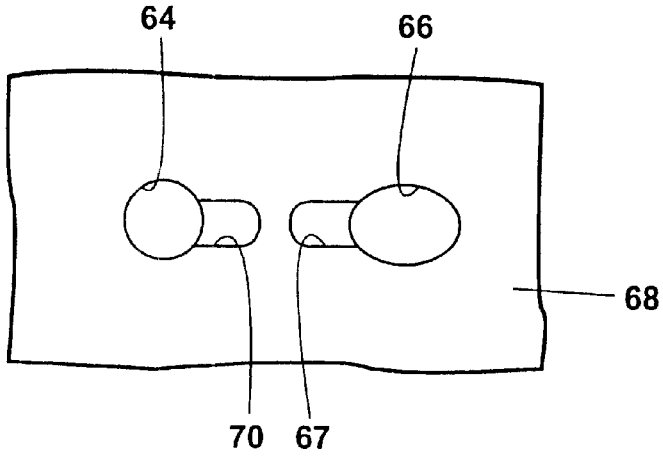
Figure 23C:
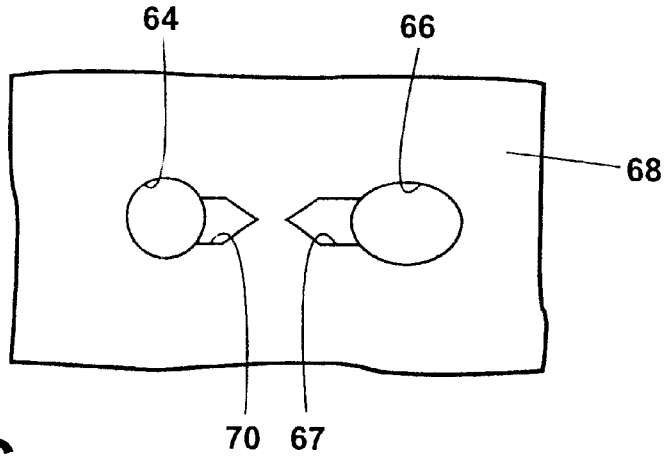

Furthermore, the print head having a groove between the first nozzle and the second nozzle may have another groove 70 formed as a second groove from the orifice of the first nozzle 64 to the middle part between the orifice of the first nozzle 64 and the orifice of the second nozzle 66 in addition to the groove 67 formed as a first groove from the orifice of the second nozzle 66 to the middle part between the orifice of the first nozzle 64 and the orifice of the second nozzle 66, as shown in FIGS. 23A, 23B, and 23C. The grooves 67 and 70 are formed in such a way that one end is opposite to the other end and does not come into contact with the other end.

If a printing is performed with this print head, the metering ink is well separated from the introduced ink when the ink is metered. This prevents the ink from adhering to the portion around the orifices of the nozzles 64, 66, and prevents the occurrence of worse printing. The print head can thereby correctly reproduce the gradation of concentration and, thus, can make a recorded image of high resolution.

The above-described groove 70 can have a flat end, an arc end, or a pointed end at the side of the second nozzle 66 of the groove 70, similar to the groove 67, as shown in FIGS. 23A, 23B, and 23C, respectively. The depth of the groove 70 is preferably gradually smaller from the first nozzle 64 toward the second nozzle 66. If the groove 70 has the above-described tapering depth, a discharge of the diluent is improved.

Figure 24A:
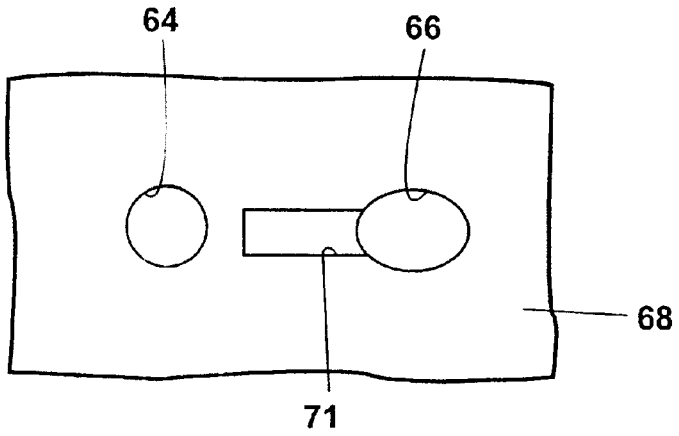
FIGS. 24A, 24B, and 24C are enlarged plan views illustrating a main part of a print head of a printing apparatus according to twelfth, thirteenth, and fourteenth embodiments of the present invention.
Figure 24B:
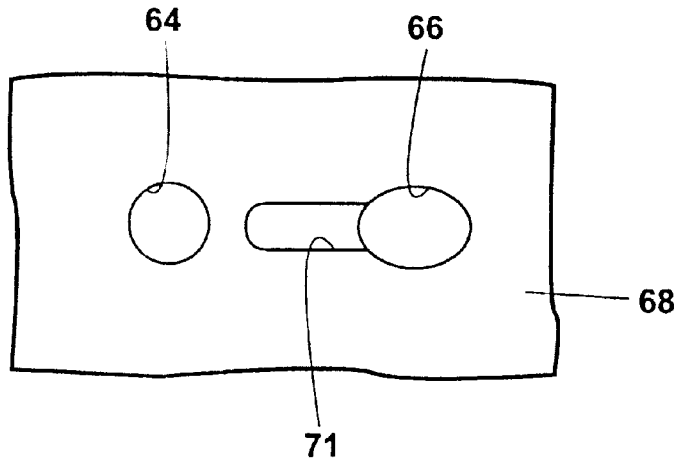
Figure 24C:
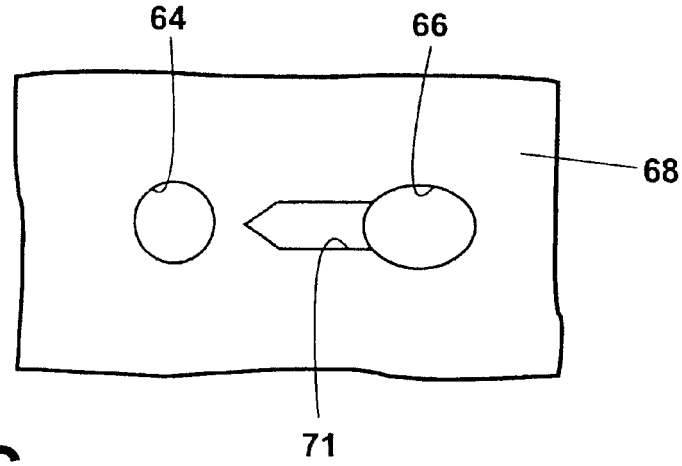

The print head having a groove between the first nozzle and the second nozzle may have a groove 71 formed from the orifice of the second nozzle 66 to the vicinity of the orifice of the first nozzle 64. The groove 71 may have a flat end, as shown in FIG. 24A, an arc end, as shown in FIG. 24B, or a pointed end, as shown in FIG. 24C, at the side of the first nozzle 64 of the groove 71, as in the case of the groove 67. The depth of the groove 71 is preferably gradually smaller from the second nozzle 66 toward the first nozzle 64.

Figure 25:
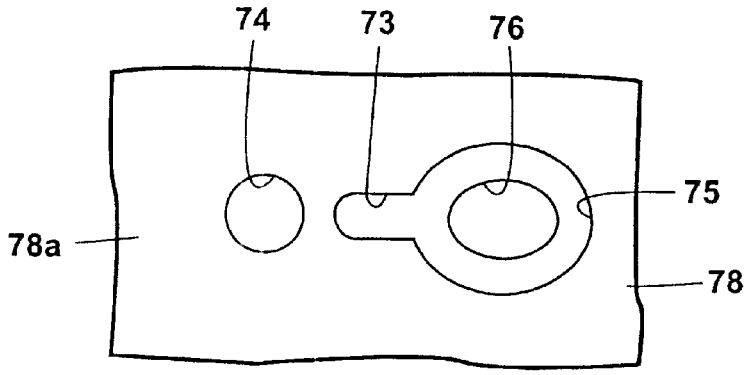
FIG. 25 is an enlarged plan view illustrating a main part of a print head of a printing apparatus according to a fifteenth embodiment of the present invention.
Figure 26:
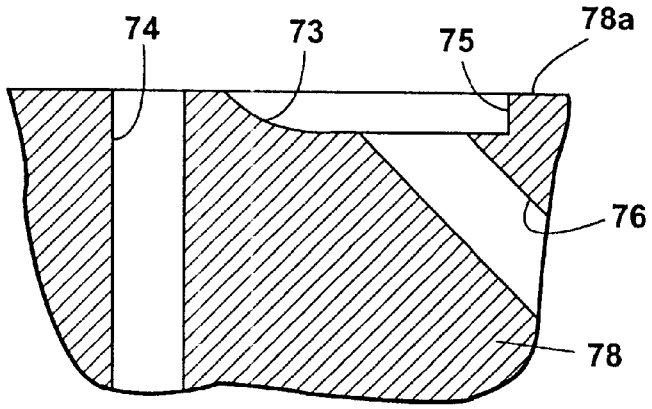
FIG. 26 is an enlarged cross-sectional view illustrating a main part of the print head according to the fifteenth embodiment of the present invention.

The print head of the printing apparatus according to the present invention may also have a recess formed at least around the orifice of the second nozzle 76 of the nozzle outlet face to surround the orifice of the second nozzle 76, in addition to the groove formed between the orifice of the first nozzle 74 and the orifice of the second nozzle 76, as schematically shown in FIGS. 25 and 26.

In other words, for example, this print head may have almost the same constitution as the above-described print head, and also have a recess 75 surrounding the orifice of the second nozzle 76 in addition to the groove 73 formed from the orifice of the second nozzle 76 to the middle part between the orifice of the first nozzle 74 and the orifice of the second nozzle 76 in the main printing face 78*a* of the nozzle outlet face of the orifice plate 78. This further prevents the ink from spreading around the orifice of the nozzle 76. In this case, the groove 73 has a depth that gradually becomes smaller from the second nozzle 76 toward the first nozzle 74 and is connected to the recess 75.

Figure 27:
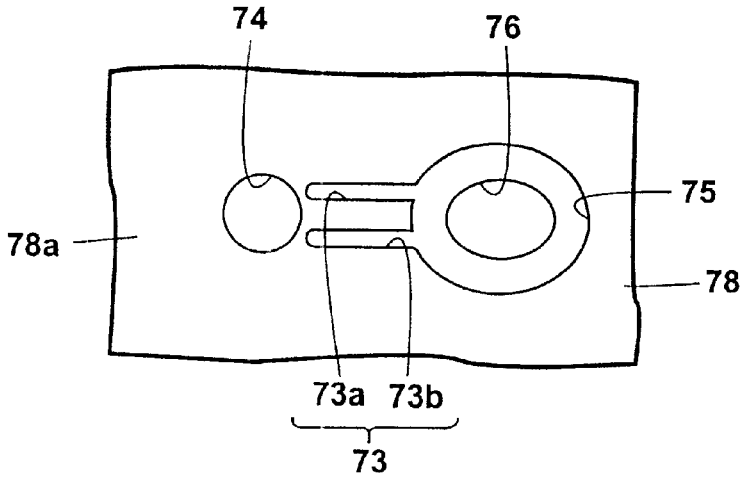
FIG. 27 is an enlarged plan view illustrating a main part of a print head of a printing apparatus according to a sixteenth embodiment of the present invention.

Moreover, the groove 73 may have a shape divided into two lines 73*a* and 73*b*, instead of the above-described shape of a single line, as schematically indicated in FIG. 27.

Figure 28:
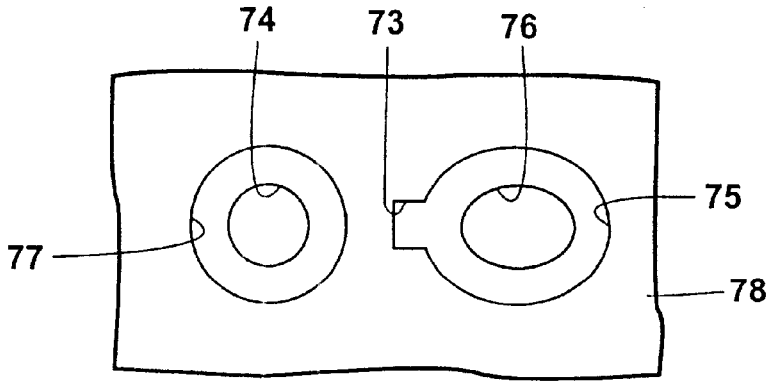
FIG. 28 is an enlarged plan view illustrating a main part of a print head of a printing apparatus according to a seventeenth embodiment of the present invention.

The print head of the printing apparatus according to the present invention may also have a recess 77 formed around the orifice of the first nozzle 74, as shown in FIG. 28. The recess 77 is in addition to a groove 73 formed from the orifice of the second nozzle 76 to the middle part between the first nozzle 74 and the orifice of the second nozzle 76, and a recess 75 formed around the orifice of the second nozzle 76 to surround the orifice of the second nozzle 76. In this case, the groove 73 is connected to the recess 75. This print head of the printing apparatus further prevents the ink, diluent, and mixed solution from spreading around the orifices of the nozzles.

Figure 29A:
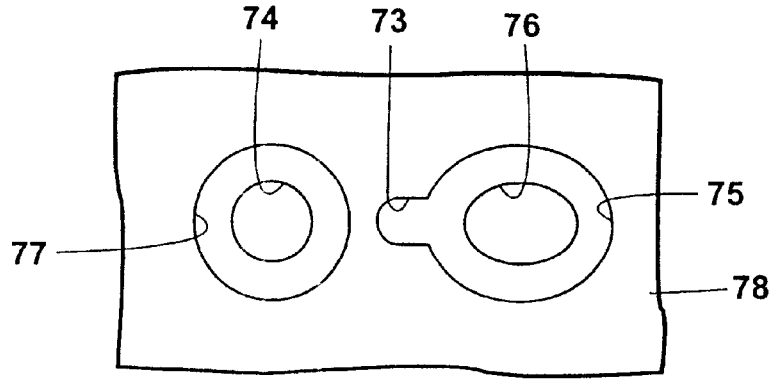
FIGS. 29A and 29B are enlarged plan views illustrating a main part of a print head of a printing apparatus according to eighteenth and nineteenth embodiments of the present invention.
Figure 29B:
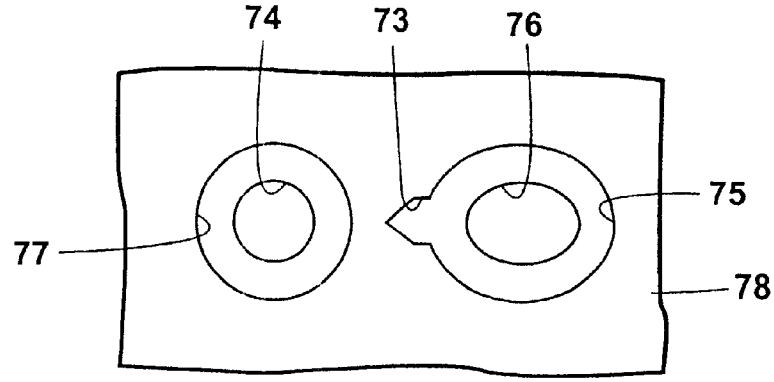

It is possible that the above-described print head having recesses 75 and 77 may also have an arc end or a pointed end at the side of the first nozzle 74 of the groove 73, as shown in FIGS. 29A and 29B, respectively, as in the case of the above-described print head.

Figure 30A:
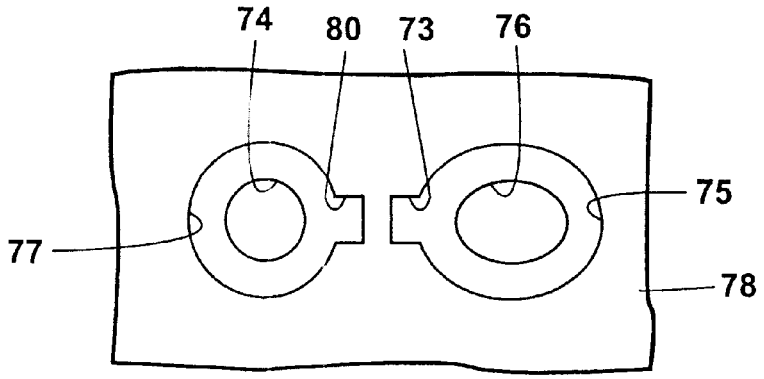
FIGS. 30A, 30B, and 30C are enlarged plan views illustrating a main part of a print head of a printing apparatus according to twentieth, twenty-first, and twenty-second embodiments of the present invention.
Figure 30B:
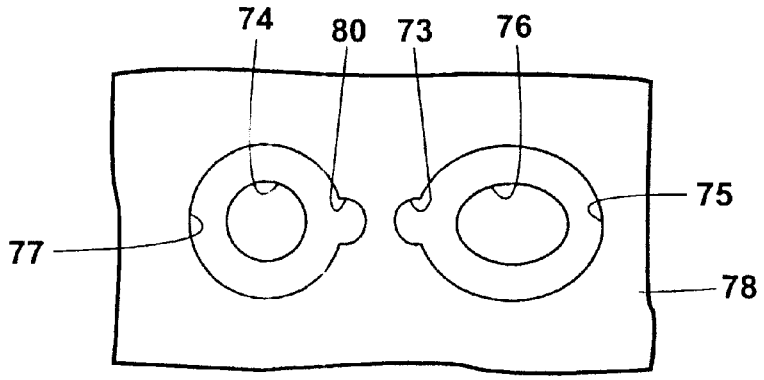
Figure 30C:
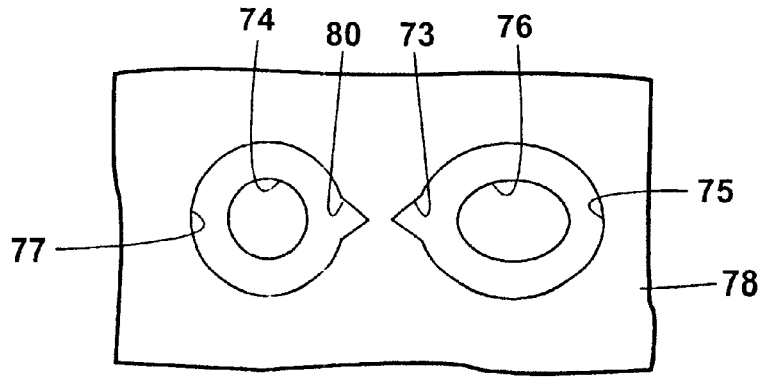

In addition, as shown in FIGS. 30A, 30B, and 30C, the print head having a groove between the first nozzle and the second nozzle may have another groove 80 formed as a second groove from the orifice of the first nozzle 74 to the middle part between the orifice of the first nozzle 74 and the orifice of the second nozzle 76. The groove 80 is in addition to the groove 73 formed as a first groove from the orifice of the second nozzle 76 to the middle part between the orifice of the first nozzle 74 and the orifice of the second nozzle 76.

In this case, these grooves 73 and 80 are formed in such a way that one end is opposite to the other end and does not come into contact with the other end.

It is possible that the above-described groove 80 may also have a flat end, an arc end, or a pointed end at the side of the second nozzle 76 of the groove 80, as shown in FIGS. 30A, 30B, and 30C, respectively, as in the case of the above-described groove 73, and that the depth of the groove 80 becomes gradually smaller from the first nozzle 74 toward the second nozzle 76.

Figure 31A:
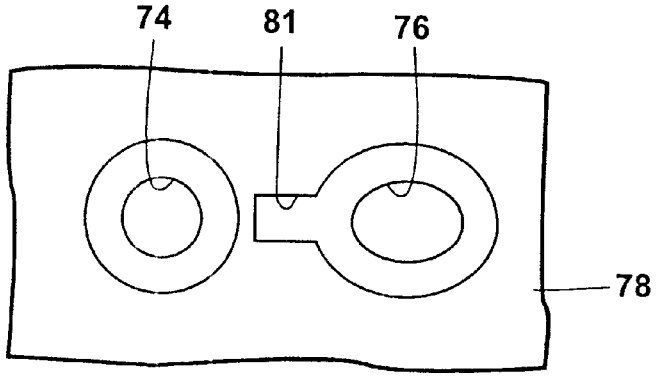
FIGS. 31A, 31B, and 31C are enlarged plan views illustrating a main part of a print head of a printing apparatus according to twenty-third, twenty-fourth, and twenty-fifth embodiments of the present invention.
Figure 31B:
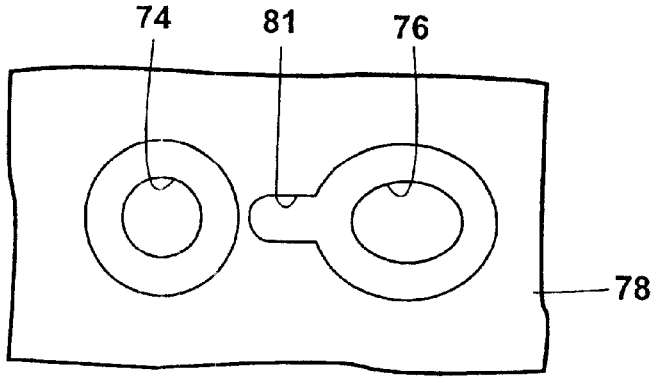
Figure 31C:
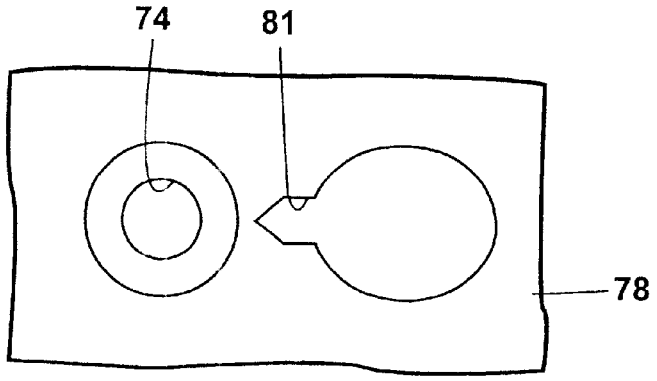

Furthermore, as shown in FIGS. 31A, 31B, and 31C, the print head may have a groove 81 formed from the orifice of the second nozzle 76 to the portion surrounding the first nozzle 74. It is possible that the above-described groove 81 may also have a flat end, an arc end or a pointed end at the side of the first nozzle 74 of the groove 81, as shown in FIGS. 31A, 31B, and 31C, respectively, as in the case of the above-described groove 73, and that the depth of the groove 81 becomes gradually smaller from the second nozzle 76 toward the first nozzle 74.

Figure 32:
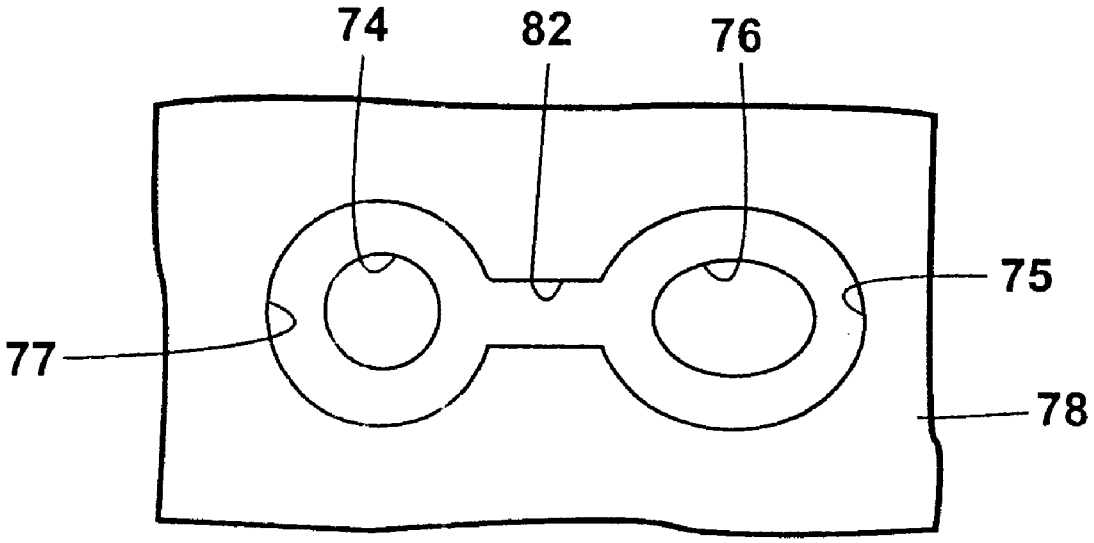
FIG. 32 is an enlarged plan view illustrating a main part of a print head of a printing apparatus according to a twenty-sixth embodiment of the present invention.
Figure 33:
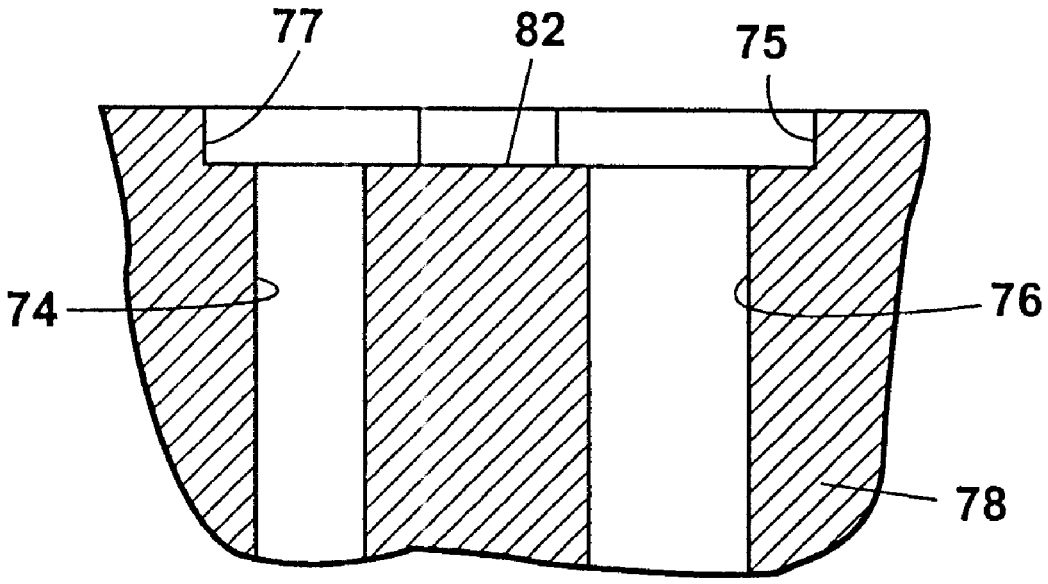
FIG. 33 is an enlarged cross-sectional view illustrating a main part of the print head according to the twenty-sixth embodiment of the present invention.

Moreover, as schematically shown in FIGS. 32 and 33, a groove 82 may also be formed from the orifice of the second nozzle 76 to the orifice of the first nozzle 74. In this case, both ends of the groove 82 are connected to the recesses 75 and 77, respectively.

Although various shapes of the grooves and the recesses have been described, it is noted that if the grooves and the recesses are instead in the form of the above-described hydrophilic portions, they would provide generally the same effects. Similarly, if the grooves and recesses are instead in the form of a non-processed portion and a hydrophobic portion, as described above, they would provide generally the same effects.

Figure 34:
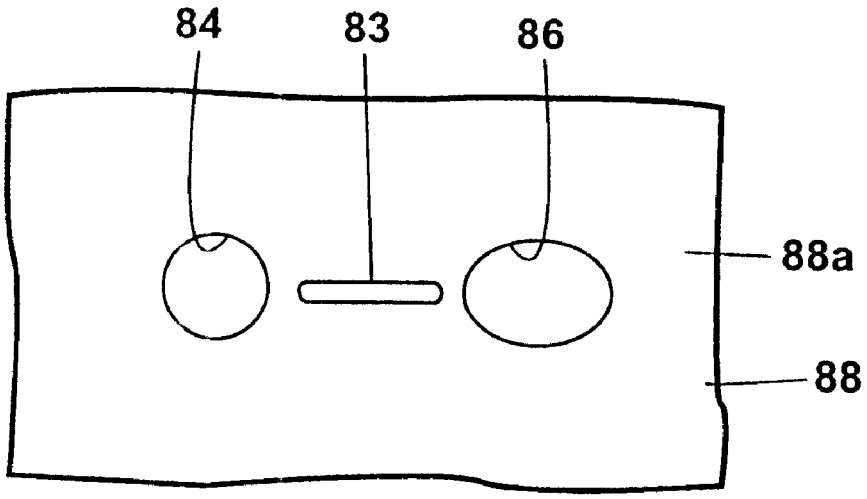
FIG. 34 is an enlarged plan view illustrating a main part of a print head of a printing apparatus according to a twenty-seventh embodiment of the present invention.
Figure 35:
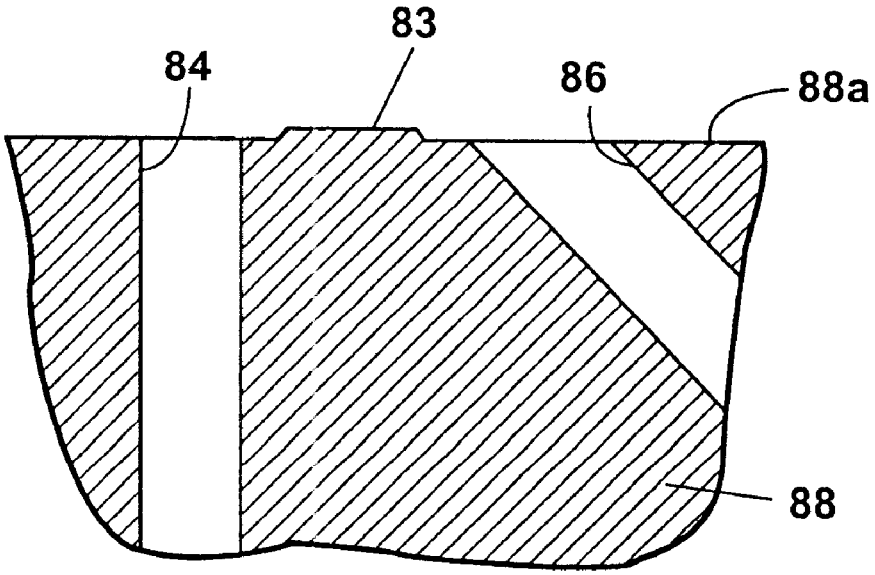
FIG. 35 is an enlarged cross-sectional view illustrating a main part of the print head according to the twenty-seventh embodiment of the present invention.

In addition, the print head of the printing apparatus according to the present invention may have an insular projection 83 formed between the orifice of the first nozzle 84 and the orifice of the second nozzle 86 in the main printing face 88*a* (i.e., the nozzle outlet face) of the orifice plate 88, as schematically shown in FIGS. 34 and 35. The insular projection 83 is a columnar projection with an elliptical plane and is made long in the direction connecting the first nozzle 84 to the second nozzle 86 and, thus, does not come into contact with the orifices of the nozzles 84 and 86.

When the printing is performed with this printing apparatus, the ink oozing from the second nozzle 86 travels along the above-described projection 83 owing to a capillary action and is fed to the first nozzle 84. Thus, the ink is prevented from spreading to the portion other than the projection 83 and from adhering to the portion around the orifices of the nozzles, thereby preventing the occurrence of worse printing. Thus, the print head can correctly reproduce the gradation of concentration and, thus, can form a recorded image of high resolution.

The projection 83 is preferably formed in such a way that the direction of its longer dimension is in the direction connecting the first nozzle 84 to the second nozzle 86, as shown in FIG. 34. However, if the projection 83 is made such that the direction of its longer diameter is in a direction normal to the direction connecting the first nozzle 84 to the second nozzle 86, the ink is easily introduced when the ink is metered.

Further, the printing apparatus of the present invention can take the constitution as described below. The constitution of the printing apparatus is nearly the same as indicated in FIG. 5 above. A block diagram of the printing part and control system of the printing apparatus is provided in FIG. 36. This block diagram is similar to the one indicated in FIG. 7 above. The control system 90 includes a signal-processing control circuit 22, which is similar to the one in FIG. 7, a memory 25, a drive control 27 and a correction circuit 26. A description of the parts which have already been described with respect to FIG. 7 is omitted.

The control system 90 also includes a first driver 91 and a second driver 92. The first and second drivers 91, 92 are installed in correspondence with the first nozzle for the delivery of discharge medium and the second nozzle for the delivery of metering medium, respectively.

The first driver 91, as will be described later, provides a drive control for a first layered piezo-electric element to spew out the discharge medium from the first nozzle. The second driver 92 provides a drive control for a second layered piezo-electric element to push out under pressure the metering medium from the second nozzle. Incidentally, one of the discharge and metering media may be ink, and the other may be a diluent.

The first and second drivers 91 and 92 are under the control of a serial/parallel converting circuit and a timing control circuit, as described below, and are placed in the signal control circuit 22 to engage in the drive control of the corresponding first and second layered piezo-electric elements.

Figure 37:
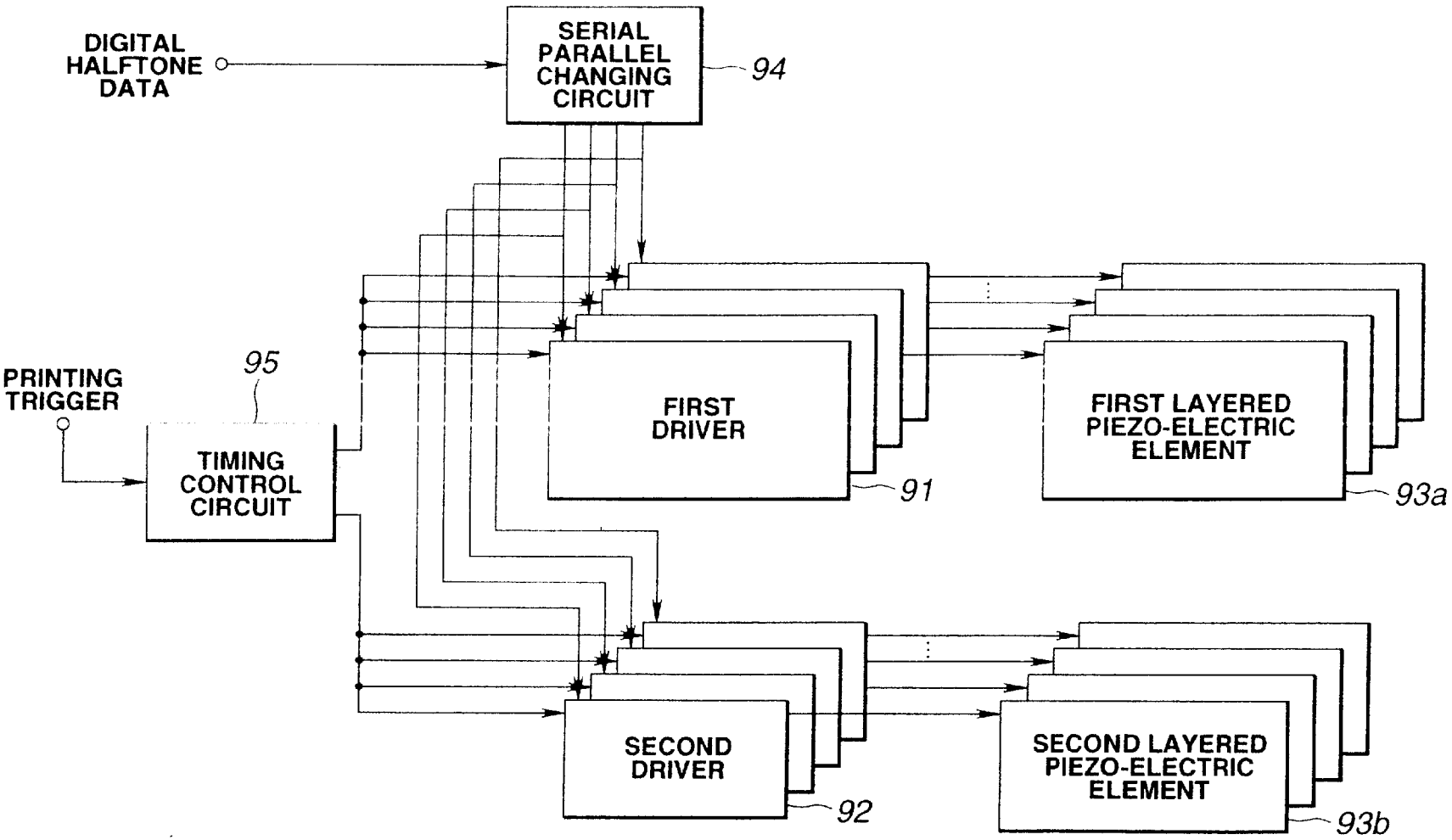
FIG. 37 is a circuit block diagram illustrating a driving circuit of a print head of a printing apparatus according to the present invention.

The drive circuit for the print head is shown in FIG. 37. Digital data for graded tones are provided from other blocks, and delivered through the serial/parallel converting circuit 94 to the first and second drivers 91 and 92. When a digital datum for graded tones delivered through the serial/parallel converting circuit 94 is below a predetermined threshold, neither pushing-out of the metering medium nor spewing-out of the discharge medium occurs. When the timing is set to character printing, a trigger for character printing is dispatched from other blocks, and the timing control circuit detects the trigger and delivers a pushing-out control signal and a spewing-out control signal to the first and second drivers 91 and 92, respectively.

Figure 38:
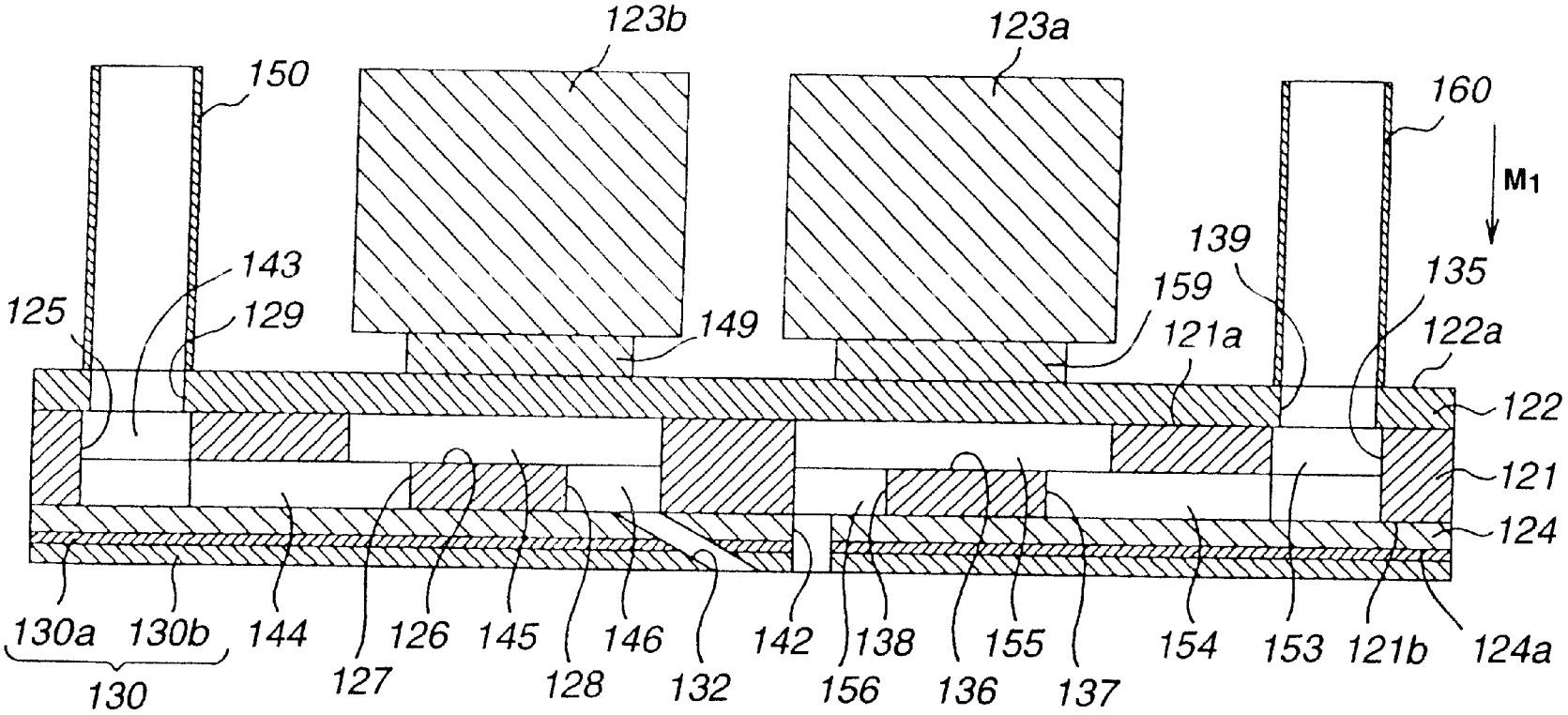
FIG. 38 is a cross-sectional view of a print head of a printing apparatus according to the present invention.

The constitution of the print head will be described by reference to FIG. 38. It is assumed here for purposes of illustration that the print head has a metering medium comprising ink and a discharge medium comprising a diluent. The print head of this example, as shown in FIG. 38, mainly consists of a pressure chamber forming member 121, a vibrating plate 122, the first and second layered piezo-electric elements 123*a* and 123*b*, and a nozzle forming member 124. The pressure chamber forming member 121 may be made of stainless steel or the like with a thickness of about 0.2 mm.

Constructed in the pressure chamber forming member 121 are a passage 135 forming a discharge-medium buffer tank (referred to hereinafter as a diluent buffer tank), a first concave surface 136 forming a pressure chamber for the discharge medium (referred to hereinafter as a diluent pressurizing chamber), a second concave surface 137 forming a discharge-medium feed channel (referred to hereinafter as a diluent feed channel), and a third concave surface 138 forming an outlet for the discharge medium (referred to hereinafter as a diluent conduit). The first concave surface 136 has a mouth directed to a main surface 121*a*. The second concave surface 137 has a mouth directed towards another main surface 121*b*, opposite to the main surface 121*a*, and joins the passage 135 and one end of the first concave surface 136. The third concave surface 138 directs its mouth toward the main surface 121*b* and communicates with the other end of the first concave surface 136.

Further, constructed in the pressure chamber forming member 121 are a passage 125 forming a metering medium buffer tank (hereinafter referred to as an ink buffer tank), a fourth concave surface 126 forming a pressure chamber for the metering medium (hereinafter referred to as an ink pressurizing chamber), a fifth concave surface 127 forming a metering medium feed channel (hereinafter referred to as an ink feed channel), and a sixth concave surface 138 forming an outlet for the metering medium (hereinafter referred to as an ink conduit). The fourth concave surface 126 has a mouth directed to a main surface 121*a*. The fifth concave surface 127 has a mouth directed toward a main surface 121*b* opposite to the main surface 121*a* and joining the passage 125 and one end of the fourth concave surface 126. The sixth concave surface 138 has a mouth directed toward the main surface 121*b* and communicating with the other end of the fourth concave surface 126.

The pressure chamber forming member 121 has those passages and concave surfaces prepared therein such that the sixth concave surface 128 and the third concave surface 138 face each other with a specified interval in between.

The pressure chamber forming member 121 of the print head of this example has a vibrating plate 122 formed on the same side as the main surface 121*a*, and a nozzle forming member 124 (hereinafter referred to as an orifice plate) formed on the same side as the main surface 121*b*, such that the vibrating plate 122 and the orifice plate 124 embrace the pressure chamber forming member 121 between them in the direction of thickness.

The orifice plate 124 may be made, for example, of a resin plate with a thickness of about 50 $\mu$m. A suitable material for the orifice plate 124 is Neoflex™ (available from Mitsui Toatsu Chemicals Co.), which is a thermoplastic polyimide with a glass transition temperature of approximately 200° C. If such resin is used, the chemical stability of the ink and diluent will be advantageously ensured.

The second nozzle 132 (referred to hereinafter as an ink nozzle) is formed on the orifice plate 124 opposite to the sixth concave surface 128, which forms the ink conduit, to push out under pressure a specified amount of the metering medium or ink. The first nozzle 142 (referred to hereinafter as a diluent nozzle) is formed opposite to the third concave surface 138, which forms the diluent conduit, to spew out the discharge medium or a diluent.

The ink nozzle 132 takes the form of a channel whose axis approaches the diluent nozzle 142 as it comes closer to the opening of the nozzle or the main surface 124*a*. The ink and diluent nozzles 132 and 142 consist of channels each having a round cross-section of a specific diameter, and are so formed as to have a smaller diameter than either the sixth concave surface forming the ink conduit or the third concave surface 138 forming the diluent conduit.

The print head of this example also has a constitution wherein a liquid-repellent membrane 130 is formed on the main surface 124*a* of the orifice plate 124 upon which the openings of the nozzles are formed. Parts of the liquid-repellent membrane 130 are selectively removed, and a groove, as described below, is inscribed between the openings of the ink nozzle 132 and the diluent nozzle 142.

The material suitable for the liquid-repellent membrane 130 may include polyimide materials suitable for painting, and a material having photosensitivity is preferred.

The sixth concave surface 128 forming the ink conduit has been so formed as to have a larger diameter than does the ink nozzle 132, while the third concave surface 138 forming the diluent conduit has been so formed as to have a larger diameter than does the diluent nozzle 142.

As the pressure chamber forming member 121 is inserted between the vibrating plate 122 and the orifice plate 124 in the direction of thickness, the passage 135, the first concave surface 136, the second concave surface 137, and the third concave surface 138 join together, and a cavity is formed which is confined between the vibrating plate 122 and the orifice plate 124. Thus, the diluent buffer tank 153 formed in the direction of thickness from the vibrating plate 122 down to the orifice plate 124 with the pressure chamber forming member 121 as a side wall, the diluent feed channel 154 communicating with the tank 153 and formed in the axial direction of the pressure chamber forming member 121, the diluent pressurizing chamber 155 communicating with the channel 154 and formed in contact with the vibrating plate 122, and the diluent conduit 156 communicating with the chamber 155 and the opening through the orifice plate 124 communicate with each other to form a continuous channel.

An ink feed aperture 129 is prepared on the vibrating plate 122 as mentioned earlier, and an ink nozzle is prepared on the orifice plate 124. Thus, ink flows from the ink feed aperture 129 through an ink buffer tank 143, ink feed channel 144, ink pressurizing chamber 145, ink conduit 146, and ink nozzle 132 in this order.

As the pressure chamber forming member 121 is inserted between the vibrating plate 122 and the orifice plate 124 in the direction of thickness, the passage 125, the fourth concave surface 126, the fifth concave surface 127, and the sixth concave portion join together, and a cavity is formed which is confined between the vibrating plate 122 and the orifice plate 124. Thus, the ink tank 143 formed in the direction of thickness from the vibrating plate 122 down to the orifice plate 124 with the pressure chamber forming member 121 as a side wall, the ink feed channel 144 communicating with the ink buffer tank 143 and formed in the axial direction of the pressure chamber forming member 121, the ink chamber pressing chamber 145 communicating with the ink feed channel 144 and formed in contact with the vibrating plate 122, and the ink conduit 146 communicating with the pressing chamber 145 and opening on the orifice plate 124 communicate with each other to form a continuous channel.

The diluent feed aperture 139 is prepared on the vibrating plate 122, as mentioned earlier, and the diluent nozzle 142 is prepared on the orifice plate 124. Thus, ink flows from the diluent feed aperture 139, the diluent buffer tank 153, the diluent feed channel 154, the diluent pressing chamber 155, the diluent conduit 156, and the diluent nozzle 142 in this order.

Figure 40:
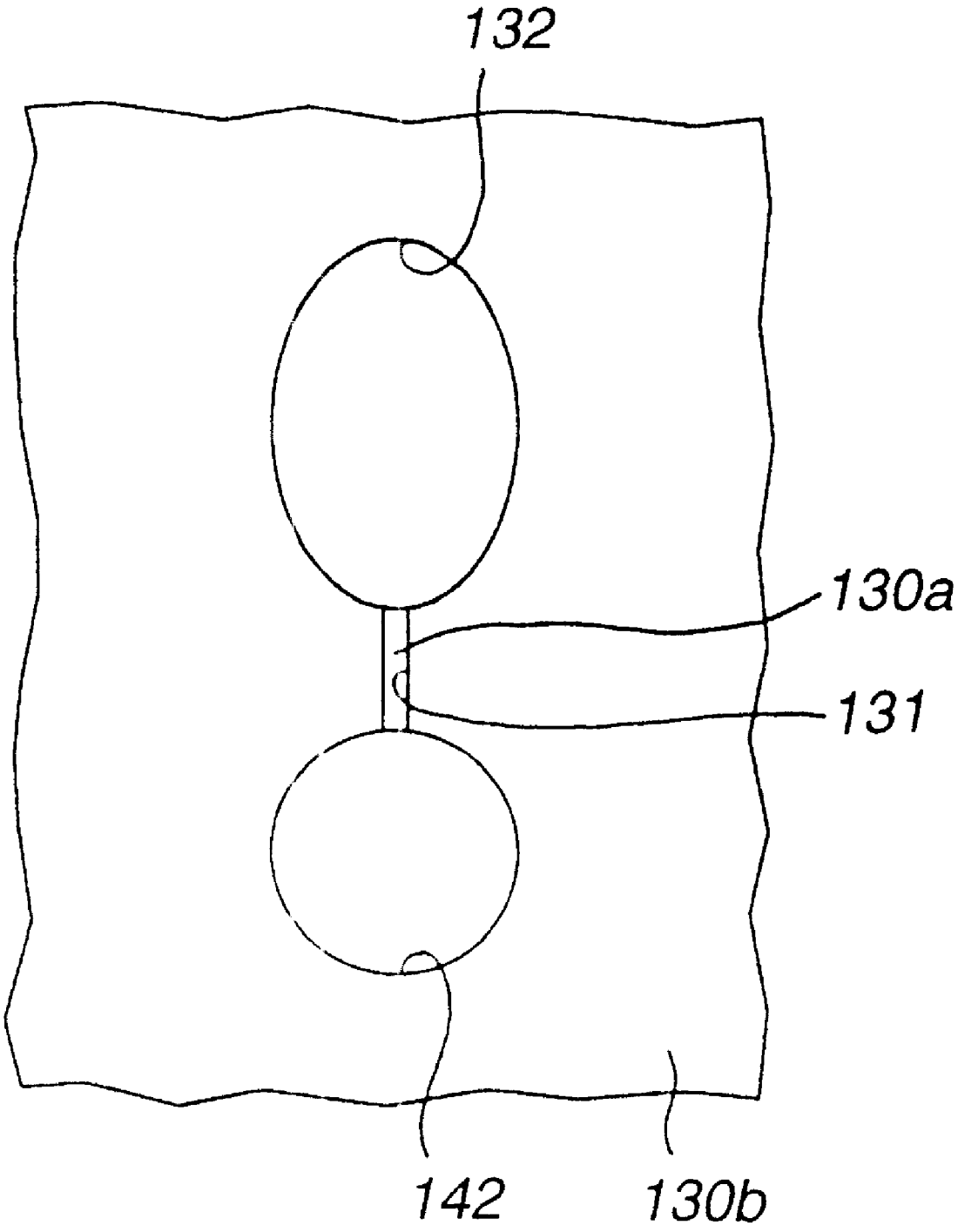
FIG. 40 is an enlarged plan view of a print head of a print apparatus according to the present invention in which a liquid-repellent membrane is formed on the main surface where the nozzles open, and a groove is formed between the nozzles.

It is assumed for illustration that the print head of the present invention has a constitution wherein the liquid-repellent membrane 130 applied on the main surface 124*a* of the orifice plate where the nozzles open has a structure with one layer 130*b* overlaid upon another layer 130*a*, and, as shown schematically in FIG. 40, a portion of the superficial layer or the second layer 130*b* has been selectively removed in such a manner that a straight groove 131 connecting the openings of the ink nozzle 132 and the diluent nozzle 142 is formed. The groove 131 has a width smaller than the diameter of the opening of the ink nozzle 132, and has the liquid-repellent membrane 130 formed on the bottom surface and the underlying layer or the first layer 130*a* exposed to outside.

For the print head of this example, the diameter of the diluent and ink nozzles 142 and 132 may be about 30 to 50 $\mu$m, and the width of the groove may be 30 $\mu$m or less, more preferably 20 $\mu$m or less, and further more preferably 10 $\mu$m or less.

Figure 41:
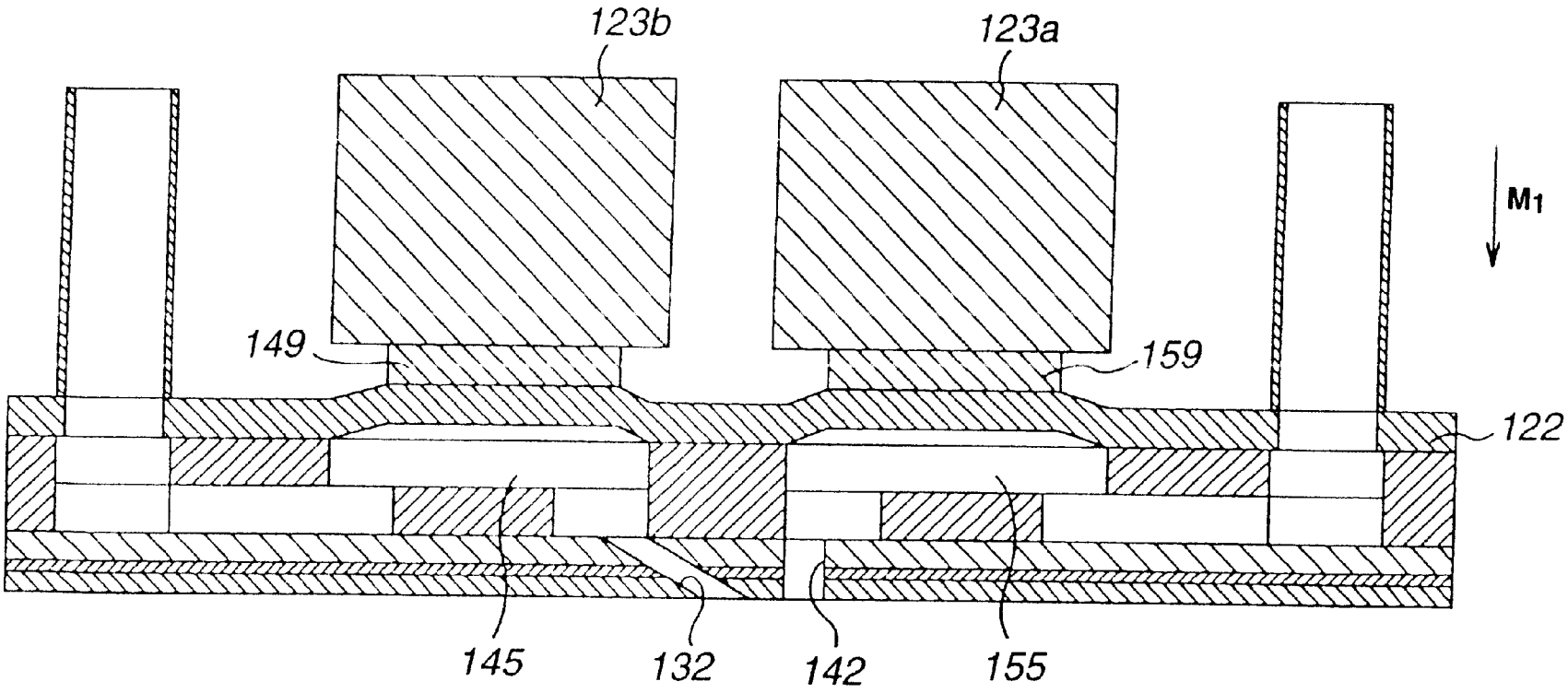
FIG. 41 is a cross-sectional view of a print head of a printing apparatus according to the present invention wherein both piezo-electric elements are at a raised position.

As shown in FIG. 41, the print head of this example has a further constitution wherein a projection 149 is formed on the surface 122*a* of the vibrating plate 122 opposite to the surface to which the vibrating plate 122 is bonded to the pressure forming chamber members 121. The projection 149 is formed at a location opposite to the ink pressurizing chamber 145. A layered piezo-electric element 123*b* (a first layered piezo-electric element) is fixed firmly through the projection 149 to the underlying structure. The projection 149 is bonded to the vibrating plate 122 with a bonding agent (not shown).

Similarly, another projection 159 is formed at a location opposite to the diluent pressurizing chamber 155. Another layered piezo-electric element 123*a* (a second layered piezo-electric element) is firmly fixed to the underlying structure through the projection 159. The layered piezo-electric elements 123*a* and 123*b* may include piezo-electric components and electro conductive components laid one over another. The number of piezo-electric and electro-conductive components used is not restricted to any specific number.

The projections 149 and 159 are so constructed that their flat surface is smaller in area than the flat surface of the ink pressurizing chamber 145 or of the diluent pressurizing chamber 155, respectively, and smaller in area than the flat surface of the layered piezo-electric elements 123*b* or 123*a*, respectively. An ink feed pipe 150 connected to an ink tank (not shown) is fitted to the location corresponding to the ink feed aperture 129 on the main surface 122*a* of the vibrating plate 122. Similarly, a diluent feed pipe 160 connected to a diluent tank (not shown) is fitted to the location corresponding to the diluent feed aperture 139.

Figure 39:
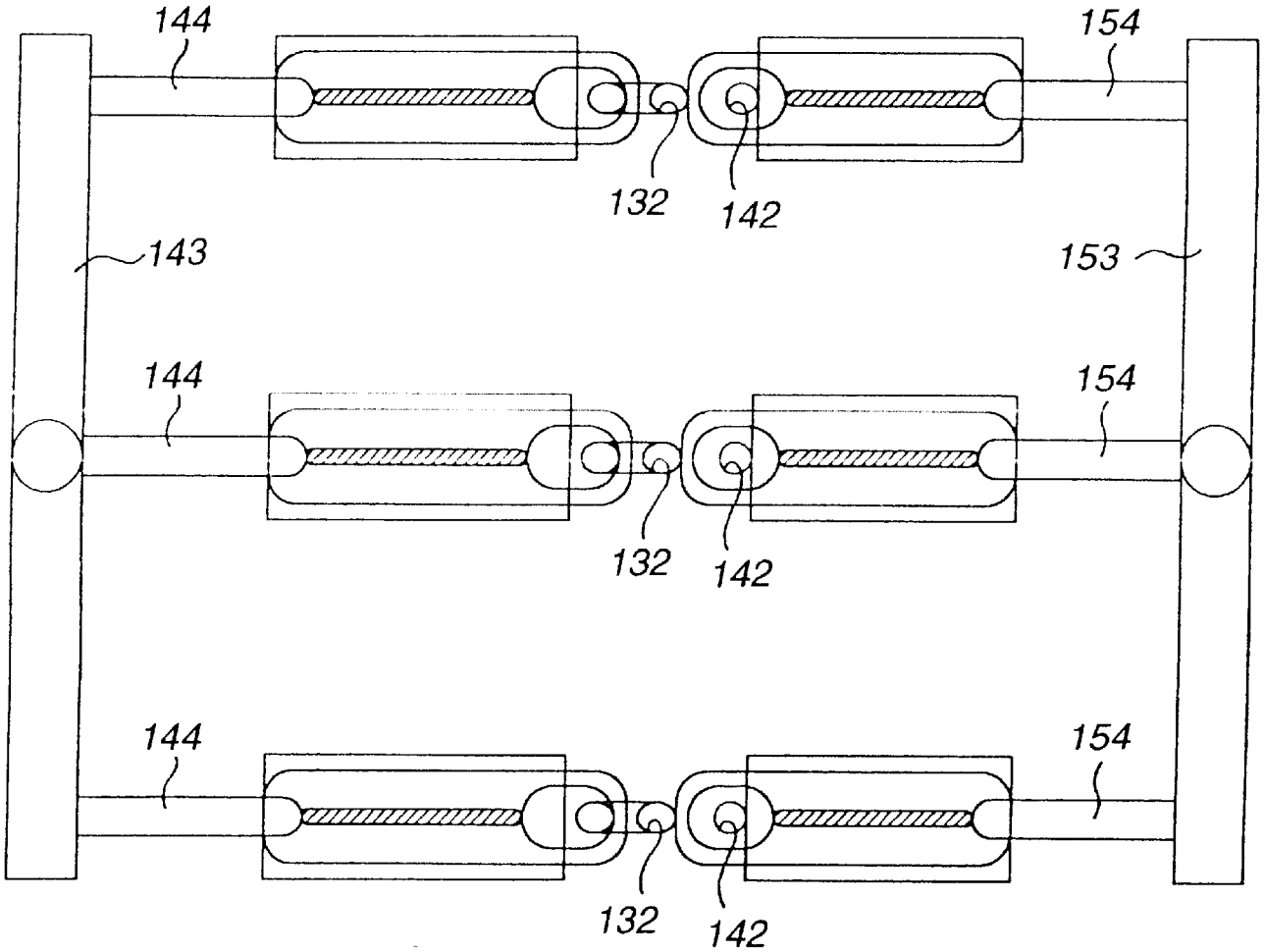
FIG. 39 is a plan view of a plurality of print heads according to the present invention arranged in parallel at regular intervals along an ink buffer tank and a diluent buffer tank.

The print head of the printing apparatus of this example has a further constitution wherein, as illustrated in FIG. 39, the ink buffer tank 143 and the diluent buffer tank 153 in the print head are so constructed as to have a tubular form, and a plurality of the print heads are arranged in parallel at specific regular intervals along the axial direction of the ink buffer tank 143 and the diluent buffer tank 153. The ink buffer tank 143 therefore acts as an ink distributing pipe common to all the print heads and, similarly, the diluent buffer tank 153 acts as a diluent distributing pipe common to all the print heads. In each of these print heads, the ink feed channel 144 is joined to the ink buffer tank 143, and the diluent feed channel 154 is joined to the diluent buffer tank 153. Therefore, the ink nozzle 132 and the diluent nozzle 142 in each print head have mouths that open close to each other on the same surface.

As is evident from the above description, in the print head of the printing apparatus of this example, ink is provided from the ink tank (not shown) to the ink buffer tank 143, and then to the ink feed channels 144 of the individual print heads, while a diluent is provided from the diluent tank (not shown) to the diluent buffer tank 153, and then to the diluent feed channels 154 of the individual print heads.

Printing with the print head of the printing apparatus of this example may take place as follows.

When a driving voltage is applied to the first layered piezo-electric element 123*a*, because of the piezo-electric element being so constructed as to displace linearly in the direction opposite to the direction indicated by the arrow $M_1$ in FIG. 38, the first piezo-electric element 123*a* carries the vibrating plate 122 upward via the projection 159 firmly bonded to the piezo-electric element 123*a*. This leads to an enlarged volume of the diluent pressurizing chamber 155, as shown in FIG. 41.

The same phenomenon also happens for the second layered piezo-electric element 123*b*. Namely, when a driving voltage is applied to the second piezo-electric element 123*b*, because of the element 123*b* being so constructed as to displace in the direction opposite to the direction indicated by the arrow $M_1$ in FIG. 38, the second piezo-electric element 123*b* carries the vibrating plate 122 upward via the projection 149 firmly bonded to the piezo-electric element 123*b*. This leads to an enlarged volume of the ink pressurizing chamber 145, as shown in FIG. 41.

When the first and second layered piezo-electric elements 123*a* and 123*b* are relieved of the driving voltage, because of their being so constructed as to displace linearly in the same direction as the arrow $M_1$ in FIG. 38, they press and bend inward the vibrating plate 122 via the projections 149 and 159. This leads to reduced volumes of the ink pressurizing and diluent pressurizing chambers 145 and 155, which, in turn, leads to increased pressures within the ink pressurizing and diluent pressurizing chambers 145 and 155. Because the projections 149 and 159 are so constructed as to have a smaller flat surface than the first and second layered piezo-electric elements 123*a* and 123*b*, they can concentrate the force transmitted through the displacement of the first and second layered piezo-electric elements 123*a* and 123*b* to the areas opposite to the diluent pressurizing chamber 155 and the ink pressurizing chamber 145, respectively.

The timing of driving voltages generated while printing is in progress with the printing apparatus of the above configuration is as shown in FIGS. 10A and 10B. Printing operation will therefore be explained with reference to FIGS. 10A and 10B, assuming that the first layered piezo element 45 in FIG. 10A corresponds to the first layered piezo-electric element 123*a*, and the second layered piezo element 48 in FIG. 10B corresponds to the second layered piezo-electric element 123*b*.

As shown in FIG. 10A, during standby periods before printing, at times indicated by (A), a voltage of, for example, 20V is applied to the layered piezo-electric element 123*a*, which has been placed opposite to the diluent pressurizing chamber 155. As shown in FIG. 10B, during standby periods before printing, at times indicated by (A), a voltage of, for example, 10V is applied to the layered piezo-electric element 123*b*, which has been placed opposite to the ink pressurizing chamber 145. In this state, as shown in FIG. 41, the ink pressurizing and diluent pressurizing chambers 145 and 155 are kept expanded. During these periods, a meniscus is formed at the tip of each of the ink and diluent nozzles 132 and 142.

Figure 42:
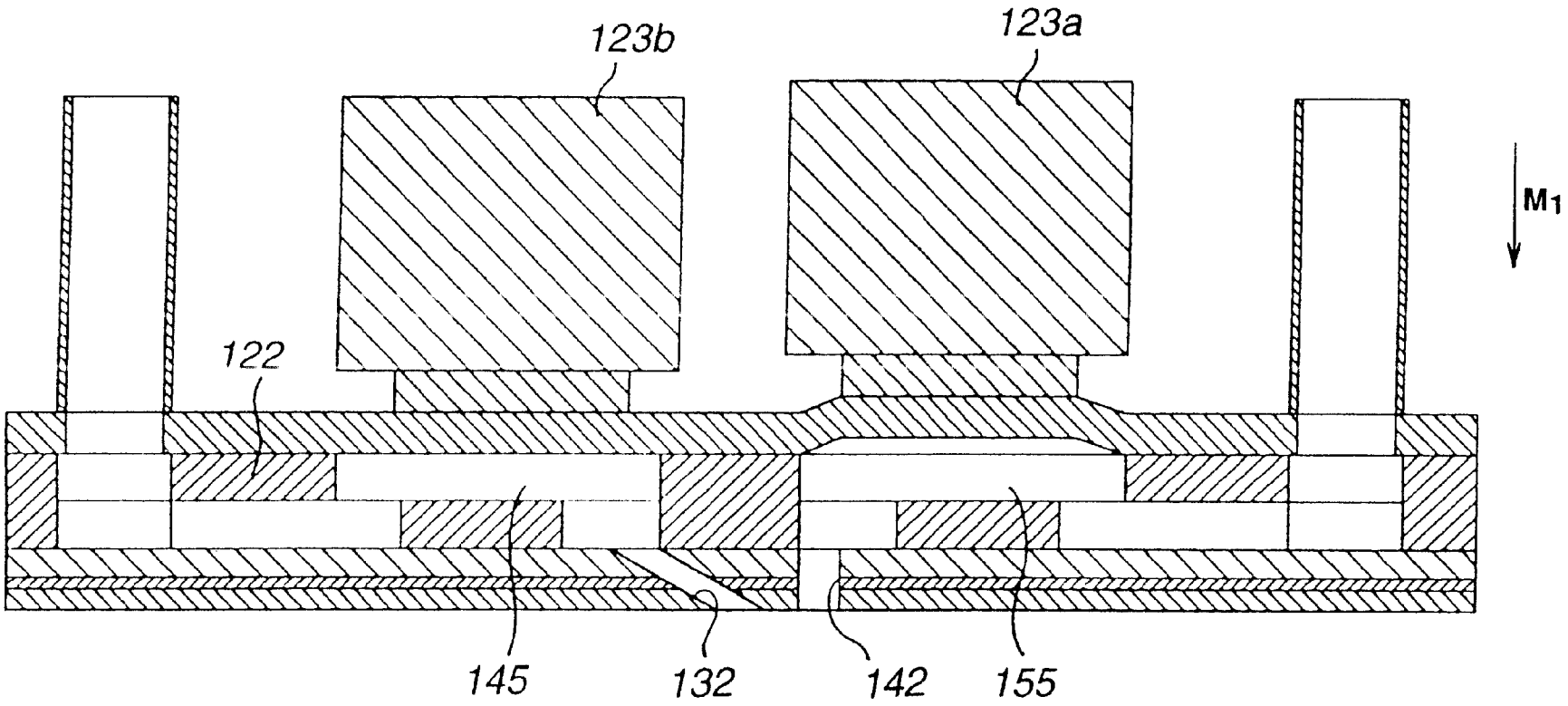
FIG. 42 is a cross-sectional view of a print head of a printing apparatus according to the present invention wherein a piezo-electric element for pressurizing the ink chamber is driven downward.

During printing, under the influence of signals from said head drive, head transfer control and drum revolution control, the voltage of the first layered piezo-electric element 123*b* is driven gradually downward to, for example, 5V at the time of (B) in FIG. 10B and maintained at that level for 150 $\mu$sec so that a specific amount of the metering medium is pushed out without being spewed out. During this interval, the second layered piezo-electric element 123*b* extends gradually in the direction as indicated by the arrow $M_1$ in FIG. 41, thereby pressurizing gradually the ink pressurizing chamber 145 via the vibrating plate 122, as shown in FIG. 42, and pushing the chamber 145 back towards its original position. The resulting increased internal pressure is transmitted to the ink nozzle 132, which causes ink to ooze out towards the opening of the diluent nozzle 142 to combine with the diluent there. The voltage is chosen to give a desired tone of the graphic data to be printed. The voltage is so adjusted as to give an amount of ink adequate to give a desired tone corresponding with the graphic data to be printed.

Then, the ink nozzle 132 draws in ink, and at the time (C) in FIG. 10B, the voltage applied to the second layered piezo-electric element 123*b* is allowed to return gradually to 1V, so that a specific amount of ink stays close to the opening of the diluent nozzle 142. During this operation, the second layered piezo-electric element 123*b* contracts gradually in the direction opposite to the direction indicated by the arrow $M_1$ in FIG. 42, the excess internal pressure of the ink nozzle 132 is relieved therewith, and ink at the tip tends to return to the interior of the ink nozzle 132. This operation allows a specific amount of ink to stay close to the opening of the diluent nozzle 142.

Then, at the time (D) in FIG. 10A the voltage applied to the first layered piezo-electric element 123*a* is made, for example, 0V. By this operation the first layered piezo-electric element 123*a* extends in the direction indicated by $M_1$ in FIG. 42, thereby to pressurize gradually the diluent pressurizing chamber 155 via the vibrating plate 122, and to push the chamber 155 back towards its original position. The resulting increased internal pressure is transmitted to the diluent nozzle 142, which causes the diluent to be pushed out to intermingle with the ink staying close to the opening of the diluent nozzle 142 to form a mixture.

Then, the voltage applied to the first layered piezo-electric element 123*a* is kept at 0V from the time marked (D) in FIG. 10A for 50 $\mu$sec, for example, and allowed to return to 20V, for example, at the time marked (E) in FIG. 10A. During this operation, the first layered piezo-electric element 123*a* contracts in the direction opposite to the direction indicated by the arrow $M_1$ in FIG. 42, the excess internal pressure of the diluent nozzle 142 is relieved therewith, and the diluent at the tip tends to return to the interior of the diluent nozzle 142.

This operation allows a constriction to develop between the diluent in the diluent nozzle 142 and the mixture, and finally the mixture is spewed out from the diluent nozzle 142 to hit upon the printing paper 1 for printing. During this operation the temporary change of the voltage applied to the first layered piezo-electric element 123*a* is set so as to allow a drop of the mixture to be spewed out from the diluent nozzle 142.

Soon the excess internal pressures of the diluent pressurizing chamber 155 and the ink pressurizing chamber 145 return to the original level, the diluent and ink are drawn into the diluent and ink nozzles 142 and 132, and the print head is put into a renewed standby state, as shown in FIG. 38.

Figure 36:
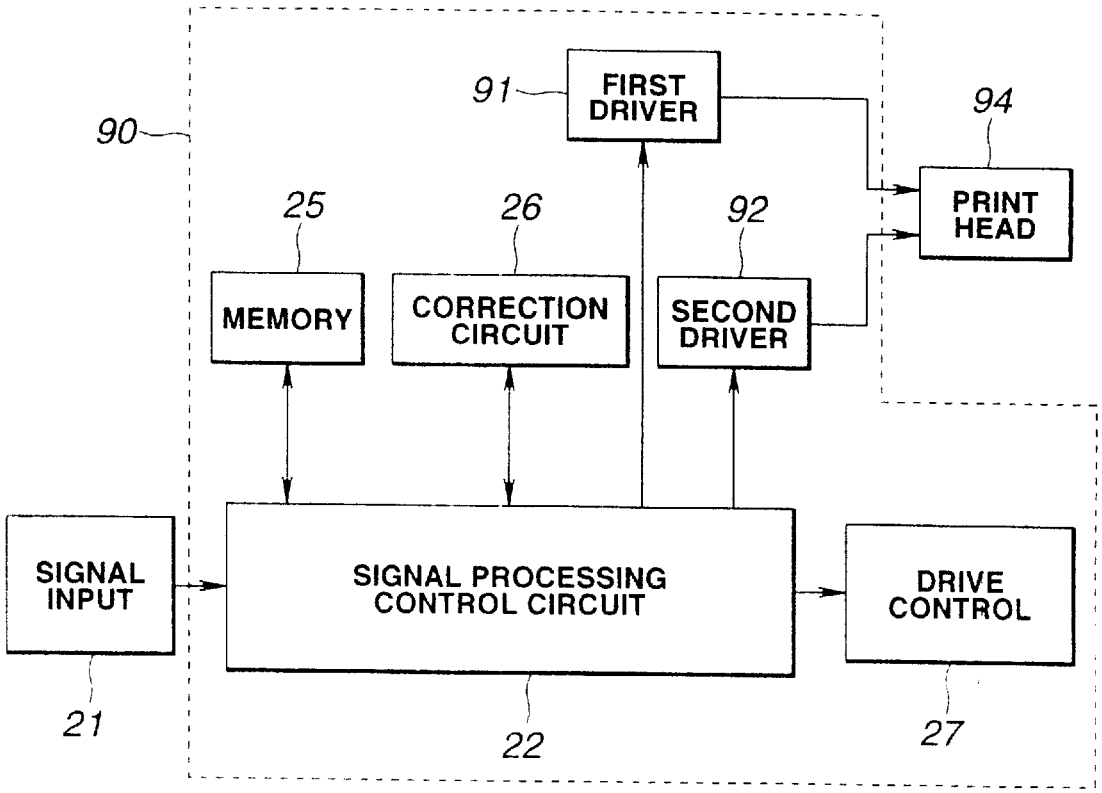
FIG. 36 is a block diagram of the printing and control system of a liquid-ejection-type recording device having a printing apparatus according to the present invention.

Signals from the driving circuit shown in FIG. 36 are dispatched at the timing indicated in FIGS. 10A and 10B, and, in accordance with those signals, specified voltages are applied to the first and second layered piezo-electric elements 123*a* and 123*b*.

As shown in FIG. 40, the printing apparatus of this example has a further constitution wherein the liquid-repellent membrane 130 is formed on the main surface 124*a* of the orifice plate 124 where the nozzles open. The portion of the liquid-repellent membrane 130 between the openings of the diluent nozzle 142 and ink nozzle 132, which are placed close to each other, has been selectively removed to form therein a groove 131.

"Wettability" at an interface between a solid and a liquid depends on the roughness of the surface of the solid. Namely, when the contact angle between a solid having a substantial surface area and a liquid having a substantial surface area (i.e., a contact angle when it is assumed that the surface roughness of the solid is zero) is larger than 90 degrees, wettability is impaired as the surface roughness increases. On the other hand, when the contact angle between a solid having a substantial surface area and a liquid having a substantial surface area (i.e., a contact angle when it is assumed that the surface roughness of the solid is zero) is smaller than 90 degrees, wettability is improved as the surface roughness increases.

The metering medium (i.e., ink) used in the printing apparatus of this example has a contact angle equal to or less than 90 degrees with respect to the liquid-repellent material, and thus, as discussed earlier, wettability is improved as the surface roughness increases.

Accordingly, in the printing apparatus of this example, a groove formed after selective removal of a portion of the liquid-repellent membrane 130 is made to have a rougher surface than other nearby portions, thereby raising its wettability so that the metering medium or ink under pressure may selectively flow through the groove 131 and its vicinity. With such a constitution, even a minute amount of ink can be stably pushed towards the diluent nozzle 142 to securely mix with the diluent, thereby ensuring ejection of the resultant mixture. The printing apparatus of this example therefore allows precise reproduction of tones of lower density. Thus, with this apparatus graded tones of a wide range of density can be reproduced faithfully, thereby enabling high resolution images of real objects.

Further, in the printing apparatus of this example, as the first layer 130*a* made of a liquid-repellent material is exposed on the bottom of the groove 131, spontaneous mixing of ink and the diluent during standby periods can be prevented.

The procedures for manufacturing the print head of the printing apparatus according to the present invention will now be described.

Figure 43:
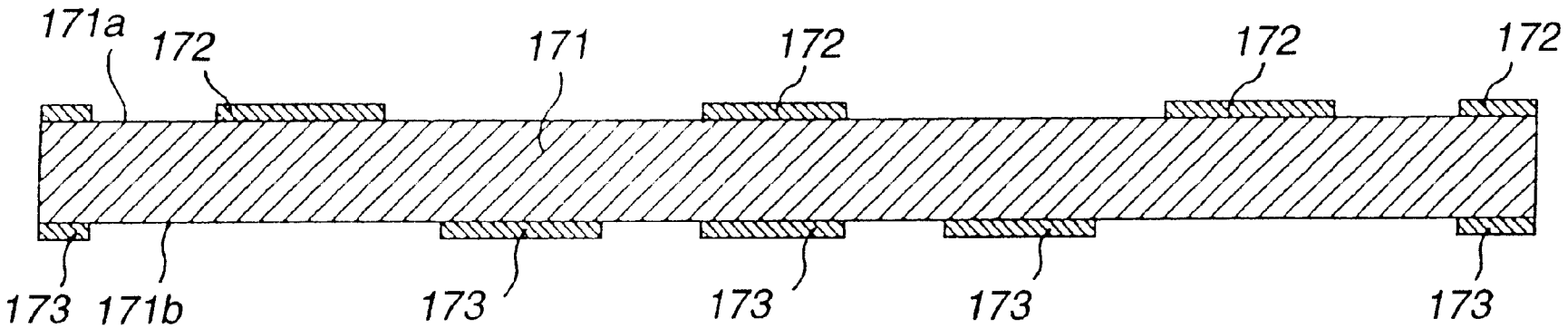
FIG. 43 is a cross-sectional view of a pressure chamber forming member of the print head of a printing apparatus according to the present invention.

First, the pressure chamber forming member is produced. As shown in FIG. 43, resists made of, for example, a photosensitive dry film or a liquid resist material are bonded onto one main surface 171*a* of a stainless steel member 171 made of a stainless steel plate with a thickness of about 0.2 mm. Then, a mask is prepared on whose surface portions corresponding to the passages for the ink buffer tank and the diluent buffer tank, and to the concave surfaces to form parts of the ink pressurizing and diluent pressurizing chambers have been processed into patterns susceptible to photo etching. The mask is applied onto the surface 171*a* and is exposed to light to form the resists 172 thereupon.

The same process as above is applied to the other main surface 171*b* which is opposite to the main surface 171*a* of the stainless steel plate 171. That is, a mask is prepared on whose surface portions corresponding to the concave surfaces to form the ink feed and diluent feed apertures, and to the concave surfaces to form parts of the ink pressurizing and diluent pressurizing chambers have been processed into patterns susceptible to photo etching. The mask is applied onto the surface 171*b* and is exposed to light to form the resists 173 thereupon.

Figure 44:
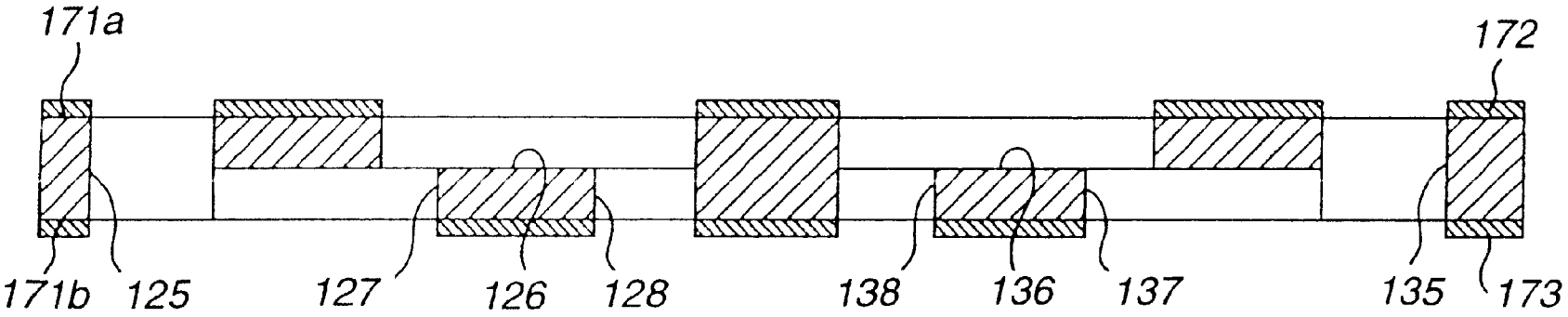
FIG. 44 is a cross-sectional view of the pressure chamber forming member of the print head after being subjected to an etching process.

The stainless member 171 is then subjected to etching with the resists 172 and 173 acting as masks. The stainless member 171 is immersed into an etching solution or, for example, into an iron chloride (II) aqueous solution for a specific period of time. As a result, as shown in FIG. 44, an ink buffer tank is formed with a passage 125 passing from the main surface 171*a* down to the opposite main surface 171*b*; an ink pressurizing chamber is formed with a fourth concave surface 126 directing its mouth towards the main surface 171*a*; an ink feed channel bounded at its sides with the passage 125 and at its base with the fourth concave surface 126 is formed with a fifth concave surface directing its mouth towards the main surface 171*b*; and an ink conduit is formed with a sixth concave surface 128 extending from the base of the fourth concave surface 126 and extending its mouth up to the main surface 171*b*.

Similarly, a diluent buffer tank is formed with a passage 135 passing from the main surface 171*a* down to the opposite main surface 171*b*; a diluent pressurizing chamber is formed with a fourth concave surface 136 directing its mouth towards the main surface 171*a*; a diluent feed channel bounded at its sides with the passage 135 and its base with the first concave surface 136 is formed with a second concave surface 137 directing its mouth towards the main surface 171*b*; and a diluent conduit is formed with a third concave surface 138 extending from the base of the first-concave surface 136 and extending its mouth up to the main surface 171*b*. In this assembly, as described earlier, the sixth and third concave surfaces are made to face each other with a specific interval in between.

Etching can be adjusted such that the consumed level from one side of the main surface of the stainless steel member 171 is equal to or marginally more than half the thickness of the steel member. Because the stainless steel member 171 has a thickness of 0.2 mm in this case, the consumed level from one main surface of the stainless steel member 171 is set to about 0.11 mm. This maneuver allows more precise reproduction of each passage and recess, thereby enabling their stable production.

Further, as the consumed levels from both main sides of the stainless steel member 171 are made nearly equal, the conditions responsible for the formation of the first and fourth concave surfaces 136 and 126, of the second and third concave surfaces 137 and 138, and of the fifth and sixth concave surfaces 127 and 128, respectively, are made nearly equal, which is helpful for simplifying and shortening the etching process.

Figure 45:
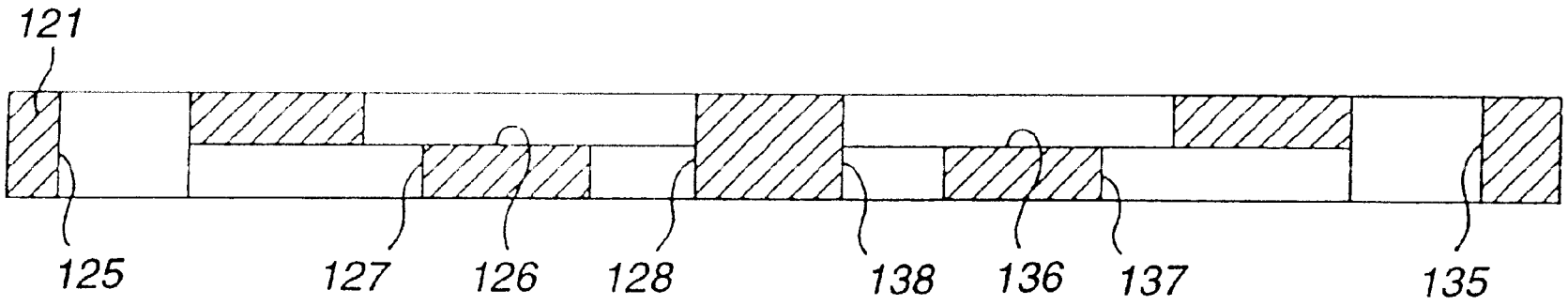
FIG. 45 is a cross-sectional view of the pressure chamber forming member of the print head after layers of resist material are removed.

Then comes removal of the resists 172 and 173. When a dry film is used for the resists 172 and 173, an aqueous solution of 5% or less sodium hydroxide, for example, may be used. When a liquid resist material is used for the resists 172 and 173, an alkali solution specially prepared for the purpose, for example, may be used. After the process, as shown in FIG. 45, a pressure chamber forming member 121 is constructed wherein a passage 135, a first concave surface 136, a second concave surface 137, a third concave surface 138, a passage 125, a fourth concave surface 126, a fifth concave surface 127, and a sixth concave surface 128 are formed.

Figure 46:
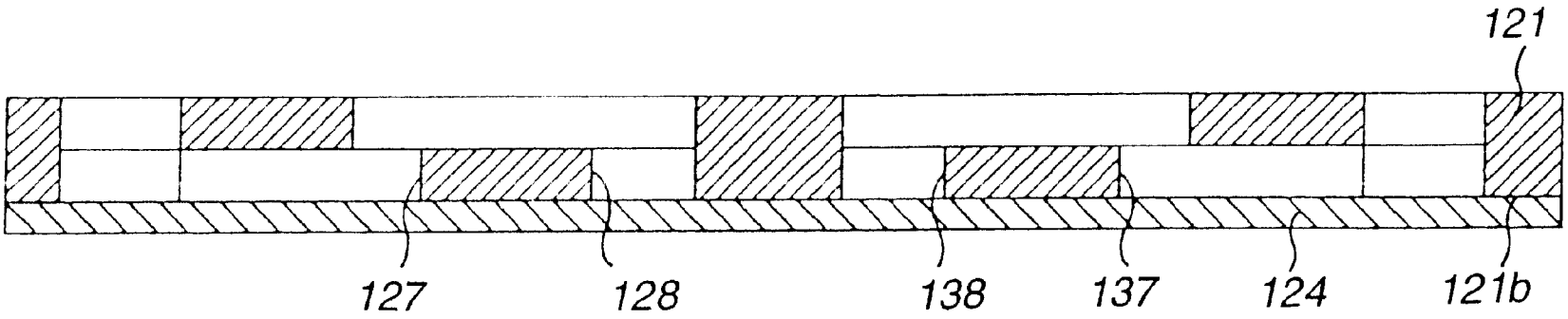
FIG. 46 is a cross-sectional view of the pressure chamber forming member of the print head after a layer of resin material is applied to form an orifice plate.

Then, as shown in FIG. 46, a resin material having a thickness of 50 $\mu$m and a glass transition temperature of 250° C. or less is placed to act as an orifice plate 124 upon the main surface 121*b* to which the mouths of the second concave surface 137, the third concave surface 138, the fifth concave surface 127, and the sixth concave surface 128 constructed within the pressure forming member 121 are directed. The material for the orifice plate 124 may include a membrane made of a thermoplastic polyimide or Neoflex™ (available from Mitsui Toatsu Chemicals Co.). The plate made of above material can be bonded by pressure while being heated. The bonding should be done at a temperature of approximately 230° C. under a pressure of 20 to 30 kgf/cm$^2$. This ensures stable and efficient bonding of the orifice plate 124 upon the pressure chamber forming member 121.

In this process, as the orifice plate 124 has no ink or diluent nozzles formed therethrough yet, the alignment of the orifice plate to the pressure chamber forming member 121 for bonding does not require so much precision, which makes the bonding easy. Further, as this bonding does not require use of a bonding agent, occlusion of the second, third, fifth and sixth concave surfaces 137, 138, 127 and 128, respectively, due to the presence of excess bonding agent can be effectively avoided.

Figure 47:
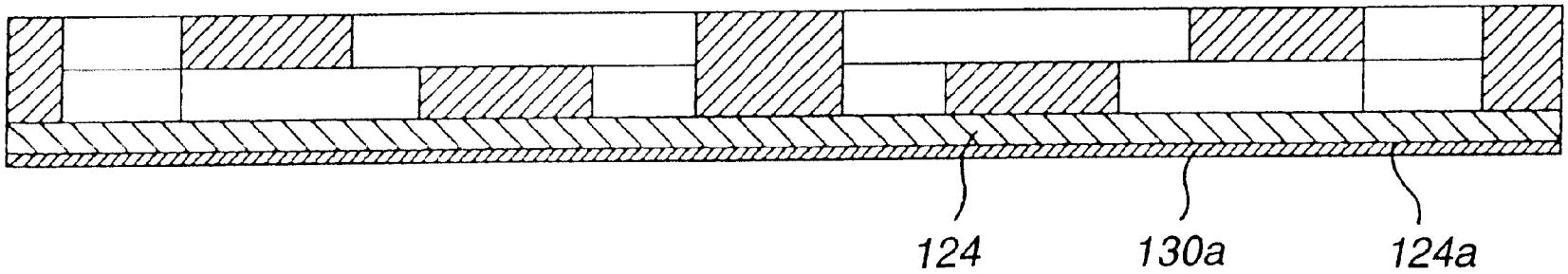
FIG. 47 is a cross-sectional view of the pressure chamber forming member of the print head after a first liquid-repellent membrane is formed on the main surface of the orifice plate.

Then, a first layer of membrane 130*a* to act as the liquid-repellent membrane is formed on the main surface 124*a* of the orifice plate 124, as shown in FIG. 47. The first layer of membrane 130*a* is preferably made of a material allowing laser processing and having a liquid-repellent property. Suitable materials are, for example, paintable polyimide materials, such as PIX™ (available from Hitachi Chemicals Co.) or Semicofine™ and Torenice™ (available from Toray Industries Inc.). Generally these materials take a liquid form before use and are dissolved in solvents. Thus, the material should be dried before use to remove the solvent, and allowed to take a form, for example, ready for the final polyimide polymerization.

The preferred drying consists of heating the material at a temperature of about 90 to 120° C. for 30 minutes to remove the solvent, and then reheating the material at about 200° C. (T1) for 30 to 60 minutes.

Figure 48:
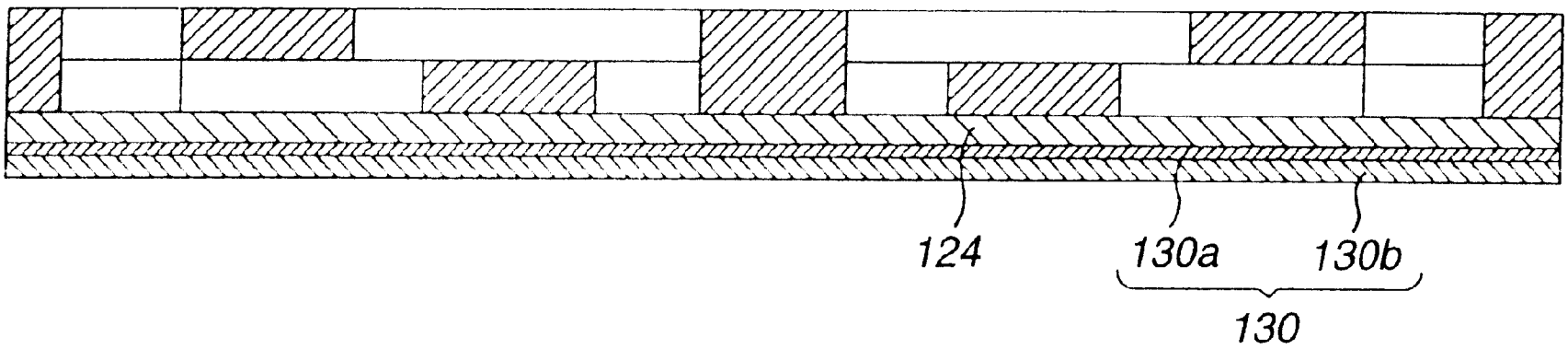
FIG. 48 is a cross-sectional view of the pressure chamber forming member of the print head after a second liquid-repellent membrane is formed over the first liquid-repellent membrane.

Then, a second layer of membrane 130*b* to act as another liquid-repellent membrane is formed on the first layer of membrane 130*a*, as shown in FIG. 48. The second layer is preferably made of a material allowing selective removal by photolithography and laser processing after membrane formation, and having a liquid-repellent property. Suitable materials are, for example, paintable polyimide materials, such as PIX™ (available from Hitachi Chemicals Co.) or Semicofine™ (available from Toray Industries Inc.).

If PIX™, which is a paintable polyimide material available from Hitachi Chemicals Co., or Semicofine™, which is a paintable polyimide material available from Toray Industries, Inc., is used as the material, it should be dried at about 90 to 120° C. for approximately 30 minutes, and then maintained at about 130 to 160° C. (T2) for 30 to 60 minutes, to form the second layer of membrane 130*b*. If the first and second layers 130*a* and 130*b* are made of similar materials, the temperature T1 should be higher than the temperature T2.

Figure 49:
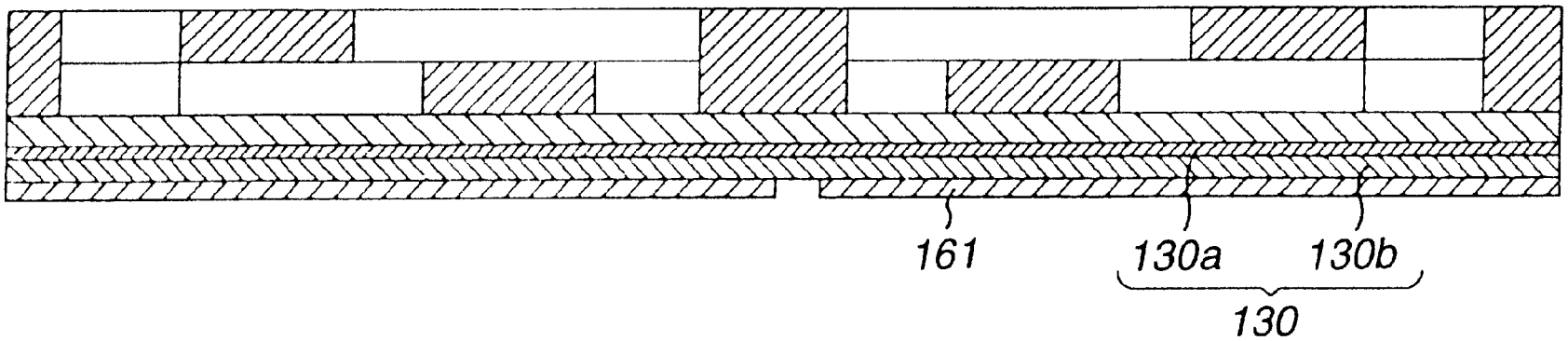
FIG. 49 is a cross-sectional view of the pressure chamber forming member of the print head after being coated with a photosensitive liquid resist material and subjected to photolithography.

In above process for the manufacture of the first layer 130*a*, as the material does not undergo polymerization, and thus does not have a liquid-repellent property, it can be painted easily as a flat membrane. The second layer 130*b* of the liquid-repellent membrane 130 is subjected, after having been coated with a photosensitive liquid resist material, to photolithography, as shown in FIG. 49. During this process, the second layer 130*b* is exposed to light and subjected to a developing process to form a mask material 161 corresponding in form to the groove 131 in FIG. 40.

Figure 50:
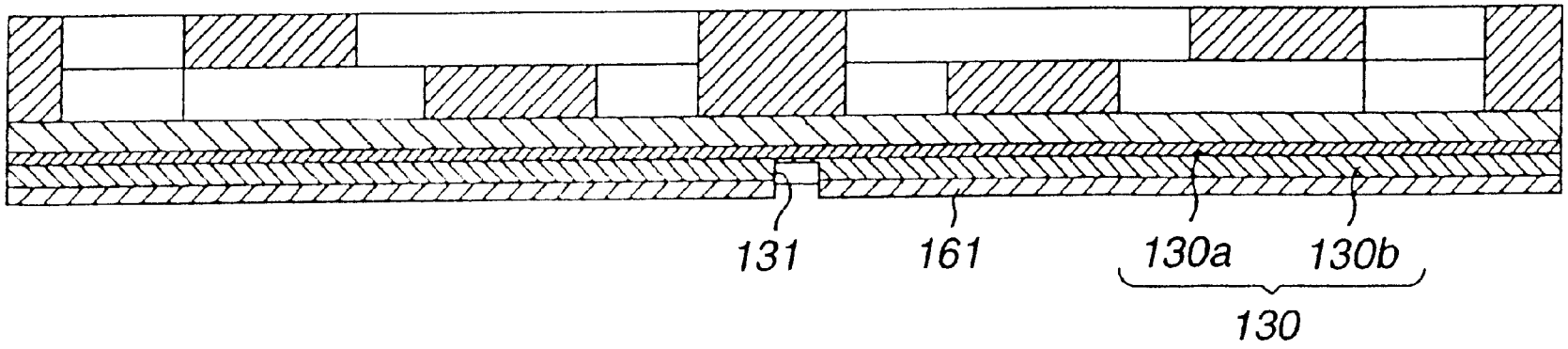
FIG. 50 is a cross-sectional view of the pressure chamber forming member of the print head after pattern etching the liquid-repellent membrane to form a groove.

Then, as shown in FIG. 50, the pattern etching of the liquid-repellent membrane 130 is made with the mask material 161 used as a masking plate, to form the groove 131. With photolithography the depth of the groove 131 can be formed stably and precisely. If the first and second layers 130*a* and 130*b* are made of PIX™, which is a paintable polyimide material available from Hitachi Chemicals Co., or Semicofine™, which is a paintable polyimide available from Toray Industries, Inc., use of an organic solvent such as NMD-3™, which is a developing agent available from Tokyo Applied Chemical Industry Co., would be beneficial because it allows precise etching. In this process, as the heat treatment temperature T1 for the first layer 130*a* of the liquid-repellent membrane 130 is placed higher than the heat treatment temperature T2 for the second layer 130*b*, etching proceeds slower in the first layer 130*a* than in the second layer 130*b*, which allows the second layer 130*b* to be selectively processed finely, and the groove to be formed precisely.

Figure 51:
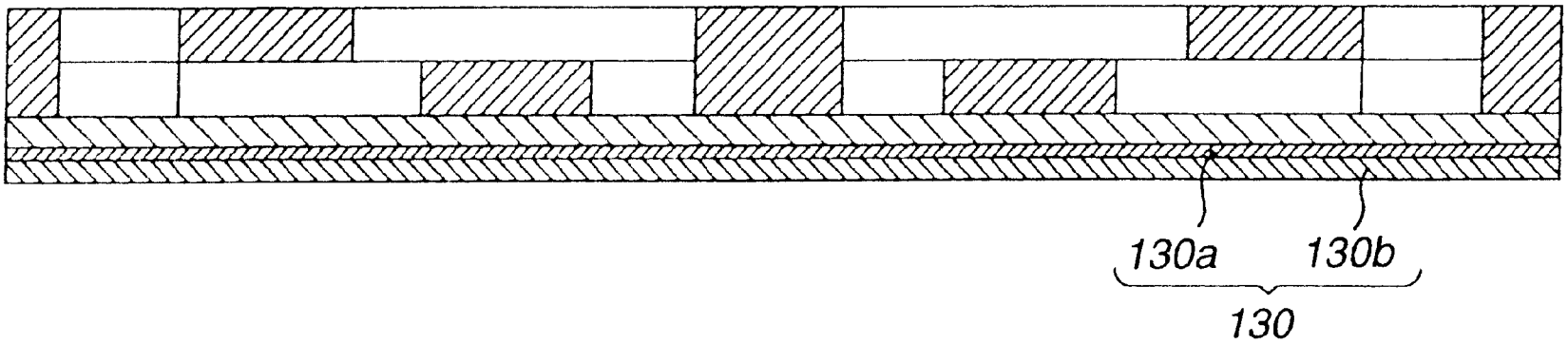
FIG. 51 is a cross-sectional view of the pressure chamber forming member of the print head after the masking material is removed.

Then, the masking material 161 is removed from the assembly by the use of a specific solvent (for example, acetone), and subjected to a heating treatment for the final polymerization, whereby liquid-repellency is conferred to the first and second layers 130*a* and 130*b* of the liquid-repellent membrane 130, and the liquid-repellent membrane 130 is produced as shown in FIG. 51. It is noted that the groove is omitted from FIG. 51 onward. The heating treatment preferably consists of heating at 350° C. for about 60 minutes.

The above description is directed to the liquid-repellent membrane 130 whose first and second layers are made of the same material or a material which undergoes imide polymerization at the final polymerization process. However, it is possible to use as a material for the second layer 130*b*, for example, Yupicoat™ (available from Ube Industries Ltd.), which is a material that has undergone polymerization prior to use and can undergo the final polymerization different from imide polymerization at a comparatively low temperature (e.g., 160 to 180° C.). In this case, application of the second superficial layer 130*b* preferably takes place before the first underlying layer 130*a* is put to the final polymerization or, in other words, before the first layer 130*a* is conferred a liquid-repellent property.

If Yupicoat™, which is a paintable polyimide material available from Ube Industries Ltd., is employed, the assembly should be maintained at 70–90° C. for 30 to 40 minutes to allow the solvent to evaporate, and the second layer 130*b* should be formed on the assembly thus dried.

Figure 52:
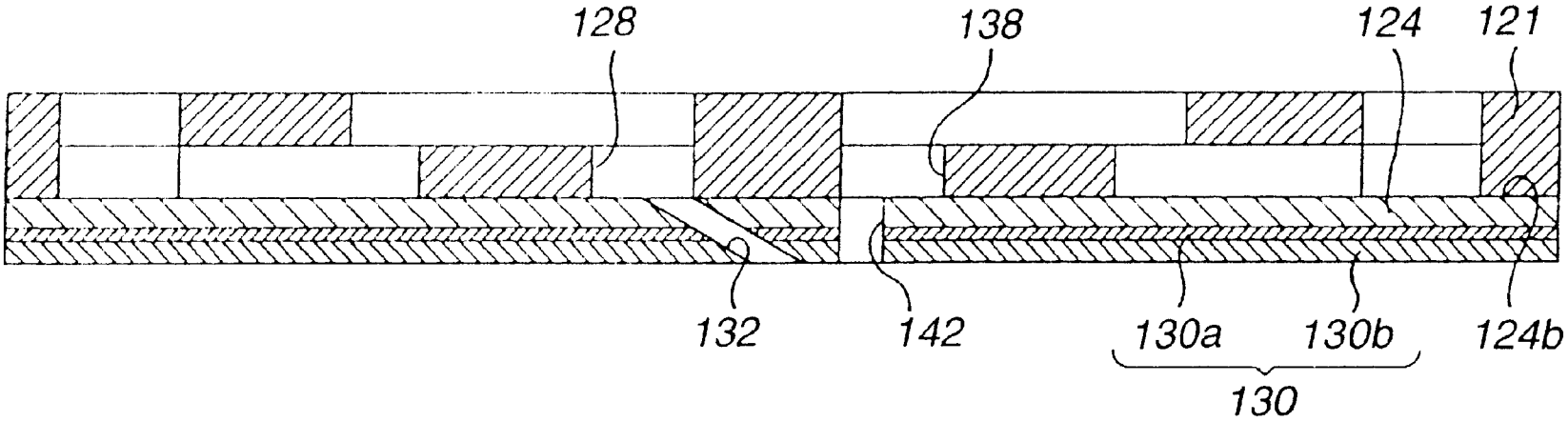
FIG. 52 is a cross-sectional view of the pressure chamber forming member of the print head after the diluent nozzle and the ink nozzle are formed by laser irradiation.

Then, as shown in FIG. 52, a laser is irradiated with a right angle onto the main surface 124*b* of the orifice plate 124 carrying the pressure chamber forming member 121 via the third concave surface 138, to form the diluent nozzle 142 penetrating the orifice plate 124 and the first and second layers 130*a* and 130*b* of the liquid-repellent membrane 130.

Further, a laser is irradiated with a slanted angle onto the main surface 124*b* of the orifice plate 124 carrying the pressure chamber forming member 121 via the sixth concave surface 128, to form the ink nozzle 132 penetrating the orifice plate 124 and the first and second layers 130*a* and 130*b* of the liquid-repellent membrane 130, thereby to complete the orifice plate 124. The laser light should be directed to the assembly such that the ink nozzle 132 produced therewith comes closer to the opening of the diluent nozzle 142 as it approaches its opening. In this process, as the orifice plate 124 and the first and second layers of the membrane 130 are all made of a polyimide material, which is easily processed by laser, the ink and diluent nozzles 132 and 142 can be easily formed.

As the third concave surface 138 forming the diluent conduit 156 and the sixth concave surface 128 forming the ink conduit 146 have a larger diameter than do the diluent and ink nozzles 142 and 132, a high precision alignment of the orifice plate 124 and the pressure chamber forming member 121 prior to laser processing is not required. Thus, the risk of the presence of the pressure chamber forming member 121 to intercept laser light during processing can be avoided.

Figure 53:
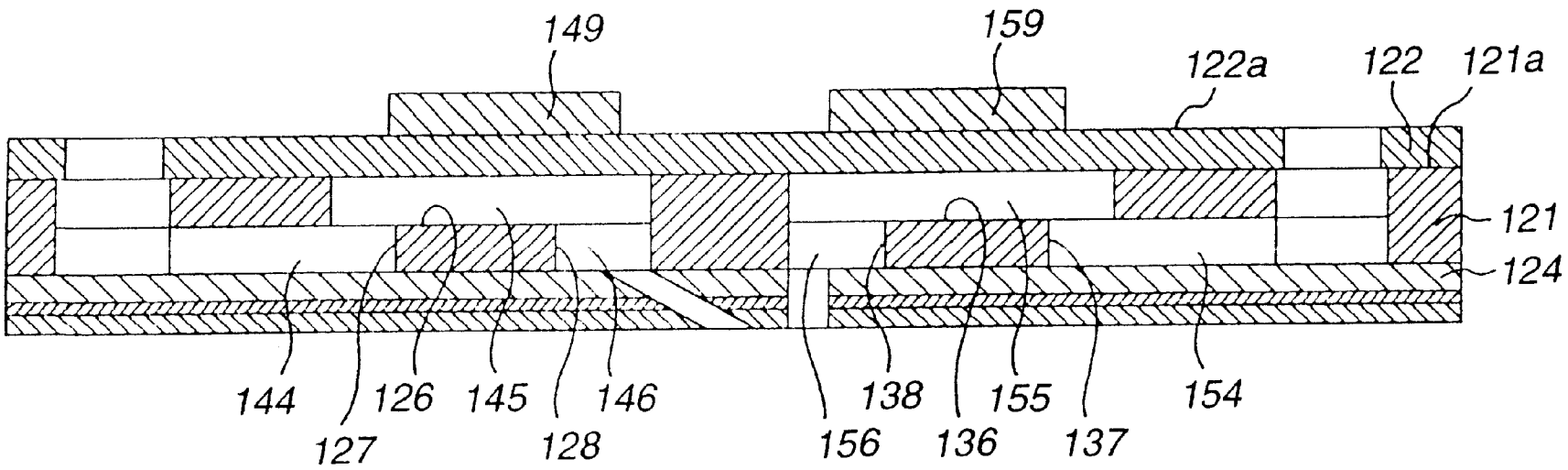
FIG. 53 is a cross-sectional view of the pressure chamber forming member of the print head after a vibrating plate is bonded onto the main surface of the pressure chamber forming member.

Then, as shown in FIG. 53, the vibrating plate 122, on one surface 122*a* of which the projections 149 and 159 have been fixed at specific positions, is bonded with an epoxy bonding agent (not shown) onto the main surface 121*a* of the pressure chamber forming member 121 opposite to the surface upon which the orifice plate 124 has been fixed. In this case, as the second, third, fifth and sixth concave surfaces 137, 138, 127 and 128 are all formed on the main surface 121*b* of the pressure chamber forming member 121 opposite to the surface 121*a* upon which the vibrating plate 122 is to be placed, occlusion of those concave surfaces due to the presence of excess bonding agent would be effectively avoided during the bonding process of the vibrating plate 122.

As this process allows the pressure chamber forming member 121 to be inserted between the vibrating plate 122 and the orifice plate 124, a diluent feed channel is formed around the second concave surface 137, a diluent pressurizing chamber is formed over the first concave surface 136, and a diluent conduit 156 is formed around the third concave surface 138.

In the same manner, an ink feed channel is formed around the fifth concave surface 127, an ink pressurizing chamber 145 is formed over the fourth concave surface 126, and an ink conduit 146 is formed around the fifth concave surface 128. As the printing apparatus of this example, as described above, has a constitution wherein the second and fifth concave surfaces 137 and 127 have been formed on the main surface 121*b* of the pressure chamber forming member 121 opposite to the surface 121*a* upon which the vibrating plate 122 is to be placed, an increase in flow resistance through the diluent and ink feed channels 154 and 144 can be avoided.

This arrangement further allows a far wider selection of usable bonding agents for bonding the pressure chamber forming member 121 and the vibrating member 122.

When the vibrating plate 122 is bonded onto the pressure chamber forming member 121, only the alignment of the projection 159 to the first concave surface 136, which forms part of the diluent pressurizing chamber 155, and the alignment of the projection 149 to the fourth concave surface 126, which forms part of the ink pressurizing chamber 145, may be taken into consideration. Thus, a bonding of the vibrating plate 122 to the pressure chamber forming member 121 will take place easily.

Then, the first layered piezo-electric element 123*a* is bonded onto the projection 159, and the second layered piezo-electric element 123*b* is bonded onto the second projection 149 with, for example, an epoxy bonding agent. The diluent feed channel 160 is allowed to communicate with the passage 139 penetrating the vibrating plate 122, and the ink feed channel 150 to communicate with the passage 129 also penetrating the vibrating plate 122, to complete the print head, as shown in FIG. 38.

The print head of the printing apparatus of this example allows even a minute amount of ink to mix stably with diluent, and thus makes it unnecessary to place, so as to widen reproducible graded tones, the diluent and ink nozzles 142 and 132 as near as possible to each other. Accordingly, during the boring process (laser processing in this example) whereby the diluent and ink nozzles 142 and 132 are formed during the manufacture of the print head, it becomes unnecessary to precisely align the involved members with respect to each other, which leads to lowering of production cost and stable manufacture of the product.

Figure 54:
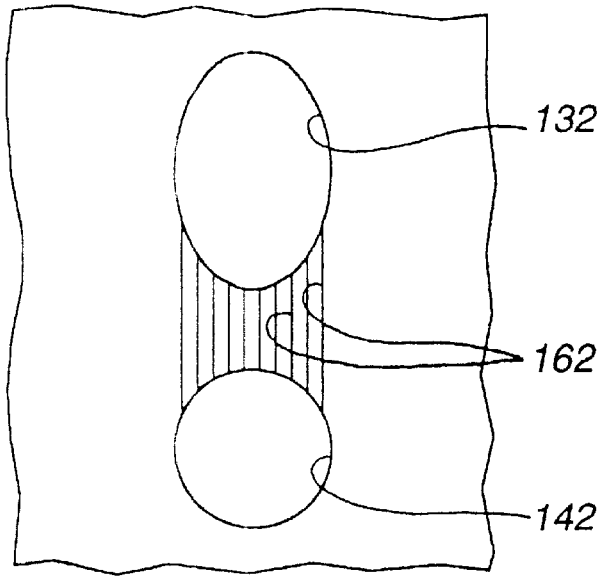
FIG. 54 is an enlarged plan view of the print head of a printing apparatus according to the present invention having a groove in the form of a plurality of lines extending between the nozzles.

In the print head of the printing apparatus of this example, the groove to be formed between the openings of the diluent and ink nozzles can take the form of a plurality of lines 162 stretching between the openings of the diluent and ink nozzles 142 and 132, as shown in FIG. 54.

Figure 55:
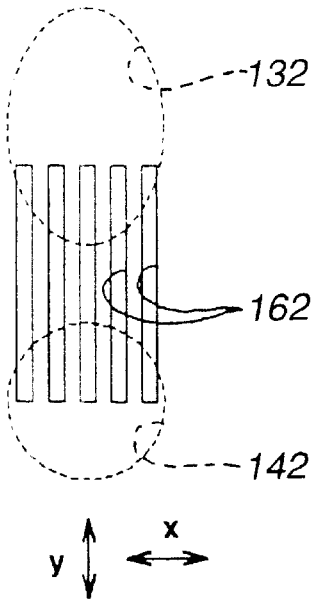
FIG. 55 is an enlarged schematic view of the grooves extending between the nozzles in the print head shown in FIG. 54.

If the groove includes a plurality of lines 162, precise alignment of the nozzles can be slackened because, even if the positions of the diluent and ink nozzles 142 and 132 are displaced from the prescribed positions, some lines or ridges between the lines are always positioned close to the center of the area sandwiched by the diluent and ink nozzles 142 and 132. As shown in FIG. 55 schematically, the tolerable crosswise alignment of the diluent and ink nozzles 142 and 132 with respect to the groove with a plurality of lines 162 (i.e., the crosswise tolerance indicated by X) can be increased.

Further, when the groove is made after the diluent and ink nozzles 142 and 132 have been formed, as in the above production method, the tolerable lengthwise alignment of the diluent and ink nozzles 142 and 132 with respect to the groove with a plurality of lines 162 (i.e., the lengthwise tolerance indicated by Y) can be increased.

Figure 56:
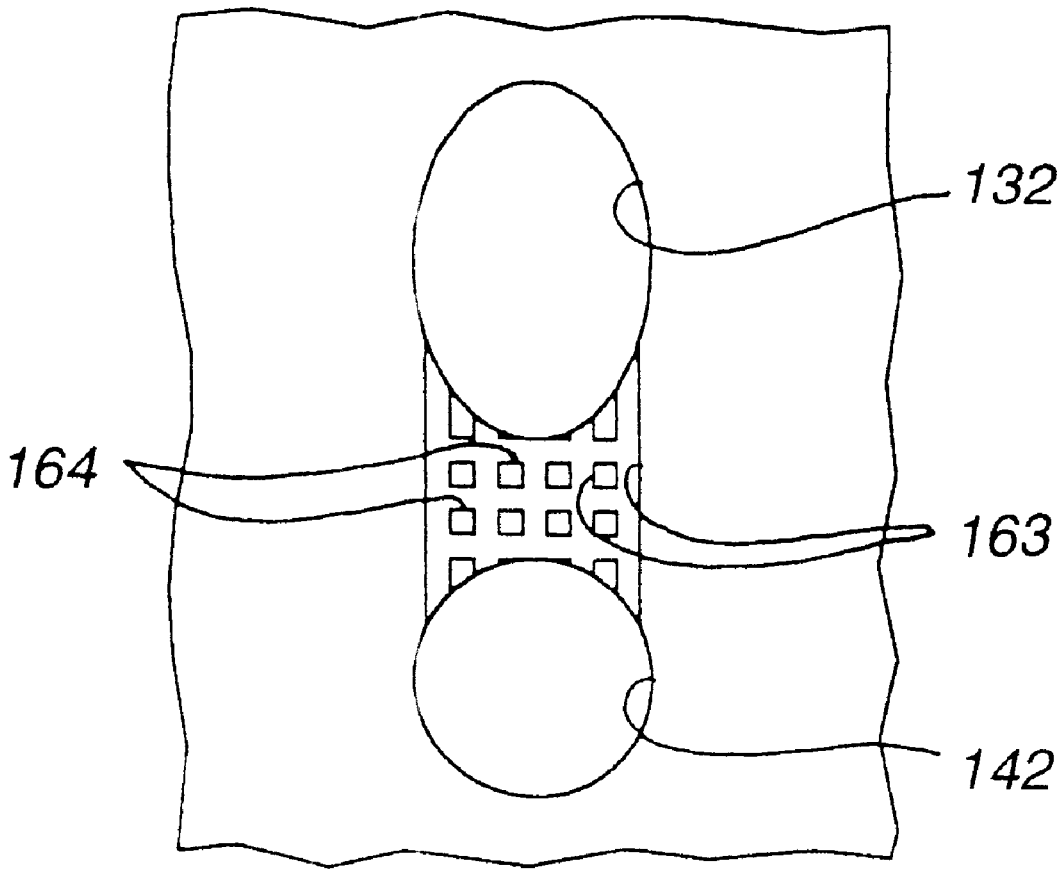
FIG. 56 is an enlarged plan view of the print head of a printing apparatus according to the present invention having a groove in the form of a plurality of lines extending between the nozzles and a plurality of lines extending at a right angle to the lines between the nozzles.

The groove formed between the openings of the diluent and ink nozzles 142 and 132 can take any form that increases the surface roughness of the area between the two openings. Thus, it can include, in addition to the parallel lines 163 running between the openings of the diluent and ink nozzles 142 and 132 as discussed above, a plurality of lines 164 running with a right angle to the lines 163, as shown in FIG. 56. The groove having parallel and crosswise lines 163 and 164, respectively, gives generally the same effect as the groove having only parallel lines 162.

A description was provided above for the case wherein PIX™, which is a paintable polyimide material provided by Hitachi Chemicals Co., or Semicofine™, which is a paintable polyimide material provided by Toray Industries, Inc., is used as a material for the second layer 130*b* of the liquid-repellent membrane 130 for the print head of the printing apparatus. These materials are particularly suitable for the second layer 130*b* because they are selectively removable by photolithography.

Another suitable material for the second layer 130*b* is a photosensitive liquid-repellent material, such as Probimide XB-7021™, which is a photosensitive, paintable polyimide material provided by FujiHunt Co., or Photonice UR-3140, which is a photosensitive paintable polyimide material provided by Toray Industries, Inc. In addition, PS-100™, which is a material produced after photosensitivity has been conferred to Yupicoat™, a paintable polyimide material provided by Ube Industries Ltd., can also be used.

Use of a photosensitive material for the manufacture of the second layer 130*b* can obviate the need for the masking material 161 used in the above process, and dispense with the process of applying/removing the mask material 161. This reduces necessary steps for production. Further, this allows the second layer 130*b* to be developed into desired form and subjected to etching, which enables a high-precision fine patterning. In above example, a suitable material for the orifice plate 124 is Neoflex™, which is a thermoplastic polyimide material with a glass transition temperature of 250° C. or less provided by Mitsui Toatsu Chemical Industry Co.

Figure 57:
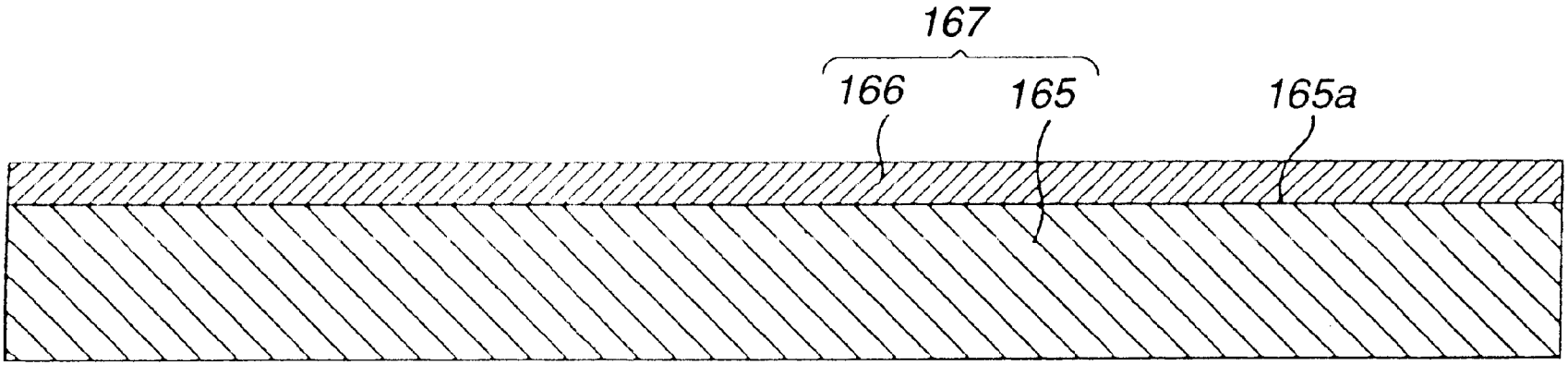
FIG. 57 is a cross-sectional view of an orifice plate of the print head of a printing apparatus according to the present invention.

However, the orifice plate can also take the following constitution. As shown in FIG. 57, a resin membrane 166 with a thickness of about 7 $\mu$m can be applied/formed on one main surface 165a of a plate 165 to form the orifice plate 167. The resin membrane 166 may comprise Neoflex™, which is a thermoplastic polyimide material with a glass transition temperature of approximately 250° C. provided by Mitsui Toatsu Chemical Industry Co. The plate 165 has a thickness of about 125 $\mu$m and may comprise Capton™, which is a polyimide film with a glass transition temperature of 250° C. or more provided by DuPont.

As this orifice plate 167 is thicker than the above-described orifice plate 124, the assembly incorporating it becomes far stronger, and the diluent nozzle formed therein becomes longer, which allows a drop of mixture to be spewed out towards a desired direction more easily. Use of the orifice plate 167 further allows the ink nozzle to have a wider selection for its slanted angle, and the interval between the diluent and the ink pressurizing chambers 155 and 145 to become wider easily. This allows secure prevention of leaks of ink and diluent.

The print head of the printing apparatus of the present invention can employ presso-electric elements instead of layered piezo-electric elements as described above, as a pressurizing means.

Figure 58:
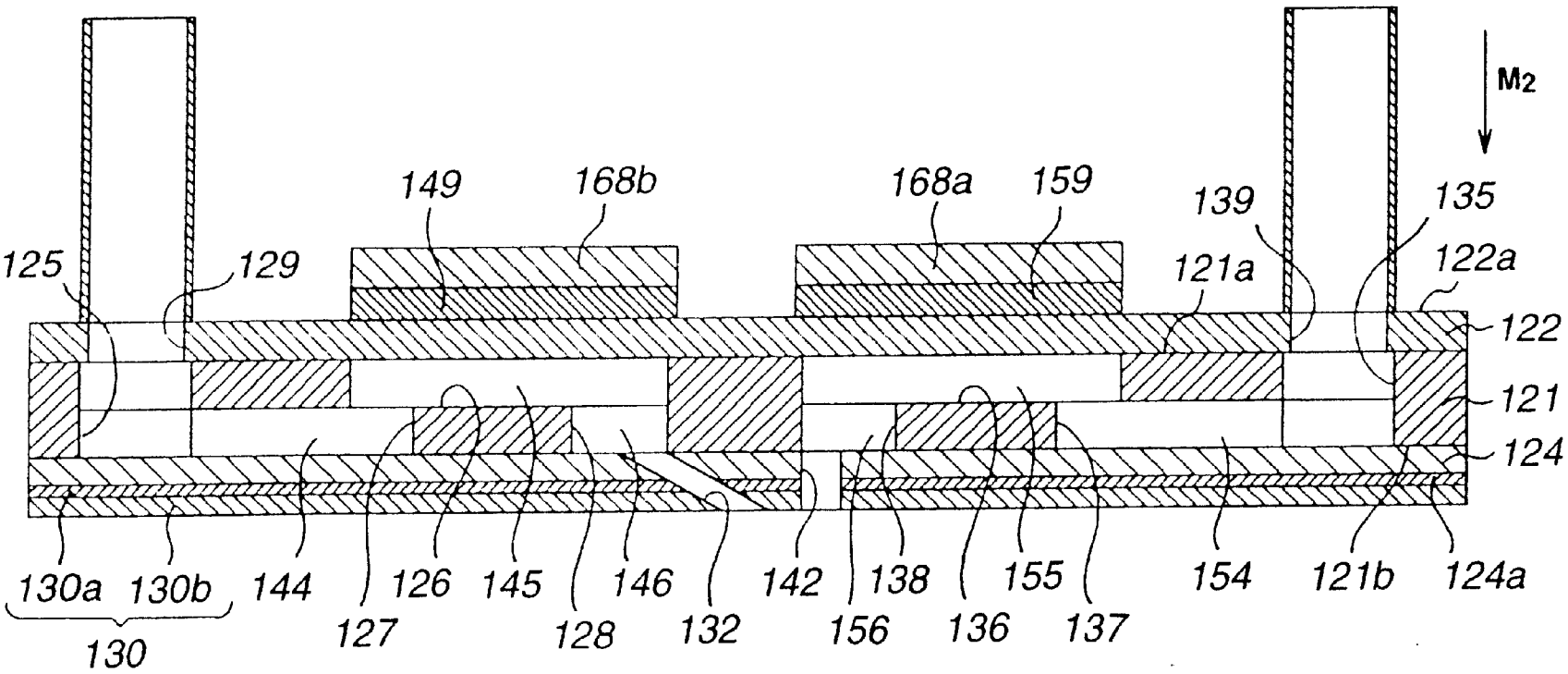
FIG. 58 is a cross-sectional view of a print head of a printing apparatus according to the present invention wherein presso-electric elements are used instead of layered piezo-electric elements to pressurize the diluent and ink chambers.

As shown in FIG. 58, the print head of the last example has the similar constitution to the one shown in FIG. 38. The parts in FIG. 58 corresponding in function to those in FIG. 38 are marked with the same symbols, and their description will be omitted for brevity. The most striking difference of the print head of FIG. 58 from the one shown in FIG. 38 is that first and second presso-electric elements 168*a* and 168*b* in the form of a plate, instead of layered piezo-electric elements 123*a* and 123*b*, are placed on the top of the projections 159 and 149, respectively.

The polarity and intensity of the voltage to be applied to the first and second presso-electric elements 168*a* and 168*b* should be so chosen as to make them contract in their axial direction. Thus, when proper voltages are provided, the first and second presso-electric elements 168*a* and 168*b* contract in their axial direction, and press the vibrating plate 122 in the direction indicated by the arrow $M_2$ via the projections 159 and 149, respectively. This results in inward bending of the vibrating plate 122.

Printing with the printing apparatus having a printing head according to the present invention preferably takes place as follows.

During standby periods, driving voltages are not applied, and ink and diluent remain at a position where equilibrium is sustained between the weight of the ink and diluent and a surrounding surface tension. A meniscus is formed close to the tip of each of the ink and diluent nozzles 132 and 142.

Figure 59:
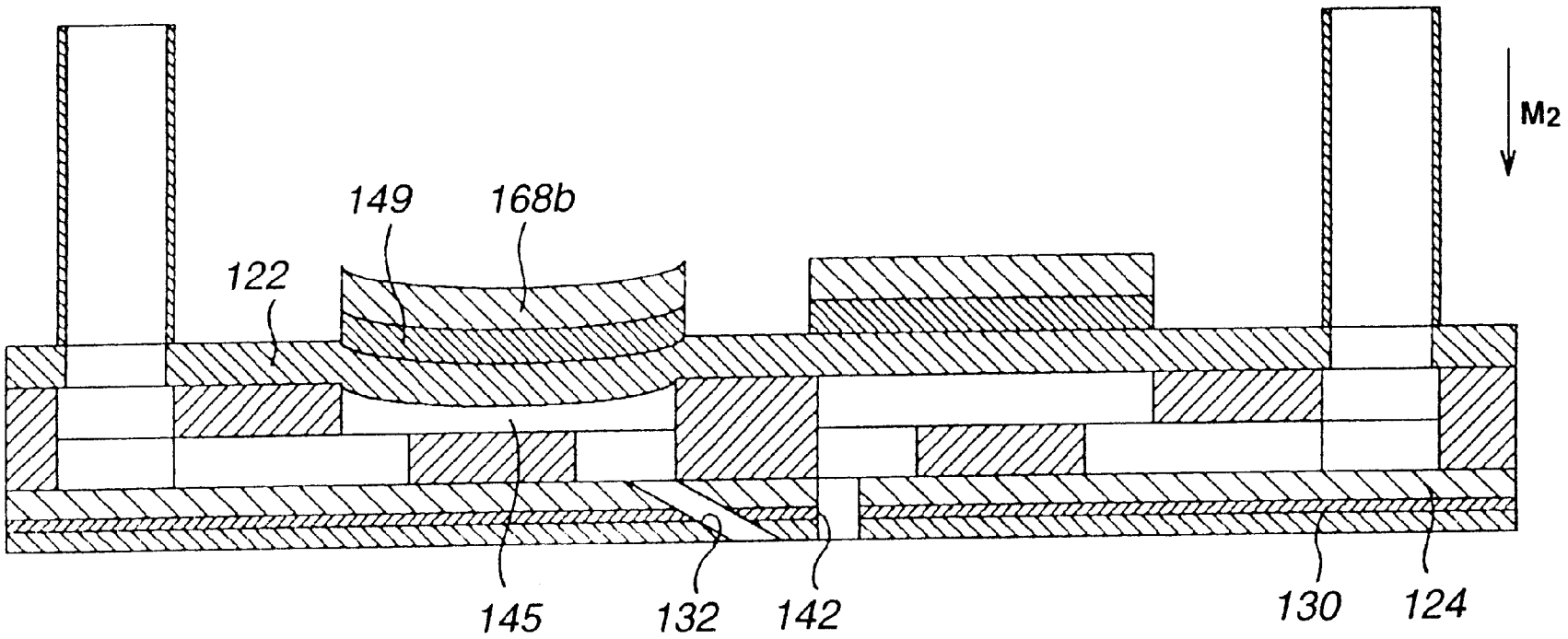
FIG. 59 is a cross-sectional view of the print head of FIG. 58 showing one of the presso-electric elements bent inward to reduce the volume of the ink pressurizing chamber.

A driving voltage is applied to the second presso-electric element 168*b* to push out a specific amount of ink. Then, as shown in FIG. 59, the second presso-electric element 168*b* bends inward, thereby reducing the volume of the ink pressurizing chamber 145 and raising its internal pressure. Ink is pushed out from the ink nozzle 132 towards the diluent nozzle 142.

The voltage applied as above to the second presso-electric element 168*b* is adjusted in intensity according to the tone of the graphic data to be reproduced. Thus, the amount of ink pushed out from the tip of the ink nozzle 132 corresponds precisely with the tone of the graphic data to be reproduced.

As the print head of this example is also provided with a groove on the liquid-repellent membrane 130 of the orifice plate 124 between the ink and diluent nozzles 132 and 142, ink, even though small in amount, is securely pushed out towards the diluent nozzle 142. This allows precise reproduction of tones of lower density. Thus, with this apparatus graded tones of a wide range of density can be reproduced faithfully, thereby enabling high resolution reproduction of real objects.

The ink pushed out from the ink nozzle 132 comes into contact with diluent forming a meniscus close to the tip of the diluent nozzle 142 to form a mixture.

Figure 60:
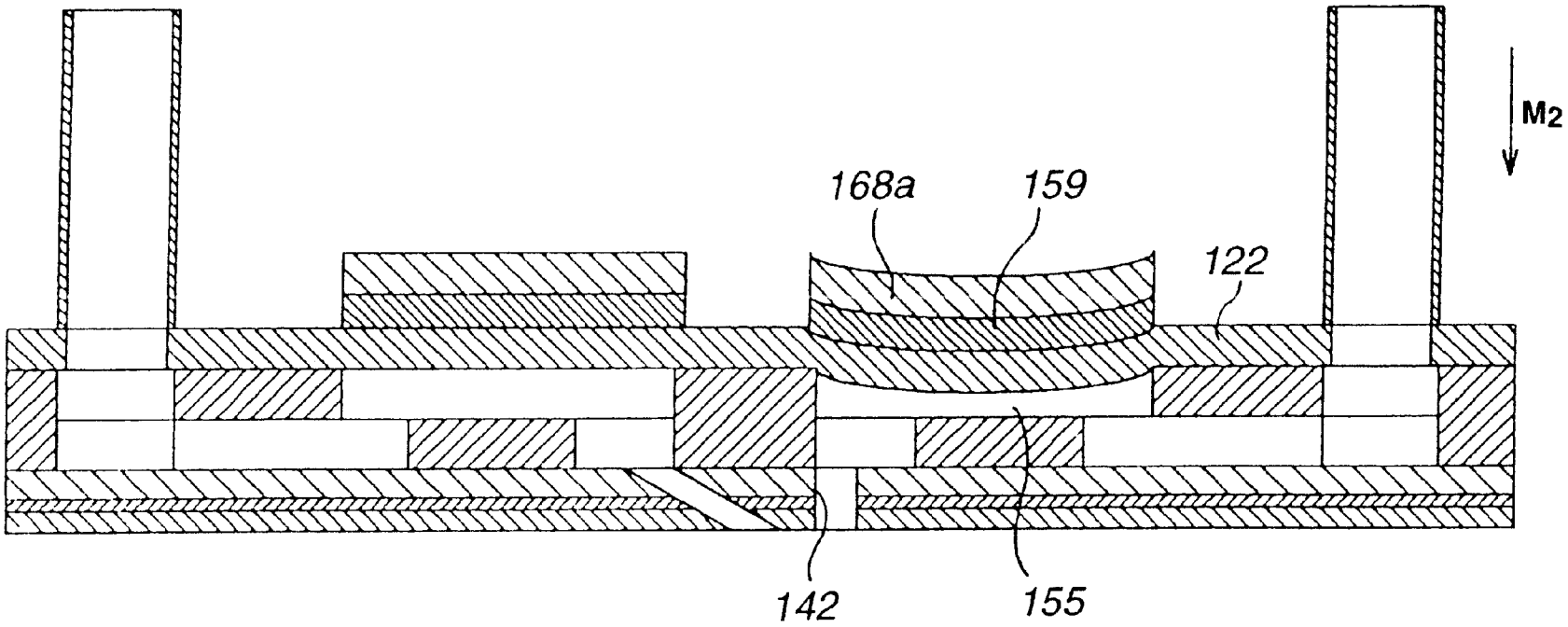
FIG. 60 is a cross-sectional view of the print head of FIG. 58 showing another one of the presso-electric elements bent inward to reduce the volume of the diluent pressurizing chamber.

A driving voltage is applied to the first presso-electric element 168*a* to spew out the diluent mixed with ink. Then, as shown in FIG. 60, the first presso-electric element 168*a* bends inward and presses the vibrating plate 122 in the direction indicated by the arrow $M_2$ via the projection 159. This movement causes the diluent pressurizing chamber 155 to reduce its volume and to increase its internal pressure, which allows the diluent mixed with ink or a mixed solution to be spewed out from the diluent nozzle 142.

The mixed solution has an ink density corresponding with the tone of the graphic data to be reproduced. In this operation, the temporary parameter of the voltage applied to the first presso-electric element 168*a* is adjusted so as to allow a mixed solution to be spewed out from the diluent nozzle 142.

The examples discussed above are directed to print heads wherein the diameter of the ink and diluent conduits 146 and 156 is larger by 30 to 50 $\mu$m than that of the ink and diluent nozzles 132 and 142. However, the present invention is not limited to those examples. The print head wherein the diameter of the ink and diluent conduits 146 and 156 is made -smaller than that of the ink and diluent nozzles 132 and 142 may be used, as long as no adverse effects are produced in association therewith when voltages are applied to the ink and diluent pressurizing chambers 145 and 155.

Further, the examples discussed above are directed to print heads wherein the ink and diluent feed channels 144 and 145 and the ink and diluent conduits 146 and 156 are placed on the orifice plate 124. However, the channels and/or conduits may instead be placed on the vibrating plate 122.

Furthermore, the examples discussed above are directed to print heads wherein the pressure chamber forming member and the orifice plate exist as separate entities. However, a single orifice plate can be modified so as to provide all the functions of the related members described above.

Figure 61:
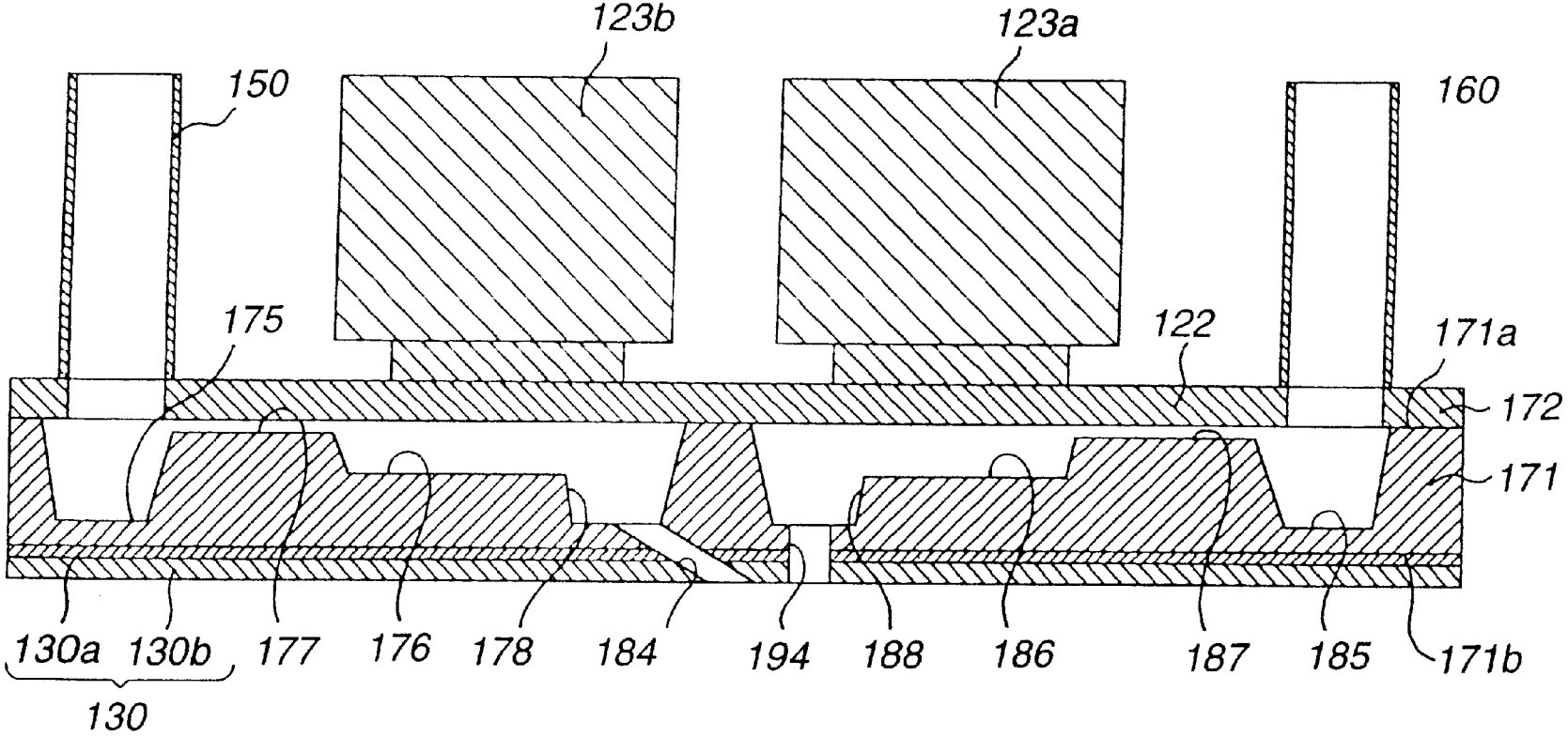
FIG. 61 is a cross-sectional view of a print head of a printing apparatus according to the present invention in which a modified orifice plate is provided.

A print head provided with the above properties is shown in FIG. 61. The orifice plate 171 is formed through injection molding. This orifice plate 171 is fabricated such that a trough 185 facing a main surface 171*a* to act as the diluent buffer tank, a second concave surface 187 forming part of the diluent feed channel, a first concave surface 186 forming part of the diluent pressurizing chamber, and a third concave surface 188 forming part of the diluent conduit communicate with each other. The diluent nozzle 194 penetrates from the bottom of the third concave surface 188 up to a main surface 171*b* opposite to the main surface 171*a*.

Further, this orifice plate 171 is fabricated such that a trough 175 facing a main surface 171*a* to act as the ink buffer tank, a fifth concave surface 177 forming part of the ink feed channel, a fourth concave surface 176 forming part of the diluent pressurizing chamber, and a fifth concave surface 178 forming part of-the ink conduit communicate with each other. The ink nozzle 184 penetrates from the bottom of the fifth concave surface 178 up to a main surface 171*b* opposite to the main surface 171*a*. A material appropriate for the manufacture of the orifice plate may include polyimide, polybenzimidazol, and the like.

The first and second layers 130*a* and 130*b* constituting the liquid-repellent membrane 130 are formed on the main surface 171*b* upon which the diluent and ink nozzles 194 and 184 of the orifice plate 171 open their mouths. Further, the vibrating plate 122 for carrying the first and second layered piezo-electric elements 123*a* and 123*b* is placed onto the main surface 171*a*, and ink and diluent feed channels are also prepared. The parts corresponding in function to the print heads described above are marked with the same symbols, and their description will be omitted for brevity.

The print head of the printing apparatus of this example has a constitution similar to above-described examples wherein a groove (not shown) is formed on a liquid-repellent membrane between the openings of the diluent and ink nozzles 194 and 184, and gives the same printing effects.

Although the examples discussed above are directed to a print head wherein the vibrating plate has a size sufficient to cover the whole main surface of the pressure chamber forming member, the vibrating plate may instead have a size only sufficient to cover the ink and diluent pressurizing chambers. In this case, as the vibrating plate becomes considerably smaller, its bonding to the pressure chamber forming member becomes quite easy.

Further, the examples discussed above are directed to a print head wherein the pressure chamber forming member is made of a metal plate with a thickness of about 0.2 mm, but the metal plate is not limited to that size. The metal plate may instead have any thickness as long as it is 0.1 mm or more and has a sufficient strength to withstand an etching process.

Furthermore, the examples discussed above are directed to a print head wherein bonding of the orifice plate to the pressure chamber forming member takes place at about 230° C. under a pressure of 20 to 30 kgf/cm$^2$, but the present invention is not limited to that condition. Bonding of the orifice plate to the pressure chamber forming member can take place under any conditions, as long as the resulting bonding is sufficiently strong.

Still further, the examples discussed above are directed to a print head wherein nozzles are formed by liquid laser processing, but the present invention is not limited to that type of processing. Various other lasers, including carbon dioxide laser, can be used for the present invention.

Still further, the examples discussed above are directed to a print head wherein the pressure is applied to the respective pressurizing chamber to pressurize the internal solution, but other types of pressurization are also possible. Further, the nozzle has been used as a route through which a specific amount of liquid is ejected or displaced, but other forms of route are also possible.

Still further, the examples discussed above are directed to a print head wherein the orifice plate is made of a resin with a glass transition temperature of 250° C. or less, such as a thermoplastic polyimide material provided by Mitsui Toatsu Chemicals Co. having a thickness of 50 $\mu$m and a glass transition temperature of 250° C. or less, but the printer apparatus of the present invention is not limited to such material. Various other kinds of resin materials can also be used.

Further, in one example described above, a resin membrane with a thickness of about 7 $\mu$m comprising Neoflex™, which is a thermoplastic polyimide material with a glass transition temperature of 250° C. provided by Mitsui Toatsu Chemical Industry Co., is applied/formed on a plate with a thickness of about 125 $\mu$m comprising Capton™, which is a polyimide film with a glass transition temperature of 250° C. or more provided by DuPont, to form the orifice plate. However, the composition of the orifice plate is not limited to this particular construction. Various materials can be employed, as long as they allow production of a composite plate consisting of a plate with a glass transition temperature of 250° C. or more, and a resin membrane with a glass transition temperature of 250° C. or less.

Figure 62:
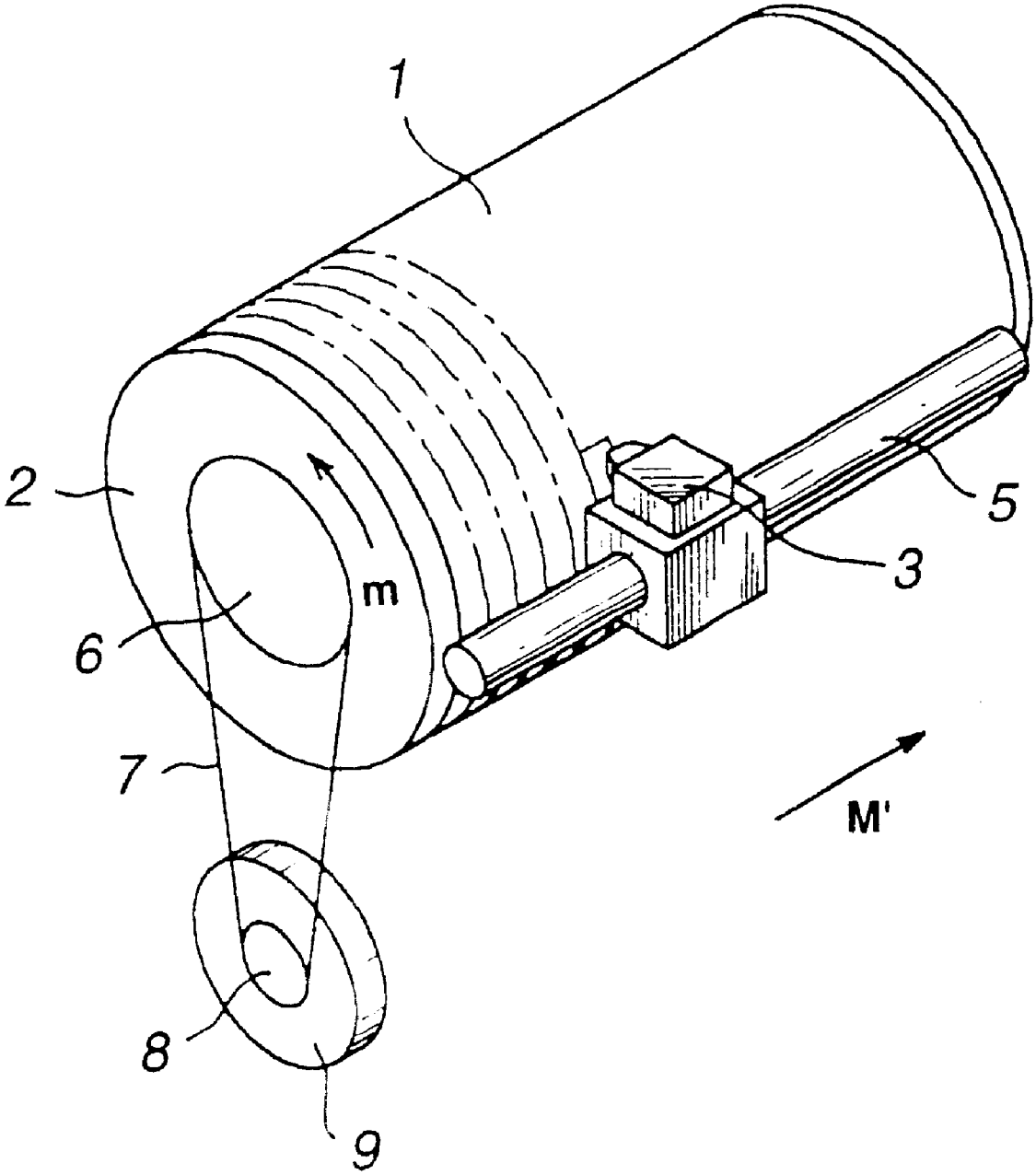
FIG. 62 is a schematic perspective view illustrating a drum-revolving type printing assembly according to the present invention.

The printing apparatus described above in relation to the present invention is of a serial or line printing type, but it can also be a drum-revolving type. The drum-revolving type printing apparatus, for example, can have a constitution as shown in FIG. 62. The parts corresponding in function to those shown in FIG. 5 are marked with the same symbols, and their description will be omitted for brevity. The control mechanism is also omitted.

In this printing apparatus, a drum 2 revolves, ink is ejected from a print head part 3 in synchrony with the revolution of the drum, and an image is formed on the printing paper 1. When the drum 2 makes a complete rotation in the direction indicated by the arrow m in FIG. 62, and printing of a line is completed on the paper 1 along the circumference of the drum, a transfer screw 5 is rotated such that the print head part 3 is displaced by one pitch in the direction indicated by the arrow M' in FIG. 62 into a position for printing for the next circumferential line. As an alternative, the drum 2 and the transfer screw 5 can be allowed to rotate at the same time, thereby displacing the print head part 3 gradually while performing printing. When the printing apparatus has a multi-nozzle head or a constitution whereby printing can be repeated on the same location, the drum 2 and the transfer screw 5 are interlocked to rotate together, to thereby print in a spiral form.

The examples discussed above are directed to a carrier-jet type of printing apparatus. However, the present invention can also be applied to an ink-jet type of printing apparatus with a density modulation variation. The ink-jet type of printing apparatus with a density modulation variation generally reproduces low density tones worse than a carrier-jet type of printing apparatus, but provides a sufficient ink density for high density tones.

Both the carrier-jet type and the ink-jet type of printing apparatus with a density modulation allow reproduction of so-called continuously graded tones and, thus, are most appropriate for printing images from photographs which require smooth reproduction of subtle shades.

EXAMPLE

The following experiments were conducted to confirm the advantages of the printing apparatus of the present invention. In the printing apparatus that was tested, a liquid-repellent membrane was formed around the openings of the nozzles of the print head, and part of the liquid-repellent membrane selectively removed to form a groove there.

An experiment was conducted to check whether the preparation of the groove on the liquid-repellent membrane would improve the wettability of the involved membrane.

Figure 63:
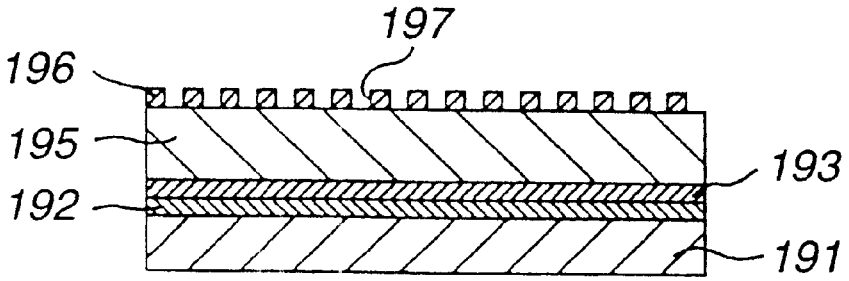
FIGS. 63, 64, and 65 are cross-sectional views of a liquid-repellent membrane showing the steps of an experiment conducted to check whether a groove on the liquid-repellant membrane would improve the wettability of the involved membrane.

First, samples were prepared. As shown in FIG. 63, a $Ta_2O_5$ sputter membrane 192 with a thickness of 0.05 $\mu$m was formed on the Si substrate 191 with a thickness of 0.5 mm, another $SiO_2$ sputter membrane 193 with a thickness of 0.05 $\mu$m was formed thereupon, a first polyimide membrane 195 with a thickness of 1 $\mu$m was formed thereupon, and finally a second polyimide membrane 196 with a thickness of 0.03 $\mu$m was formed as the uppermost layer which has had its parts removed corresponding in form to the groove 197. This was sample 1. As is evident from above, the groove 197 in sample 1 had a depth of 0.03 $\mu$m.

Figure 64:
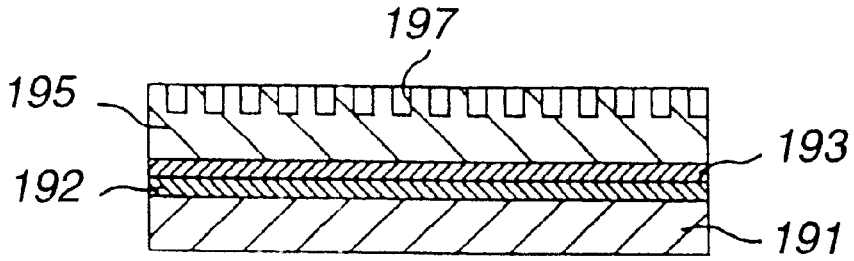

Next, as shown in FIG. 64, a $Ta_2O_5$ sputter membrane 192 was formed on the Si substrate 191, another $SiO_2$ sputter membrane 193 was formed thereupon, a first polyimide membrane 195 was formed thereupon, and then part of the first polyimide membrane 193 was removed to form a groove 197 therein. This was sample 2. As is evident from above, the groove 197 in sample 2 had a depth of 0.04 to 0.08 $\mu$m.

Figure 65:
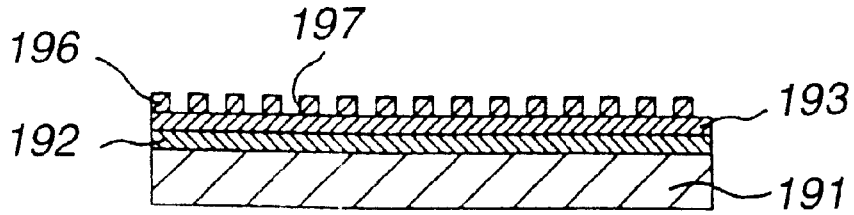

In addition, as shown in FIG. 65, a $Ta_2O_5$ sputter membrane 192 was formed on the Si substrate 191, another $SiO_2$ sputter membrane 193 was formed thereupon, a first polyimide membrane 195 was formed thereupon, and finally the second polyimide membrane 196 with a thickness of 0.03 $\mu$m was formed as the uppermost layer, which had its parts removed corresponding in form to the groove 197. This was sample 3. As is evident from above, the groove 197 in sample 3 had a depth of 0.03 $\mu$m.

The patterning interval was determined as 2.5 $\mu$.m for each sample. Each line of the groove had a width of about 1.0 $\mu$m, and each ridge between the lines had a width of about 1.5 $\mu$m.

A solution for which water and glycol had been mixed so as to give a surface tension of 31 to 32 dyn/cm when in contact with the groove surface of each sample, was allowed to contact with the groove. A contact angle towards the groove and the contact angle in the direction perpendicular to the foregoing direction were measured. Pure water was used instead of ink, and a contact angle towards the groove and the angle perpendicular to the foregoing angle were measured. When pure water was allowed to contact with the second polyimide membrane 196 or a membrane which was assumed to have a completely flat surface, the contact angle was 92.3 degrees. The results are shown in Table 1. In the table, A represents the contact angle towards the groove, and B represents the contact angle in the direction perpendicular to the foregoing direction.

TABLE 1

RESULTS OF WETTABILITY EXPERIMENT

| | Ink (31–32 dyne/cm) | | Pure Water (92.3°) | |
|---|---|---|---|---|
| | A | B | A | B |
| Sample 1 | 44.5° | 46.5° | 87.7° | 86.4° |
| Sample 2 | 41.3° | 44.1° | 80.6° | 80.9° |
| Sample 3 | 9.7° | 12.7° | 75.7° | 74.3° |

As is evident from inspection of the results in Table 1, when pure water allowing a big surface tension was used, no difference was observed between the two contact angles in the direction towards the groove and in the direction perpendicular thereto, for all the samples.

Comparison of the results from samples 1 and 2, and those from sample 3 indicates that samples 1 and 2, whose groove has no liquid-repellent membrane on its bottom, do not readily become wet, while sample 3, whose groove has a liquid-repellent membrane on its bottom, readily becomes wet. If a liquid-repellent membrane were not formed on the groove, spontaneous mixing of liquids from the nozzles would occur. Comparison of the results from samples 1 and 2 suggests that the depth of the groove may affect its wettability.

Further, as is evident from the results in Table 1, when ink allowing a small surface tension is used, both the contact angles in the direction towards the groove and in the direction perpendicular thereto are smaller than those with pure water, for all the samples, suggesting that the samples become readily wet when in contact with ink.

Further, a difference was observed between the two contact angles in the direction towards the groove and in the direction perpendicular thereto, for all the samples; the former was smaller than the latter. This suggests that it is possible to harness a liquid to flow more in the direction of the groove.

From the above experimental results, it is apparent that when a groove is formed so as to communicate the openings of ink and diluent nozzles as seen in above-described printing apparatuses, ink becomes vented to flow in the direction of the groove. Accordingly, it has been confirmed that, when a groove is formed close to the openings of the nozzles as in the print head of the present invention, it is possible to control the direction towards which a metering medium is pushed out, and also to prevent spontaneous mixing of media by forming a liquid-repellent membrane on the bottom of the groove.

Although a carrier-jet-type printing apparatus has been described in the above-described embodiments, the present invention is also applicable to an ink-jet-type printing apparatus which can adjust concentration by mixing the ink with a diluent before discharging. The ink-jet-type printing apparatus capable of adjusting concentration is inferior to the carrier-jet-type printing apparatus in low concentration, but it can operate comparably at high concentrations.

In addition, both of the carrier-jet-type printing apparatus and the ink-jet-type printing apparatus capable of adjusting concentration can record the so-called continuous gradation. Thus, both types of printing apparatus are suitable for printing a photograph image because they can smoothly express concentration.

As described above, the printing apparatus according to the present invention has a groove formed between the orifice of the first nozzle and the orifice of the second nozzle whose orifice is adjacent to the orifice of the first nozzle in the nozzle outlet face, and the metering medium oozing from the second nozzle travels along the above-described groove owing to a capillary action and is fed to the first nozzle. Thus, the metering medium hardly leaks to the part other than the groove, which therefore prevents the metering medium from adhering to the portion around the orifice of the nozzle.

Further, if the groove is formed from the orifice of the second nozzle to the middle part between the orifice of the second nozzle and the orifice of the first nozzle, the metering medium is well introduced into the second nozzle when the metering medium is introduced into the second nozzle so as to quantify the metering medium by making the metering medium ooze from the second nozzle toward the first nozzle and then making a given quantity of the metering medium remain around the orifice of the first nozzle. The groove thereby prevents the metering medium from adhering to the portion around the orifice of the nozzle.

Further, if the groove is formed from the orifice of the first nozzle to the middle part between the orifice of the first nozzle and the orifice of the second nozzle, the metered amount of the metering medium is better separated from the introduced-metering medium, which thereby prevents the metering medium from adhering to the portion around the orifice of the nozzle.

If the width of the groove is smaller than the orifice of the second nozzle, the capillary action further tends to occur.

Further, when the groove is formed from the orifice of the second nozzle to the middle portion between the orifice of the second nozzle and the orifice of the first nozzle, if the depth of the groove is made gradually smaller from the second nozzle toward the first nozzle, the metering medium is better metered.

Further, when the groove is also formed from the orifice of the first nozzle to the middle part between the orifice of the first nozzle and the orifice of the second nozzle, if the depth of the groove is made gradually smaller from the first nozzle toward the second nozzle, the metering medium is still better metered.

Further, if the printing apparatus according to the present invention has a recess formed at least around the orifice of the second nozzle in a nozzle outlet face of the printing head so as to surround the orifice of the second nozzle therewith and, in addition, a recess formed around the orifice of the first nozzle so as to surround the orifice of the first nozzle therewith, it can prevent the ink, the diluent and the mixed solution thereof from spreading around the orifice of the nozzle.

Further, since the printing apparatus according to the present invention has a hydrophilic portion formed between the orifice of the first nozzle and the orifice of the second nozzle whose orifice is adjacent to the orifice of the first nozzle in the nozzle outlet face of the printing head, for example, from the orifice of the second nozzle to the orifice of the first nozzle, and wettability of the above-described hydrophilic portion for the metering medium is considerably good, the metering medium oozing from the second nozzle travels along the above-described hydrophilic portion and is fed to the first nozzle and hardly leaks to the portion other than the above-described hydrophilic portion, which prevents the metering medium from adhering to the portion around the orifice of the nozzle.

Further, if the above-described hydrophilic portion is formed from the orifice of the second nozzle to the middle part between the orifice of the second nozzle and the orifice of the first nozzle, the metering medium is well introduced into the second nozzle when the metering medium is introduced into the second nozzle so as to quantify the metering medium by making the metering medium ooze from the second nozzle toward the first nozzle and then making a metered amount of the metering medium remain around the orifice of the first nozzle, which thereby prevents the metering medium from adhering to the portion around the orifice of the nozzle.

Further, if the above-described hydrophilic portion is also formed from the orifice of the first nozzle to the middle part between the orifice of the first nozzle and the orifice of the second nozzle, when the metering medium is metered as described above, the metered amount of the metering medium is still better separated from the introduced-metering medium, which thereby prevents the metering medium from adhering to the portion around the orifice of the nozzle.

Further, if the portion other than the hydrophilic portion in the nozzle outlet face of the printing head of the printing apparatus is made of a hydrophobic portion, the metering medium travels further selectively along the hydrophilic portion.

Further, if the printing apparatus according to the present invention has a hydrophilic portion formed at least around the orifice of the second nozzle in a nozzle outlet face of the printing head so as to surround the orifice of the second nozzle therewith and, in addition, also has a hydrophilic portion formed around the orifice of the first nozzle so as to surround the orifice of the first nozzle therewith, it can further prevent the ink, the diluent and the mixed solution thereof from spreading around the orifice of the nozzle.

Further, in the printing apparatus according to the present invention, if the above-described hydrophilic portion is made a non-processed portion, and the remaining portion other than the hydrophilic portion is made a hydrophobic portion, the same effect as in the case of forming the hydrophilic portion is produced.

Further, since the printing apparatus according to the present invention has an insular projection formed between the orifice of the first nozzle and the orifice of the second nozzle whose orifice is adjacent to the orifice of the first nozzle in the nozzle outlet face, and the metering medium oozing from the second nozzle travels along the contour of the above-described projection owing to a capillary action and is fed to the first nozzle, the metering medium hardly leaks to the portion other than the projection, which thereby prevents the metering medium from adhering to the portion around the orifice of the nozzle.

Accordingly, the printing apparatus according to the present invention prevents the occurrence of a worse printing and can reproduce the gradation of concentration and thus make a recorded image of high resolution.

The printing apparatus of the present invention has a further constitution wherein a liquid-repellent membrane is formed on the surface flush with the openings of the nozzles of the print head, and part of the liquid-repellent membrane between the closely opposed openings of the first and second nozzles is selectively removed to form a groove therein.

"Wettability" at an interface between a solid and a liquid depends on the roughness of the surface of the solid. Namely, when the contact angle between a solid having a substantial surface area and a liquid having a substantial surface area (i.e., when it is assumed that the surface roughness of the solid is zero) is larger than 90 degrees, wettability is more impaired as the surface roughness increases. On the contrary, when the contact angle between a solid having a substantial surface area and a liquid having a substantial surface area (i.e., when it is assumed that the surface roughness of the solid is zero) is smaller than 90 degrees, wettability is improved as the surface roughness increases.

A metering medium to be used for the printing apparatus of the present invention has a contact angle equal to or less than 90 degrees when in contact with the liquid-repellent material and, thus, its wettability is improved further as the surface roughness described above increases.

Accordingly, in the printing apparatus of the present invention, a groove formed after selective removal of a portion of the liquid-repellent membrane 130 is made to have a rougher surface than other nearby portions, thereby raising its wettability so that a metering medium, even in a minute amount, can be stably pushed towards the first nozzle. The printing apparatus of the present invention therefore allows precise reproduction of tones of low density and, thus, of graded tones of a wide range of density, thereby enabling high resolution reproduction of images.

This obviates the need for preparing the first and second nozzles as close as possible to each other, so as to broaden the width of reproducible tones, and for precisely aligning the involved members with respect to each other, which leads to lowering of production cost and stable manufacture of the product.

The printing apparatus of the present invention has a further constitution wherein the width of the groove is made smaller than the diameter of the opening of the second nozzle. Making the width of the groove smaller than the diameter of the opening of the second nozzle allows the width of the groove to be smaller than the radius of a drop of the metering medium pushed out from the second nozzle. Further, as the groove is made rougher than nearby portions, the metering medium comes to flow readily on the groove, which ensures stable movement of the metering medium towards the first nozzle.

The characteristics described above are also present in a printing head wherein the groove consists of a plurality of lines. In such a printing head, the metering medium selectively flows along those lines or their surrounds. Further, for the printing head having the groove comprising a plurality of lines, when the groove is allowed to have a width smaller than the diameter of the opening of the second nozzle, the metering medium comes to flow readily on the groove because the groove forms a rougher surface than nearby portions. This ensures stable movement of the metering medium towards the first nozzle.

Further, when the printing apparatus of the present invention is allowed to have a liquid-repellent membrane on the bottom of the groove, no spontaneous mixing takes place between the metering medium and the discharge medium during printing.

Furthermore, during manufacture of the printing apparatus of the present invention, when two layers are put upon one another to form the liquid-repellent membrane, and part of the superficial layer is selectively removed, a groove whose bottom has a liquid-repellent membrane thereupon can be prepared readily.

Still further, when the liquid-repellent membrane is made of a photosensitive polyimide material, a groove can be made easily by photolithography. When the liquid-repellent membrane is produced after two layers have been put one over the other, at least the superficial layer is preferably made of a photosensitive polyimide material. Then, a groove can be readily made by photolithography, thereby improving the productivity.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A printing apparatus comprising a print head, said print head comprising:

a first chamber into which a discharge medium is introduced;

a second chamber into which a metering medium is introduced;

a first nozzle having a first orifice, communicating with said first chamber;

a second nozzle having a second orifice, communicating with said second chamber; and first and second piezo-electric elements connected to said first and second chambers, respectively;

wherein said first and second nozzles are located in a nozzle member having a surface on which said first and second orifices are located, and further wherein said second piezo-electric element moves said metering medium from said second orifice to said first orifice through said surface, and a groove is formed in said surface between said first and second orifices, wherein said first and second nozzles are located between said first and second chambers, and wherein both first and second orifices have diameters, a width of said groove is smaller than said diameter of said second orifice, and a depth of said groove becomes gradually smaller from said second orifice to said first orifice.

2. A printing apparatus as described in claim 1, wherein said groove is connected with at least one of said first and second orifices.

3. A printing apparatus as described in claim 1, wherein said groove is connected with said second orifice.

4. A printing apparatus as described in claim 1, wherein said groove is connected with both of said first and second orifices.

5. A printing apparatus as described in claim 1, wherein said groove continues from an edge of said second orifice to a midpoint between said first and second orifices.

6. A printing apparatus as described in claim 1, wherein said groove comprises a first groove connecting with said first orifice, and a second groove connecting with said second orifice, wherein said first and second grooves are not connected with each other.

7. A printing apparatus as described in claim 6, wherein each of said grooves has a depth, wherein said depth of said first groove becomes gradually smaller in a direction away from said first orifice, and said depth of said second groove becomes gradually smaller in a direction away from said second orifice.

8. A printing apparatus as described in claim 1, wherein a recess is formed on said surface around at least said first and second orifices.

9. A printing apparatus as described in claim 1, wherein a recess is formed on said surface around said second orifice.

10. A printing apparatus as described in claim 1, wherein said surface is covered with a hydrophobic film, and said groove is defined by a removed portion of said hydrophobic film.

11. A printing apparatus as described in claim 10, wherein said hydrophobic film is a polyimide film.

12. A printing apparatus as described in claim 11, wherein said polyimide is a light sensitive polyimide.

13. A printing apparatus comprising a print head, said print head comprising:

a first chamber into which a discharge medium is introduced;

a second chamber into which a metering medium is introduced;

a first nozzle having a first orifice, communicating with said first chamber; and a second nozzle having a second orifice, communicating with said second chamber; and first and second piezo-electric elements connected to said first and second chambers, respectively;

wherein said first and second nozzles are located in a nozzle member having a surface on which said first and second orifices are located, and further wherein said second piezo-electric element moves said metering medium from said second orifice to said first orifice through said surface, and a groove is formed in said surface between said first and second orifices, and wherein said groove comprises a plurality of parallel grooves extending between said first orifice and said second orifice.

14. A printing apparatus comprising a print head, said print head comprising:

a first chamber into which a discharge medium is introduced;

a second chamber into which a metering medium is introduced;

a first nozzle having a first orifice, communicating with said first chamber; and a second nozzle having a second orifice, communicating with said second chamber; and first and second piezo-electric elements connected to said first and second chambers, respectively;

wherein said first and second nozzles are located in a nozzle member having a surface on which said first and second orifices are located, and further wherein said second piezo-electric element moves said metering medium from said second orifice to said first orifice through said surface, and a hydrophilic portion is formed in said surface between said first and second orifices, wherein said first and second nozzles are located between said first and second chambers.

15. A printing apparatus as described in claim 14, wherein a hydrophobic portion is formed on said surface elsewhere from said hydrophilic portion.

16. A printing apparatus as described in claim 14, wherein said hydrophilic portion is connected with at least one of said first and second orifices.

17. A printing apparatus as described in claim 14, wherein said hydrophilic portion is connected with both of said first and second orifices.

18. A printing apparatus as described in claim 14, wherein said hydrophilic portion continues from an edge of said second orifice to a middle part between said first and second orifices.

19. A printing apparatus as described in claim 14, wherein said hydrophilic portion comprises a first hydrophilic portion connecting with said first orifice, and a second hydrophilic portion connecting with said second orifice, wherein said first and second hydrophilic portions are not connected to each other.

20. A printing apparatus as described in claim 14, wherein said hydrophilic portion is further formed around at least one of said first and second orifices.

21. A printing apparatus as described in claim 14, wherein said hydrophilic portion is further formed around both of said first and second orifices.

22. A printing apparatus comprising a print head, said print head comprising:

a first chamber into which a discharge medium is introduced;

a second chamber into which a metering medium is introduced;

a first nozzle having a first orifice, communicating with said first chamber; and a second nozzle having a second orifice, communicating with second chamber; and first and second piezo-electric elements connected to said first and second chambers, respectively;

wherein said first and second nozzles are located in a nozzle member having a surface on which said first and second orifices are located, and further wherein said second piezo-electric element moves said metering medium from said second orifice to said first orifice through said surface, and a hydrophobic portion is formed in said surface elsewhere from between said first and second orifices, and a hydrophilic portion is formed on said surface between said first and second orifices.

23. A printing apparatus as described in claim 22, wherein said hydrophilic portion is connected with at least one of said first and second orifices.

24. A printing apparatus as described in claim 22, wherein said hydrophilic portion is connected with both of said first and second orifices.

25. A printing apparatus as described in claim 22, wherein said hydrophilic portion continues from an edge of said second orifice to a middle part between said first and second orifices.

26. A printing apparatus as described in claim 22, wherein said hydrophilic portion is further formed around at least one of said first and second orifices.

27. A printing apparatus comprising a print head, said print head comprising:

a first chamber into which a discharge medium is introduced;

a second chamber into which a metering medium is introduced;

a first nozzle having a first orifice, communicating with said first chamber; and a second nozzle having a second orifice, communicating with said second chamber; and first and second piezo-electric elements connected to said first and second chambers, respectively;

wherein said first and second nozzles are located in a nozzle member having a surface on which said first and second orifices are located, and further wherein said second piezo-electric element moves said metering medium from said second orifice to said first orifice through said surface, and an insular projection is formed in said surface between said first and second orifices without contacting either orifice.

* * * * *

UNITED STATES PATENT AND TRADEMARK OFFICE

CERTIFICATE OF CORRECTION

PATENT NO. : 6,257,700 B1
DATED : July 10, 2001
INVENTOR(S) : Takashi Aihara

It is certified that error appears in the above-identified patent and that said Letters Patent is hereby corrected as shown below:

Column 43,
Line 54, delete "orifice." and insert therefore:
-- orifice and a plurality of crosswise grooves extending at right angles to said parallel grooves, said crosswise grooves and said parallel grooves forming a grid between said first orifice and said second orifice. --

Signed and Sealed this

Tenth Day of June, 2003

JAMES E. ROGAN
*Director of the United States Patent and Trademark Office*